US011634958B2

(12) United States Patent
Davies et al.

(10) Patent No.: US 11,634,958 B2
(45) **Date of Patent: *Apr. 25, 2023**

(54) DOWNHOLE TOOL WITH BOTTOM COMPOSITE SLIP

(71) Applicant: The WellBoss Company, LLC, Houston, TX (US)

(72) Inventors: Evan Lloyd Davies, Houston, TX (US); Yi Xia, Houston, TX (US); Luis Miguel Avila, Pearland, TX (US); David Hughes, Houston, TX (US); Gabriel Slup, Houston, TX (US); Ashton E. Diaz, Tomball, TX (US)

(73) Assignee: The WellBoss Company, LLC, Houston, TX (US)

( * ) Notice: Subject to any disclaimer, the term of this patent is extended or adjusted under 35 U.S.C. 154(b) by 62 days.

This patent is subject to a terminal disclaimer.

(21) Appl. No.: 17/357,689

(22) Filed: Jun. 24, 2021

(65) Prior Publication Data

US 2021/0317717 A1 Oct. 14, 2021

Related U.S. Application Data

(63) Continuation of application No. 16/106,114, filed on Aug. 21, 2018, now Pat. No. 11,078,739.
(Continued)

(51) Int. Cl.
*E21B 23/06* (2006.01)
*E21B 33/129* (2006.01)
(Continued)

(52) U.S. Cl.
CPC ..... *E21B 23/06* (2013.01); *E21B 23/01* (2013.01); *E21B 33/1285* (2013.01);
(Continued)

(58) Field of Classification Search
CPC ..... E21B 23/01; E21B 23/06; E21B 33/124; E21B 33/134; E21B 33/1293; E21B 33/1285; E21B 34/16
See application file for complete search history.

(56) References Cited

U.S. PATENT DOCUMENTS 2,230,712 A 2/1941 Bendeler et al.
2,683,492 A 7/1954 Baker
(Continued)

FOREIGN PATENT DOCUMENTS

EP 0136659 4/1985
EP 0504848 9/1992
(Continued)

*Primary Examiner* — Christopher J Sebesta
(74) *Attorney, Agent, or Firm* — Kearney, McWilliams & Davis, PLLC; John M. DeBoer

(57) ABSTRACT

A downhole tool having a mandrel, and a bottom slip disposed around the mandrel. The bottom slip includes a circular body having a one-piece configuration characterized by a plurality of slip segments by at least partial material connectivity therearound. The bottom slip is made of a filament wound composite material, which means the bottom slip has a plurality of layers joined by respective interface layers. An outer slip surface of at least one of the plurality of slip segments is defined in cross-section by a plane P that intersects a longitudinal axis of the downhole tool at an angle a1 when the bottom slip is in an unset position.

19 Claims, 29 Drawing Sheets

Related U.S. Application Data

(60) Provisional application No. 62/690,445, filed on Jun. 27, 2018, provisional application No. 62/656,897, filed on Apr. 12, 2018.

(51) Int. Cl.

| | |
|---|---|
| ***E21B 23/01*** | (2006.01) |
| ***E21B 33/134*** | (2006.01) |
| ***E21B 33/128*** | (2006.01) |
| *E21B 34/16* | (2006.01) |
| *E21B 33/124* | (2006.01) |

(52) U.S. Cl.
CPC ..... *E21B 33/1293* (2013.01); *E21B 33/134* (2013.01); *E21B 33/124* (2013.01); *E21B 34/16* (2013.01)

(56) References Cited

U.S. PATENT DOCUMENTS 2,797,758 A 7/1957 Showalter
3,163,225 A 12/1964 Perkins
3,343,607 A 9/1967 Current
3,422,898 A 1/1969 Conrad
3,687,196 A 8/1972 Mullins
3,769,127 A 10/1973 Goldsworthy et al.
3,776,561 A 12/1973 Haney
4,359,090 A 11/1982 Luke
4,388,971 A 6/1983 Peterson
4,436,150 A 3/1984 Barker
4,437,516 A 3/1984 Cockrell
4,440,223 A 4/1984 Akkerman
4,469,172 A 9/1984 Clark
4,630,690 A 12/1986 Beasley et al.
4,711,300 A 12/1987 Wardlaw et al.
4,784,226 A 11/1988 Wyatt
5,025,858 A 6/1991 Glaser
5,048,606 A 9/1991 Allwin
5,113,940 A 5/1992 Glaser
5,147,857 A 9/1992 Raddatz et al.
5,224,540 A 7/1993 Streich et al.
5,246,069 A 9/1993 Glaser et al.
5,253,714 A 10/1993 Davis et al.
5,333,685 A 8/1994 Gilbert
5,376,200 A 12/1994 Hall
5,449,040 A 9/1995 Milner
5,484,040 A 1/1996 Penisson
5,819,846 A 10/1998 Bolt et al.
5,839,515 A 11/1998 Yuan et al.
5,842,517 A 12/1998 Coone
5,927,403 A 7/1999 Dallas
5,967,352 A 10/1999 Repp
5,984,007 A 11/1999 Yuan
6,167,963 B1 1/2001 McMahan et al.
6,241,018 B1 6/2001 Eriksen
6,353,771 B1 3/2002 Southland
6,354,372 B1 * 3/2002 Carisella ..... E21B 33/1216 166/134
6,425,442 B1 7/2002 Latiolais et al.
6,491,116 B2 12/2002 Berscheidt et al.
6,578,638 B2 6/2003 Guillory
6,708,768 B2 3/2004 Slup et al.
6,712,153 B2 3/2004 Turley et al.
6,899,181 B2 5/2005 Simpson et al.
7,044,230 B2 5/2006 Starr et al.
7,087,109 B2 8/2006 Bredt et al.
7,093,664 B2 8/2006 Todd et al.
7,255,178 B2 8/2007 Slup et al.
7,350,569 B2 4/2008 Collins et al.
7,350,582 B2 4/2008 McKeachnie et al.
7,475,736 B2 1/2009 Lehr et al.
7,484,940 B2 2/2009 O'Neill
7,735,549 B1 6/2010 Nish et al.
7,740,079 B2 6/2010 Clayton et al.
7,753,416 B2 7/2010 Mazzaferro et al.
7,762,323 B2 7/2010 Frazier
7,980,300 B2 7/2011 Roberts et al.
8,002,030 B2 8/2011 Turley et al.
8,016,295 B2 9/2011 Guest et al.
8,079,413 B2 12/2011 Frazier
8,113,276 B2 2/2012 Greenlee et al.
8,127,851 B2 3/2012 Misselbrook
8,167,033 B2 5/2012 White
8,205,671 B1 6/2012 Branton
8,211,248 B2 7/2012 Marya
8,231,947 B2 7/2012 Vaidya et al.
8,267,177 B1 9/2012 Vogel et al.
D673,182 S 12/2012 Frazier
8,336,616 B1 12/2012 McClinton
8,381,809 B2 2/2013 White
8,459,346 B2 6/2013 Frazier
8,469,088 B2 6/2013 Shkurti et al.
8,567,492 B2 10/2013 White
8,596,347 B2 12/2013 Valencia et al.
8,839,855 B1 2/2014 McClinton et al.
8,770,276 B1 7/2014 Nish et al.
8,770,280 B2 7/2014 Buytaert et al.
8,887,818 B1 11/2014 Carr et al.
8,893,780 B2 11/2014 Greenlee et al.
9,416,617 B2 8/2016 Wiese et al.
9,708,878 B2 7/2017 Cooke, Jr.
9,714,551 B2 7/2017 Okura et al.
9,745,847 B2 8/2017 Ditzler et al.
9,790,763 B2 10/2017 Fripp et al.
D806,136 S 12/2017 Saulou et al.
9,845,658 B1 12/2017 Nish et al.
9,982,506 B2 5/2018 Walton et al.
2003/0121558 A1 * 7/2003 Cook ..... E21B 29/10 264/269
2003/0188876 A1 10/2003 Vick et al.
2003/0226660 A1 12/2003 Winslow et al.
2003/0236173 A1 12/2003 Dobson et al.
2004/0003928 A1 1/2004 Frazier
2004/0045723 A1 3/2004 Slup et al.
2004/0216868 A1 11/2004 Owen, Sr.
2005/0109502 A1 5/2005 Buc Slay et al.
2005/0183864 A1 8/2005 Trinder
2005/0194141 A1 9/2005 Sinclair et al.
2006/0243455 A1 11/2006 Telfer
2007/0039742 A1 2/2007 Costa
2007/0119600 A1 5/2007 Slup et al.
2008/0128133 A1 6/2008 Turley et al.
2008/0196879 A1 8/2008 Broome et al.
2008/0264627 A1 10/2008 Roberts et al.
2008/0277162 A1 11/2008 DiFoggio
2009/0038790 A1 2/2009 Barlow
2009/0090516 A1 4/2009 Delucia et al.
2009/0229424 A1 9/2009 Montgomery
2009/0236091 A1 9/2009 Hammami et al.
2010/0155050 A1 6/2010 Frazier
2010/0263876 A1 10/2010 Frazier
2010/0276159 A1 11/2010 Mailand et al.
2010/0326660 A1 12/2010 Ballard et al.
2011/0024134 A1 2/2011 Buckner
2011/0048740 A1 3/2011 Ward et al.
2011/0048743 A1 3/2011 Stafford et al.
2011/0088891 A1 4/2011 Stout
2011/0094802 A1 4/2011 Vatne
2011/0186306 A1 8/2011 Marya et al.
2011/0232899 A1 9/2011 Porter
2011/0259610 A1 10/2011 Shkurti et al.
2011/0277989 A1 11/2011 Frazier
2011/0290473 A1 12/2011 Frazier
2012/0061105 A1 3/2012 Neer et al.
2012/0125642 A1 5/2012 Chenault et al.
2012/0181032 A1 7/2012 Naedler et al.
2012/0234538 A1 9/2012 Martin et al.
2012/0279700 A1 11/2012 Frazier
2013/0032357 A1 2/2013 Mazyar et al.
2013/0098600 A1 4/2013 Roberts
2013/0240201 A1 9/2013 Frazier
2013/0306331 A1 11/2013 Bishop et al.
2014/0020911 A1 * 1/2014 Martinez ..... E21B 33/129 166/134

(56) References Cited

U.S. PATENT DOCUMENTS

| | | | | |
|---|---|---|---|---|
| 2014/0027127 | A1 | 1/2014 | Frazier et al. | |
| 2014/0045731 | A1 | 2/2014 | Daccord | |
| 2014/0090831 | A1 | 4/2014 | Young et al. | |
| 2014/0116677 | A1 | 5/2014 | Sherlin | |
| 2014/0120346 | A1 | 5/2014 | Rochen | |
| 2014/0190685 | A1 | 7/2014 | Frazier et al. | |
| 2014/0224476 | A1 | 8/2014 | Frazier | |
| 2014/0251641 | A1 | 9/2014 | Marya et al. | |
| 2014/0345875 | A1 | 11/2014 | Murphree et al. | |
| 2014/0345878 | A1 | 11/2014 | Murphree et al. | |
| 2014/0374163 | A1 | 12/2014 | Rui et al. | |
| 2015/0013996 | A1 | 1/2015 | Davies et al. | |
| 2015/0027737 | A1* | 1/2015 | Rochen | E21B 23/01 166/138 |
| 2015/0068728 | A1 | 3/2015 | Stage et al. | |
| 2015/0083394 | A1 | 3/2015 | Skarsen et al. | |
| 2015/0144348 | A1 | 5/2015 | Okura et al. | |
| 2015/0239795 | A1 | 8/2015 | Doud et al. | |
| 2015/0252638 | A1 | 9/2015 | Richards et al. | |
| 2015/0275070 | A1 | 10/2015 | Getzlaf et al. | |
| 2015/0354313 | A1 | 12/2015 | McClinton et al. | |
| 2015/0368994 | A1 | 12/2015 | Mhaskar et al. | |
| 2016/0115759 | A1 | 4/2016 | Richards et al. | |
| 2016/0122617 | A1 | 5/2016 | Murphree et al. | |
| 2016/0123104 | A1 | 5/2016 | Harris | |
| 2016/0130906 | A1 | 5/2016 | Garvey et al. | |
| 2016/0145957 | A1* | 5/2016 | Davies | E21B 33/128 166/217 |
| 2016/0160591 | A1 | 6/2016 | Xu et al. | |
| 2016/0201427 | A1 | 7/2016 | Fripp et al. | |
| 2016/0265305 | A1 | 9/2016 | Davies et al. | |
| 2016/0281458 | A1 | 9/2016 | Greenlee | |
| 2016/0305215 | A1 | 10/2016 | Harris et al. | |
| 2017/0044859 | A1 | 2/2017 | Blair | |
| 2017/0101836 | A1 | 4/2017 | Webster et al. | |
| 2017/0183950 | A1 | 6/2017 | Gillis et al. | |
| 2017/0260824 | A1 | 9/2017 | Kellner et al. | |
| 2017/0260825 | A1* | 9/2017 | Schmidt | E21B 33/12 |
| 2017/0284167 | A1 | 10/2017 | Takahashi et al. | |
| 2017/0321514 | A1 | 11/2017 | Crow | |

FOREIGN PATENT DOCUMENTS

| | | |
|---|---|---|
| EP | 0890706 | 1/1993 |
| EP | 1643602 | 4/2006 |
| WO | 2007014339 | 2/2007 |
| WO | 2008100644 | 8/2008 |
| WO | 20091128853 | 9/2009 |
| WO | 2011097091 | 8/2011 |
| WO | 2011160183 | 12/2011 |
| WO | 2014197827 | 12/2014 |
| WO | 2016032761 | 3/2016 |
| WO | 2016182545 | 11/2016 |

* cited by examiner

200

DOWNHOLE TOOL WITH BOTTOM COMPOSITE SLIP

INCORPORATION BY REFERENCE

The subject matter of U.S. non-provisional application Ser. No. 15/876,120, filed Jan. 20, 2018, Ser. No. 15/898,753 (now U.S. Pat. No. 10,480,267) and Ser. No. 15/899,147 (now U.S. Pat. No. 10,480,280), each filed Feb. 19, 2018, and Ser. No. 15/904,468, filed Feb. 26, 2018 (now U.S. Pat. No. 10,570,694), is incorporated herein by reference in entirety for all purposes, including with particular respect to a composition of matter (or material of construction) for a (sub)component for a downhole tool. One or more of these applications may be referred to herein as the "Applications".

STATEMENT REGARDING FEDERALLY SPONSORED RESEARCH OR DEVELOPMENT

Not applicable.

BACKGROUND

Field of the Disclosure

This disclosure generally relates to tools used in oil and gas wellbores. More specifically, the disclosure relates to downhole tools that may be run into a wellbore and useable for wellbore isolation, and systems and methods pertaining to the same. In particular embodiments, the tool may be a plug made of drillable materials and may include at least one slip having a one-piece configuration. Other embodiments pertain to a composite slip for a downhole tool.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with secondary recovery operation.

Fracing is now common in the industry and has reshaped the entire global energy sector. Fracing includes the use of a plug set in the wellbore below or beyond the respective target zone, followed by pumping or injecting high pressure frac fluid into the zone. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 105 (e.g., e-line, wireline, coiled tubing, etc.) and/or with setting tool 112, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

Composite materials, such as filament wound materials, have enjoyed success in the frac industry because of easy-to-drill tendencies. The process of making filament wound materials is known in the art, and although subject to differences, typically entails a process like that of FIG. 1A. As shown, a mandrel 114 rotates around a spindle 116 on a first axis A1 while a delivery eye 119 on a carriage (hidden from view here) traverses a second, usually horizontal, axis A2 in line with the axis of the rotating mandrel, laying down layers of fibers 125 back-n-forth in a desired pattern or angle forming cylindrical layer upon layer. The fibers 125 are continuously supplied from one or more creels 133.

The most common filaments are glass or carbon impregnated in a resin bath 127 as they are drawn and wound onto the mandrel.

Once the mandrel 114 is completely covered to the desired thickness, the resin is cured. Once cured, the mandrel is removed, and subsequently machined (such as by CNC machining) to produce a desired composite component. The wound (and cured) fibers result in fiber layers with respective interface(s) therebetween.

Because plugs are required to withstand extreme downhole conditions, they are built for durability and toughness, which often makes a drill-through process difficult. Even drillable plugs are typically constructed of some metal (such as cast iron) that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

The use of plugs in a wellbore is not without other problems, as these tools are subject to known failure modes. When the plug is run into position, the slips have a tendency to pre-set before the plug reaches its destination, resulting in damage to the casing and operational delays. Pre-set may result, for example, because of residue or debris (e.g., sand) left from a previous frac. In addition, conventional plugs are known to provide poor sealing, not only with the casing, but also between the plug's components. For example, when the sealing element is placed under compression, its surfaces do not always seal properly with surrounding components (e.g., cones, etc.).

The Applicant has addressed significant industry needs with its commercially successful 'Boss Hog' frac plug (and related embodiments). Applicant's redesign and innovation over conventional downhole tools has resulted in running of more than 250,000 plugs without damaging casing or presets in major basins throughout the U.S. and Canada and have held pressures exceeding 10,000 psi during frac stage treatments. One of the attributes of the typical Boss Hog plug embodiment is the mixed use of both a one-piece composite slip and a one-piece metal slip. Applicant's innovation around its plug has culminated in no less than 20 issued patents worldwide, with other patent applications yet pending.

FIGS. 1B-1E together illustrate conventional setting and failure of a composite slip. In the industry the selection of a metal slip for a 'bottom' slip position is typically because a metal-type slip is known to be better suited to holding at higher pressures as compared to that of a composite.

A component cut or machined from the cylindrical filament wound product will inherit the properties thereof—these layers are ostensibly parallel to the casing wall (at least in the proximate sense). As such, when the outer surface 190 is engaged with the tubular 108, the outer surface 190 is engaged concentric to the layers 129 (and respectively lies in a plane in parallel with resultant net forces F). Similarly, the outer surface is concentric to the interface 135 of the layers 129 (in cross-section) (and respectively lies in a plane in parallel with resultant net forces). During curing, the resin-glass cross-over interface 135 between the layers 129 is a lower tensile strength than the layer itself, and thus is prone to shearing in the direction of net forces F.

The composite slip 134, on the other hand, particularly when of the filament-wound nature, tends to have layer(s) (e.g., 129 *a-d*) that come apart at any respective layer interface 135. That is, downhole forces F in setting (or injection) are often incurred in the same plane P as the layer interface 135 in excess of the ability of the resin matrix between the layers maintain its integrity (or strength) in the realm of less than 1000 to 2000 psi.

As shown in FIG. 1B, during setting the slip 134 (or slip body, slip segment, etc.) is urged radially outward by way of its underside interaction with a conical member or surface 136. An outer surface 190 (or its respective plane) tends to be in parallel with a long axis 158 of the surrounding tubular 108 (and/or a long axis of the downhole tool 102). Similarly, the plane (or axis parallel thereto) P of interface 135 also tends to be in parallel with the long axis 158. 'Parallel' includes about a 1-degree tolerance. The outer surface 190 (including any respective gripping elements) is ultimately urged into a biting engagement with the surrounding tubular, as shown in FIG. 1C.

However, as downward (or sometimes upward) or setting forces exceed ~6000 psi (typically a necessary load to bear for at least one slip), the slip 134 becomes prone to failure. As shown in FIGS. 1D-1E, a portion 134*a* of the slip breaks (or shears) away from the main body of the slip 134 at the interface 135 between respective layers 129 *b-c*, resulting in a failure and inability of the tool 102 to hold pressure.

Composite slips also tend to fail in areas where material is removed or machined away via subtractive manufacturing. That is, on the one hand, the slip needs to be durable and so more material is desirous, but on the other hand the more material the harder it is to fracture (set) the slip, which can impact performance and predictability. For example, when a groove is machined into the body of a composite slip, the machining process is limited in that the groove can only be machined to a certain size of no less than about ⅛". That is, the lower limit end of a machined cut can still remove too much or an undesired amount of material.

Still, it is increasingly desirous in some sectors to use a downhole tool that does not utilize a metal slip, and still be able to hold in excess of 10,000 psi.

In some instances, it may be advantageous to have a device (ball, tool, tool component, etc.) made of a material (of composition of matter) characterized by properties where the device is mechanically strong (hard) under some conditions (such as at the surface or at ambient conditions), but reacts (e.g., degrades, dissolves, breaks, etc.) under certain conditions, such as in the presence of water-containing fluids like fresh water, seawater, formation fluid, additives, brines, acids and bases, or changes in pressure and/or temperature. Such a material, essentially self-actuated by changes in its surrounding may potentially replace costly and complicated designs and may be most advantageous in situations where accessibility is limited or even considered to be impossible, which is the case in a downhole (subterranean) environment.

It is desirous to form a one-piece composite slip that has as least amount of material machined therefrom as feasible.

The ability to save operational time (and those saving operational costs) leads to considerable competition in the marketplace. Achieving any ability to save time, or ultimately cost, leads to an immediate competitive advantage. Thus, there is a need in the art for a downhole tool that does not require extensive time (or incur difficulties) in drilling out a metal slip.

There are needs in the art for novel systems and methods for isolating wellbores in a viable and economical fashion. There is a great need in the art for downhole plugging tools that form a reliable and resilient seal against a surrounding tubular. There is also a need for a downhole tool made substantially of a drillable material that is easier and faster to drill. It is highly desirous for these downhole tools to readily and easily withstand extreme wellbore conditions, and at the same time be cheaper, smaller, lighter, and useable in the presence of high pressures associated with drilling and completion operations.

SUMMARY

Embodiments of the disclosure pertain to a method of using a downhole tool that may include one or more steps of: at a surface facility proximate to a wellbore, connecting the downhole tool with a workstring; operating the workstring to run the downhole tool into the wellbore to a desired position; setting the downhole tool; and disconnecting the downhole tool from the workstring.

Other embodiments herein pertain to a downhole tool that may include: a mandrel; and a bottom slip disposed around the mandrel.

The bottom slip may include or be a circular body having a plurality of slip segments connected together via a one-piece configuration. A one-piece configuration may be that such as what may be characterized by at least partial material connectivity therearound (identifiable by a material connectivity line).

The bottom slip may be made of a filament wound composite material. As such there may be a plurality of layers joined by respective interface layers. The plurality of layers may be concentric to one another as a result of a winding manufacturing process.

The bottom slip may have an outer slip surface of an at least one of the plurality of slip segments is defined in cross-section by a plane P that intersects a longitudinal axis of the downhole tool at an angle a1. The angle a1 may be in a range of 10 degrees to 20 degrees when the bottom slip is in an unset position (or in the assembled configuration). An end of one or more of the plurality of slip segments may include a facet.

The bottom cone may have an end face proximately engaged with the facet of the bottom slip. The connection point therebetween may be defined in cross-section by a break plane P' that intersects the longitudinal axis at a break angle b1 in a range of 20 degrees to 60 degrees.

In aspects, each of the plurality of slip segments may have a respective inclined outer surface defined in cross-section by a respective plane P that intersects a longitudinal axis of the downhole tool at a respective angle a1 in a range of 10 degrees to 20 degrees when the bottom slip is in an assembled configuration/unset position. Each end of the plurality of slip segments further may include a facet engaged with a respective cone surface.

One or more slip segments may be separated from an adjacent slip segment by a respective lateral groove. The lateral groove may have a depth that extends from the outer surface to an inner slip surface. The groove may further extend the length of the segment.

The bottom cone may include a plurality of raised fins, with a respective fin configured to move through the respective lateral groove. The inner slip surface may include a transition region resulting in the inner slip surface having a first inner slip diameter that is smaller than a second inner slip diameter.

The bottom cone may have a sloped outer surface defined in cross-section by a plane P' that may intersect a longitudinal axis of the downhole tool at an absolute angle a1' equal to that of the angle a1 within 0.5 degrees. The angle a1 and the angle a1' may be in the range of 10 degrees to 15 degrees, and wherein the angle b1 is in the range of 45 degrees to 55 degrees.

Each of the plurality of slip segments may include a set of three inserts triangulated to each other. Upon setting, the angle a1 may collapse to equal about approximately zero degrees. In aspects, an interface between two adjacent layers of the plurality of layers may be defined in cross-section by an interface plane parallel to the plane P'.

The downhole tool may include a bearing plate disposed around the mandrel. There may be a top slip disposed around the mandrel, and proximate to the bearing plate. There may be a top cone disposed around the mandrel, and engaged with the top slip. There may be a sealing element disposed between the top cone and the bottom cone. There may be a lower sleeve threadingly engaged with the mandrel. There may be a gap present between a tapered surface of the lower sleeve and a lateral slip end face.

Upon setting of the bottom slip, the gap may be closed by way of the tapered surface being in substantial contact with the lateral slip end face.

Other embodiments herein pertain to a downhole tool that may include a mandrel; and a bottom slip disposed around the mandrel comprising.

The bottom slip may include a circular body having a one-piece configuration characterized by at least partial material connectivity therearound in some portion thereof. The slip may include a plurality of separated slip segments extending therefrom.

The bottom slip may be made of a filament wound composite material that may include a plurality of wound layers joined by respective interface layers. An outer slip surface of an at least one of the plurality of slip segments may be defined in cross-section by a plane P that intersects a longitudinal axis of the downhole tool at an angle a1. The angle a1 may be in a range of 10 degrees to 20 degrees when the bottom slip is in an unset position. An end of each of the plurality of slip segments may include a facet. There may be a bottom cone having a plurality of end faces proximately engaged with the respective facet of the bottom slip. The contact point may defined in cross-section by a break plane P' that intersects the longitudinal axis at a break angle b1 in a range of 45 degrees to 55 degrees.

Each slip segment may be separated from an adjacent slip segment by a respective lateral groove having a depth that may extend from the outer surface to an inner slip surface. Any groove may extend completely through a first slip end.

The bottom cone may include a plurality of raised fins, with a respective fin configured to engage and move through the respective lateral groove. The inner slip surface may include a transition region resulting in the inner slip surface having a first inner slip diameter that is smaller than a second inner slip diameter.

The bottom cone may have a sloped outer surface defined in cross-section by a plane P' that intersects a longitudinal axis of the downhole tool at an absolute angle a1' equal to that of the angle a1 within 0.5 degrees. The angle a1 and the angle a1' may be in the range of 10 degrees to 15 degrees.

The downhole tool may include one or more of: a bearing plate disposed around the mandrel; a top slip disposed around the mandrel, and proximate to the bearing plate; a top cone disposed around the mandrel, and engaged with the top slip; a sealing element disposed between the top cone and the bottom cone; a lower sleeve threadingly engaged with the mandrel.

A gap may be present between a tapered surface of the lower sleeve and a lateral slip end face. Upon setting of the bottom slip, the angle a1 may equal approximately zero degrees, and an interface between two adjacent layers of the plurality of layers may be defined in cross-section by an interface plane lying parallel to the plane P'. The gap may be reduced or closed by way of the tapered surface being in substantial contact with the lateral slip end face.

Yet other embodiments of the disclosure pertain to a downhole tool having mandrel; a bearing plate disposed around the mandrel; a top slip disposed around the mandrel, and proximate to the bearing plate; a top cone disposed around the mandrel, and engaged with the top slip; and a bottom slip disposed around the mandrel.

The bottom slip may include a circular body having a one-piece configuration characterized by at least partial material connectivity therearound (at least some portion thereof). The circular slip body may have a plurality of separated slip segments extending therefrom, The bottom slip may be made of a filament wound composite material. The bottom slip may thus have a plurality of concentrically-wound layers joined by respective interface layers.

There may be an outer slip surface of an at least one of the plurality of slip segments that may be defined in cross-section by a plane P that intersects a longitudinal axis of the downhole tool at an angle a1 in a range of 10 degrees to 20 degrees.

The bottom slip may be in an unset (or assembled) position. An at least one end of one of the plurality of slip segments may include a facet.

The downhole tool may include a bottom cone having a plurality of end faces proximately engaged with the respective facet of the bottom slip at a break angle b1. There may be a sealing element disposed between the top cone and the bottom cone; and a lower sleeve threadingly engaged with the mandrel.

These and other embodiments, features and advantages will be apparent in the following detailed description and drawings.

BRIEF DESCRIPTION OF THE DRAWINGS

For a more detailed description of the present disclosure, reference will now be made to the accompanying drawings, wherein.

DETAILED DESCRIPTION

Figure 1:
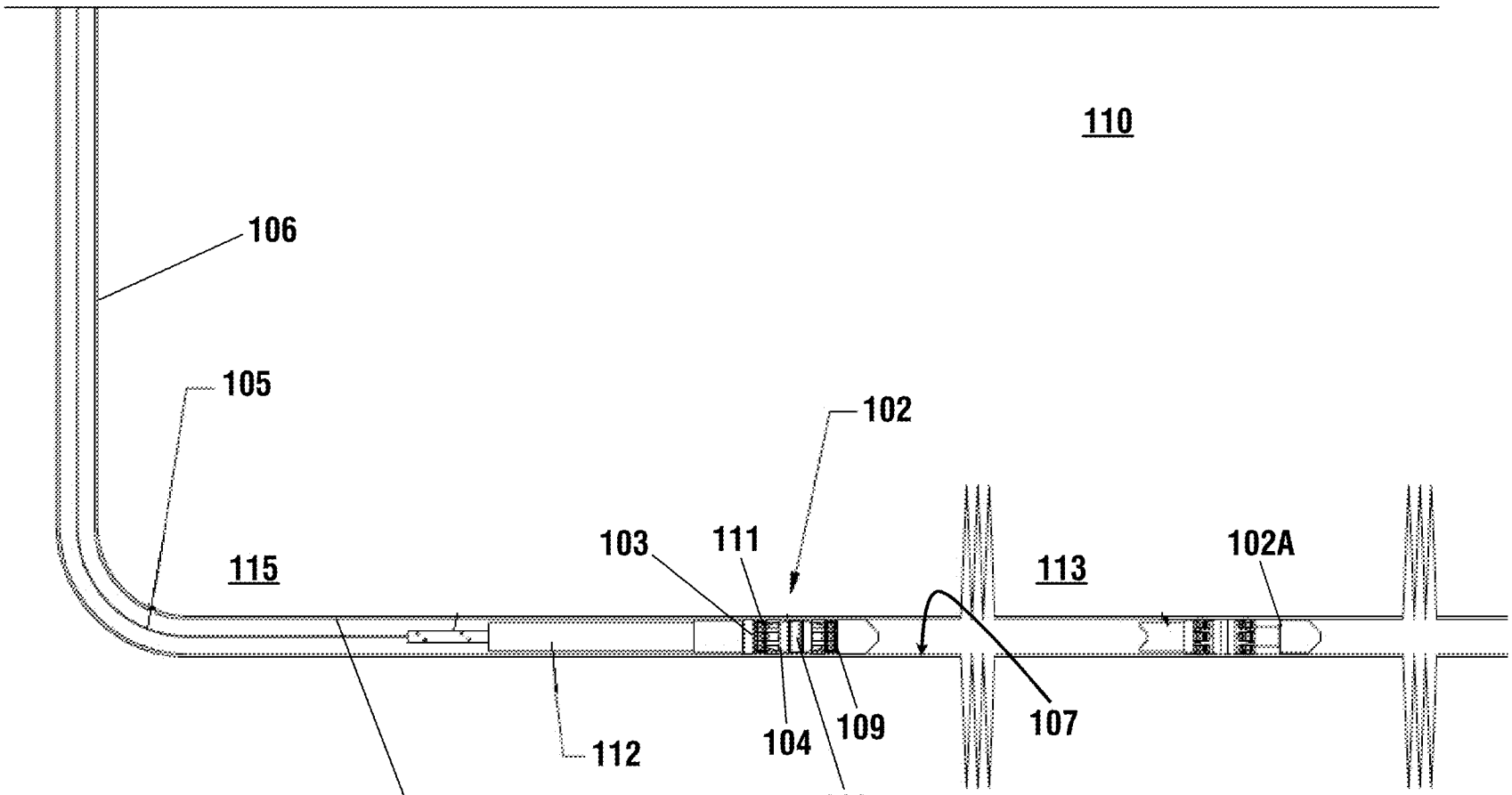
FIG. 1 is a side view of a process diagram of a conventional plugging system.
Figure 1A:
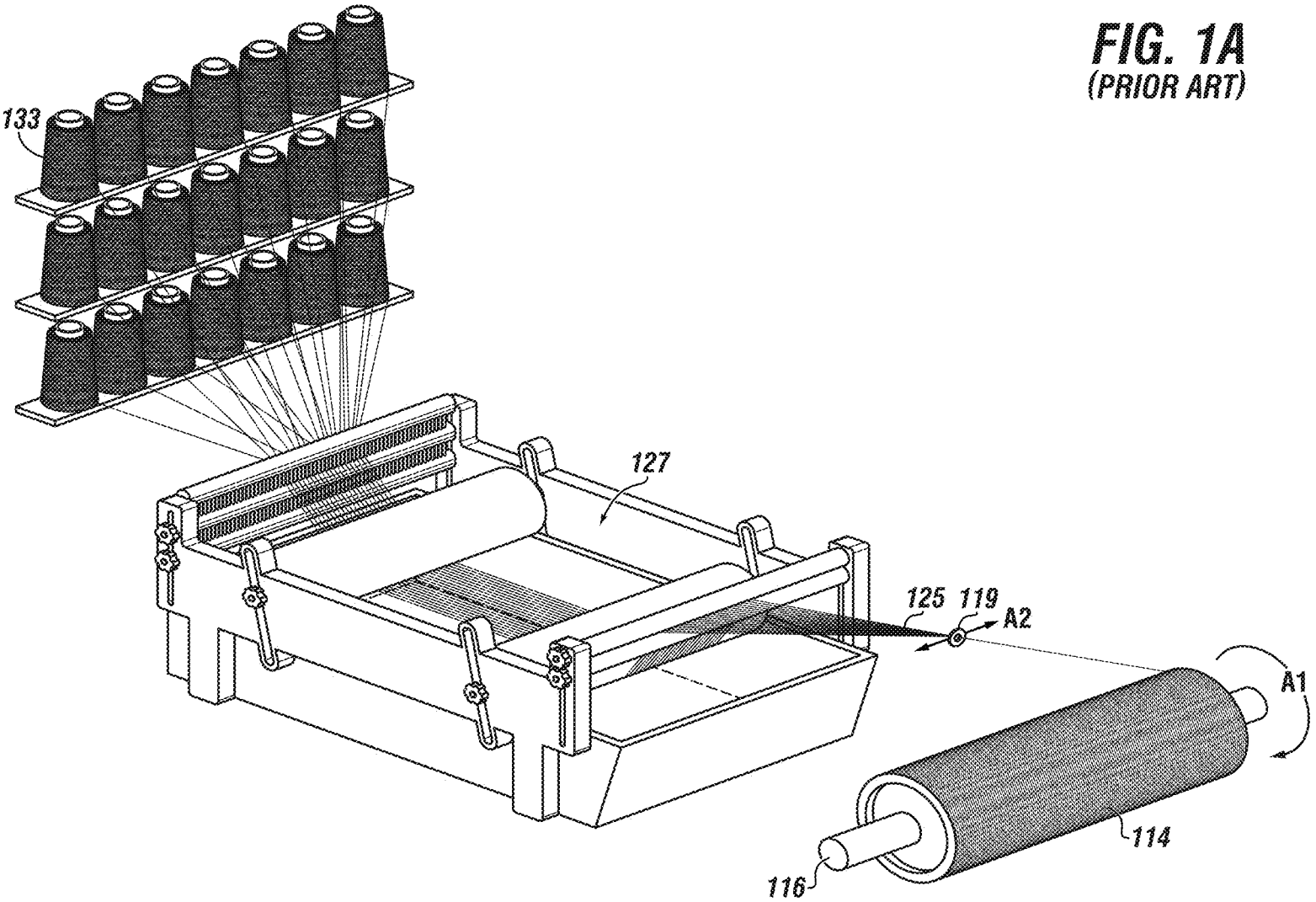
FIG. 1A (PRIOR ART)
FIG. 1A is an overview of a conventional filament winding process.
Figure 1C:
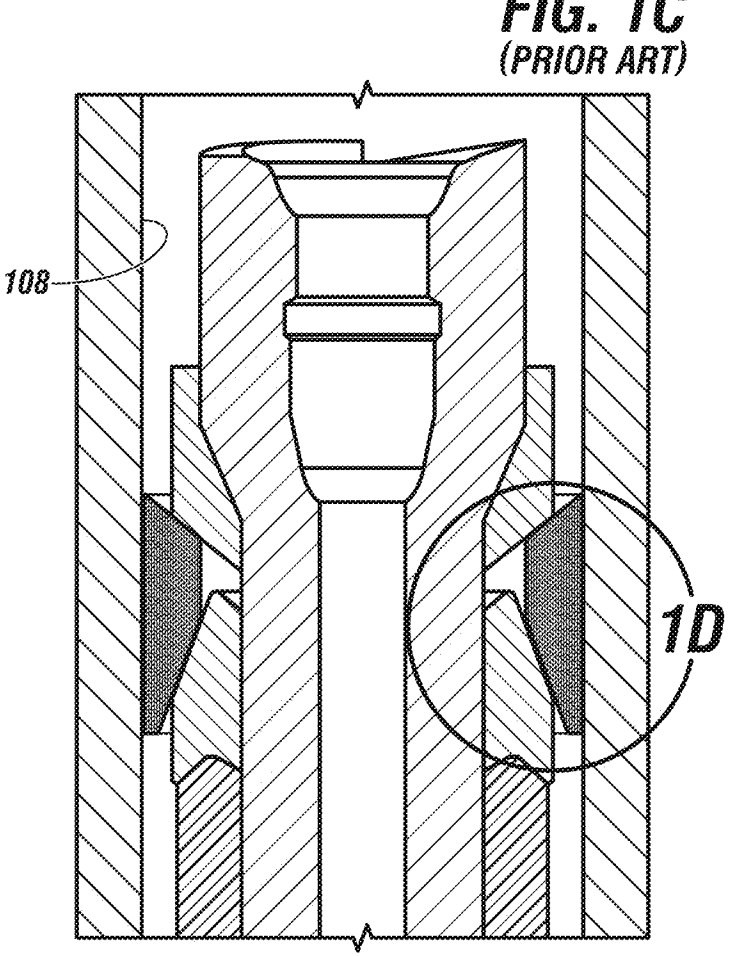
FIG. 1C (PRIOR ART)
FIG. 1C is side cross-sectional view of a set slip of FIG. 1B.
Figure 1B:
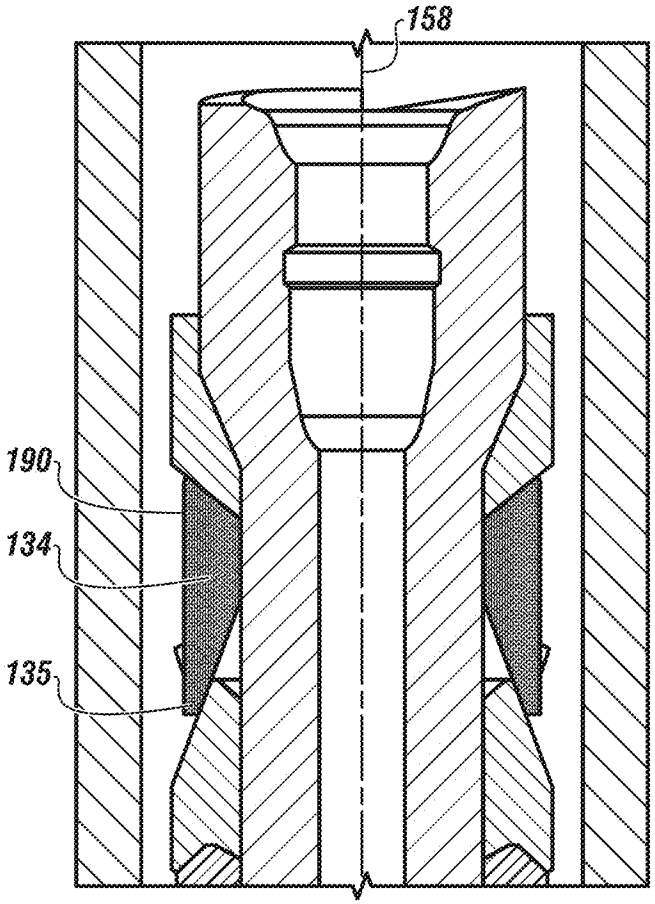
FIG. 1B (PRIOR ART)
FIG. 1B is side cross-sectional view of a conventional slip and cone arrangement for a downhole tool.
Figure 1D:
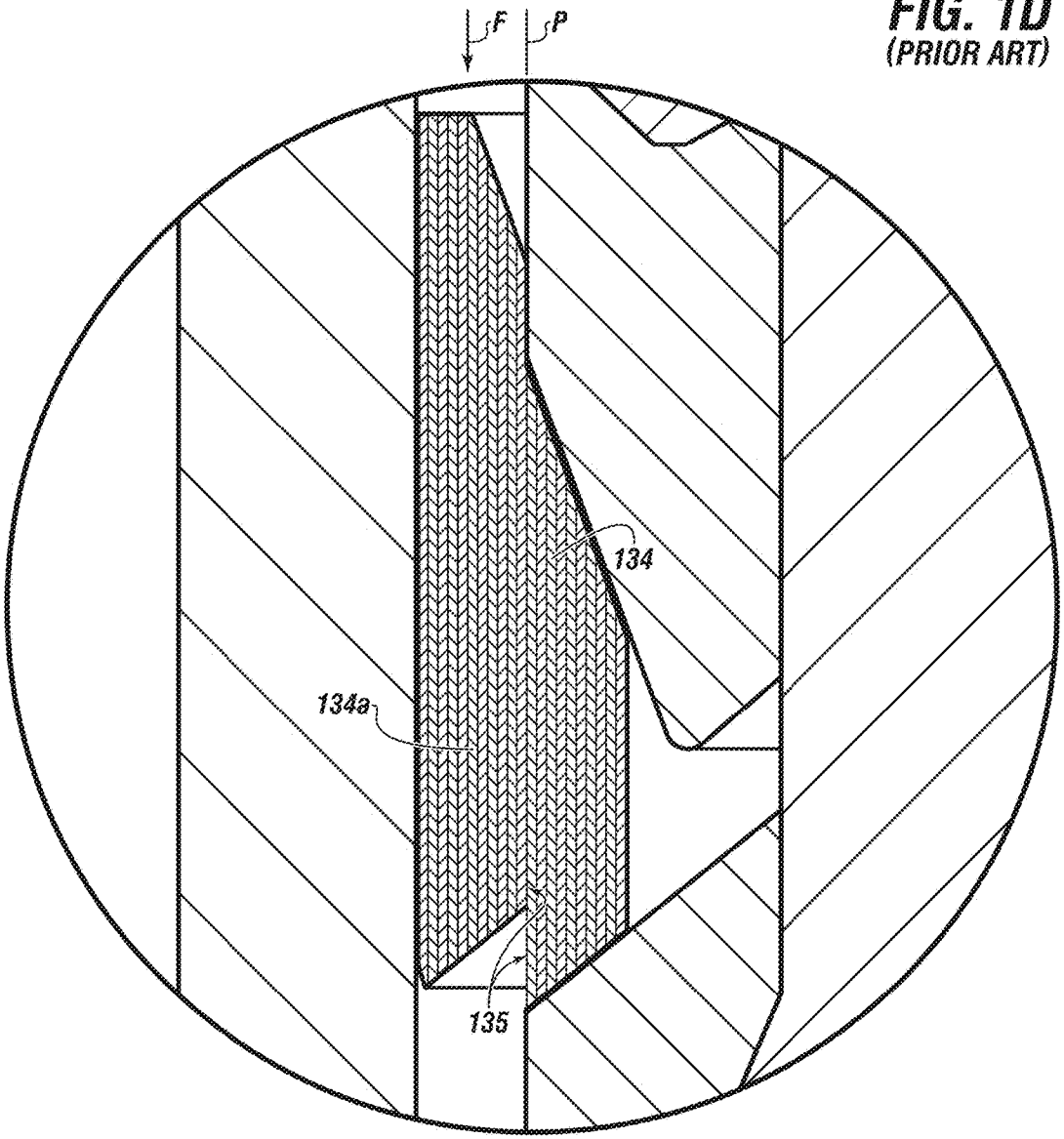
FIG. 1D (PRIOR ART)
FIG. 1D is side cross-sectional view of a failed slip of FIG. 1B.
Figure 1E:
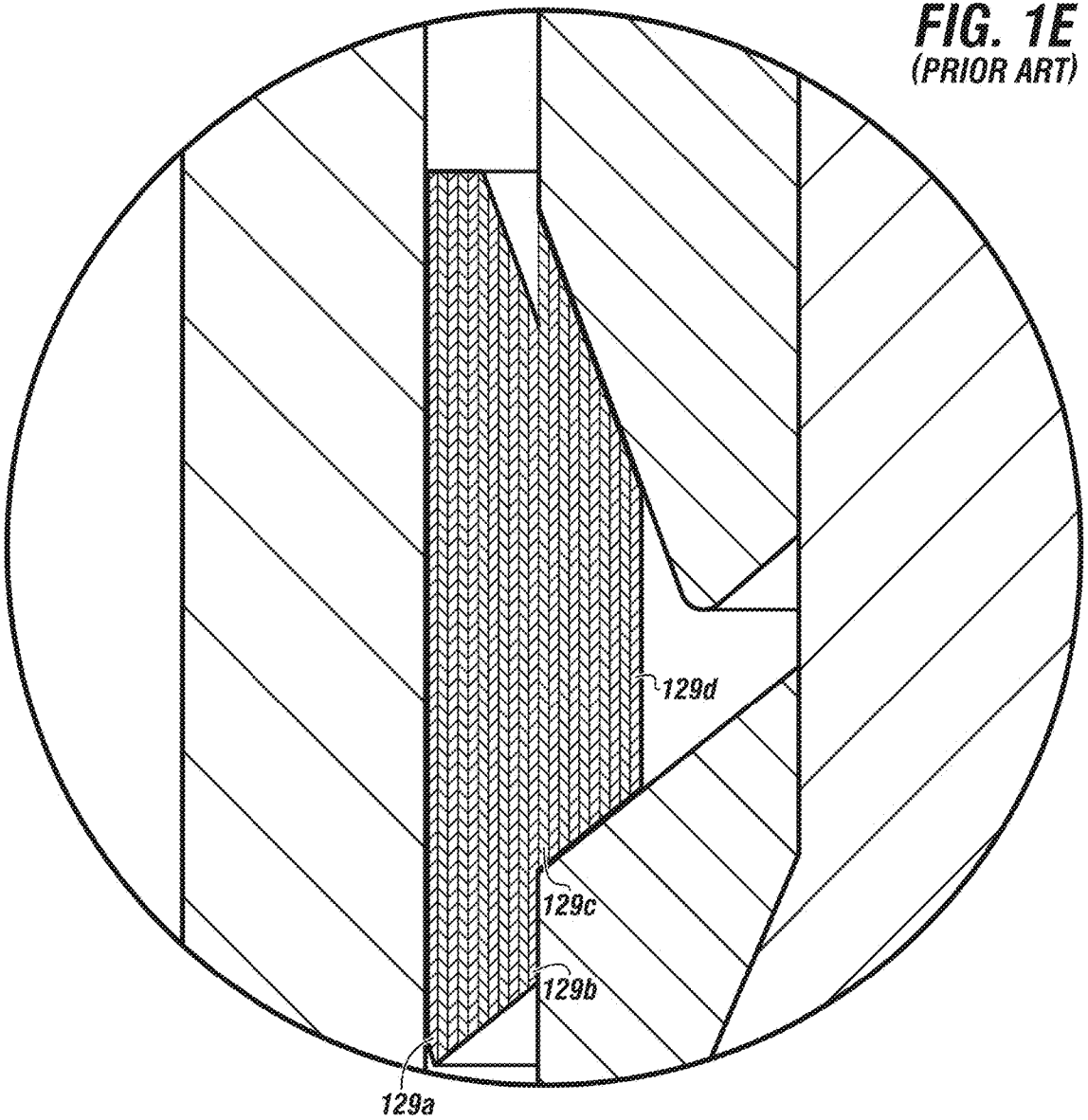
FIG. 1E (PRIOR ART)
FIG. 1E is side cross-sectional view of alternative failed slip of FIG. 1B.

Herein disclosed are novel apparatuses, systems, and methods that pertain to downhole tools usable for wellbore operations, and aspects (including components) related thereto, the details of which are described herein.

Downhole tools according to embodiments disclosed herein may include one or more anchor slips, one or more compression cones engageable with the slips, and a compressible seal element disposed therebetween, all of which may be configured or disposed around a mandrel. The mandrel may include a flow bore open to an end of the tool and extending to an opposite end of the tool. In embodiments, the downhole tool may be a frac plug or a bridge plug. Thus, the downhole tool may be suitable for frac operations. In an exemplary embodiment, the downhole tool may include a one-piece slip made of drillable composite material, the tool being suitable for use in vertical or horizontal wellbores.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., may be used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "plane" or "planar" as used herein may refer to any surface or shape that is flat, at least in cross-section. For example, a curved or rounded surface may appear to be planar in 2D cross-section. It should be understood that plane or planar need not refer to exact mathematical precision, but instead be contemplated as visual appearance to the naked eye. A plane or planar may be illustrated in 2D by way of a line.

The term "parallel" as used herein may refer to any surface or shape that may have a reference plane lying in the same direction as that of another. It should be understood that parallel need not refer to exact mathematical precision, but instead be contemplated as visual appearance to the naked eye.

The term "composition" or "composition of matter" as used herein may refer to one or more ingredients, components, constituents, etc. that make up a material (or material of construction). For example, a material may have a composition of matter. Similarly, a device may be made of a material having a composition of matter. The composition of matter may be derived from an initial composition. Composition may refer to a flow stream of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable Material" may be analogous to degradable material. The as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

Disassociatable Material (also dissociable): as used herein may refer to a composition of matter having properties and/or characteristics that, while subject to change over time and/or under certain conditions, lead to a change in the integrity of the material, including to the point of changing from a solid structure to a powdered material. As one example, the material may initially be hard, rigid, and strong at ambient or surface conditions, but over time (such as within about 12-36 hours) and under certain conditions (such as wellbore conditions), the material changes (disassociates) to a powder.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "fracing" or "frac operation" as used herein may refer to fractionation of a downhole well that has already been drilled. The same may also be referred to and interchangeable with the terms facing operation, fractionation, hydrofracturing, hydrofracking, fracking, hydraulic fracturing, frac, and so on. A frac operation may be land or water based.

Figure 2A:
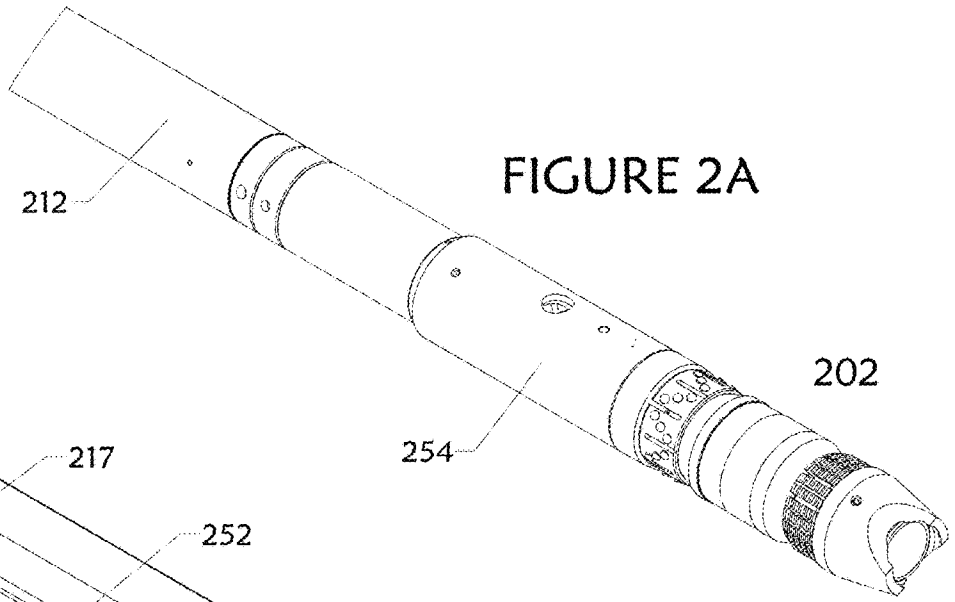
FIG. 2A shows an isometric view of a system having a downhole tool, according to embodiments of the disclosure.
Figure 2B:
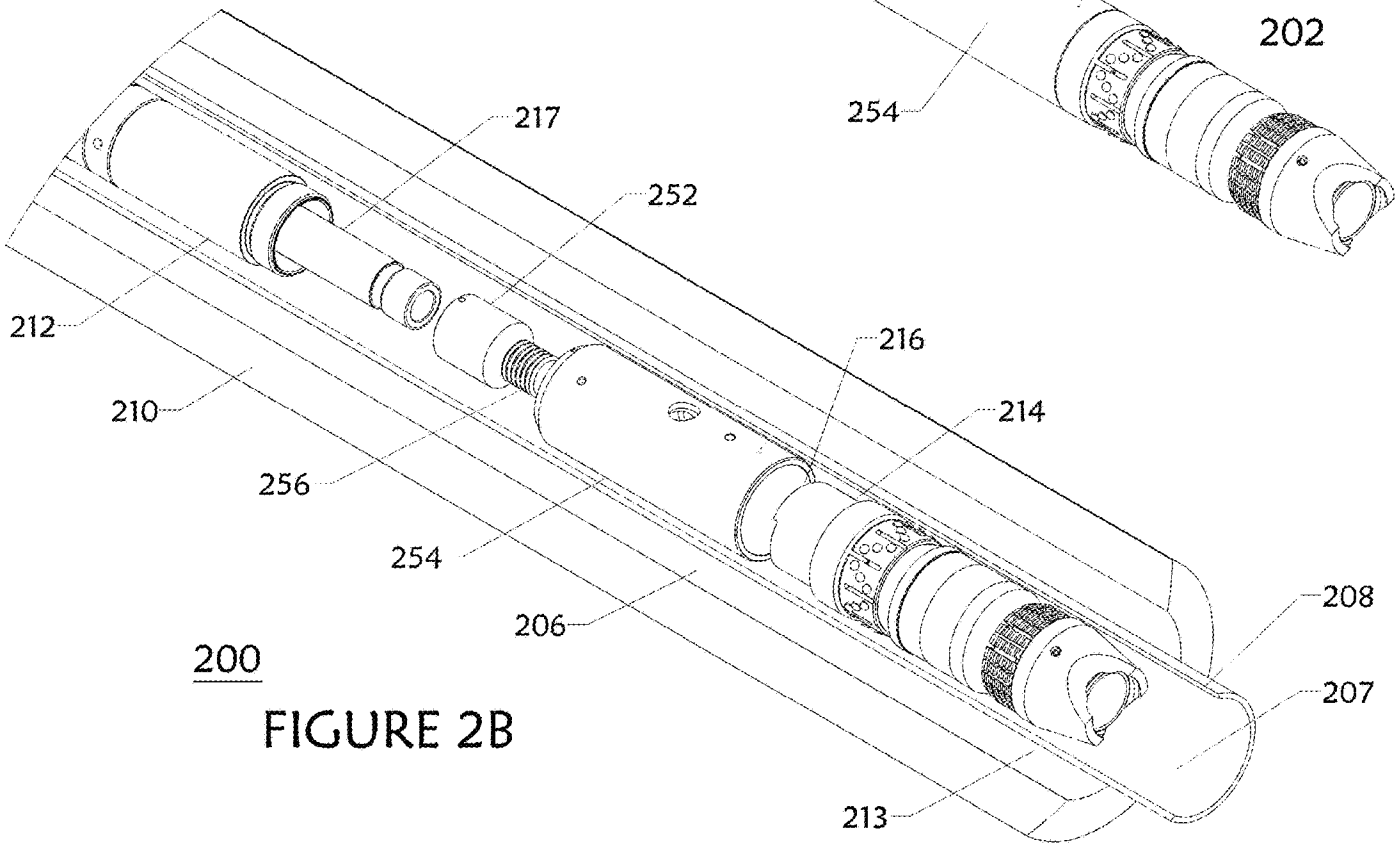
FIG. 2B shows an isometric view of a system having a downhole tool, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented). A workstring 212 (which may include a part 217 of a setting tool coupled with adapter 252) may be used to position or run the downhole tool 202 into and through the wellbore 206 to a desired location.

In accordance with embodiments of the disclosure, the tool 202 may be configured as a plugging tool, which may be set within the tubular 208 in such a manner that the tool 202 forms a fluid-tight seal against the inner surface 207 of the tubular 208. In an embodiment, the downhole tool 202 may be configured as a bridge plug, whereby flow from one section of the wellbore 213 to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball may be dropped into the wellbore 206 and flowed into the tool 202 and come to rest in a corresponding ball seat at the end of the mandrel 214. The seating of the ball may provide a seal within the tool 202 resulting in a plugged condition, whereby a pressure differential across the tool 202 may result. The ball seat may include a radius or curvature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation with any of these configurations.

Once the tool 202 reaches the set position within the tubular, the setting mechanism or workstring 212 may be detached from the tool 202 by various methods, resulting in the tool 202 left in the surrounding tubular and one or more sections of the wellbore isolated. In an embodiment, once the tool 202 is set, tension may be applied to the adapter 252 until the threaded connection between the adapter 252 and the mandrel 214 is broken. For example, the mating threads on the adapter 252 and the mandrel 214 (256 and 216, respectively as shown in FIG. 2D) may be designed to shear, and thus may be pulled and sheared accordingly in a manner known in the art. The amount of load applied to the adapter 252 may be in the range of about, for example, 20,000 to 40,000 pounds force. In other applications, the load may be in the range of less than about 10,000 pounds force.

Accordingly, the adapter 252 may separate or detach from the mandrel 214, resulting in the workstring 212 being able to separate from the tool 202, which may be at a predetermined moment. The loads provided herein are non-limiting and are merely exemplary. The setting force may be determined by specifically designing the interacting surfaces of the tool and the respective tool surface angles. The tool 202 may also be configured with a predetermined failure point (not shown) configured to fail or break. For example, the failure point may break at a predetermined axial force greater than the force required to set the tool but less than the force required to part the body of the tool.

Operation of the downhole tool 202 may allow for fast run in of the tool 202 to isolate one or more sections of the wellbore 206, as well as quick and simple drill-through to destroy or remove the tool 202. Drill-through of the tool 202 may be facilitated by components and sub-components of tool 202 made of drillable material that is less damaging to a drill bit than those found in conventional plugs.

The downhole tool 202 may have one or more components made of a material as described herein and in accordance with embodiments of the disclosure. In an embodiment, the downhole tool 202 and/or its components may be a drillable tool made from drillable composite material(s), such as glass fiber/epoxy, carbon fiber/epoxy, glass fiber/PEEK, carbon fiber/PEEK, etc. Other resins may include phenolic, polyamide, etc. All mating surfaces of the downhole tool 202 may be configured with an angle, such that corresponding components may be placed under compression instead of shear.

The downhole tool 202 may have one or more components made of non-composite material, such as a metal or metal alloys. The downhole tool 202 may have one or more components made of a reactive material (e.g., dissolvable, degradable, etc.).

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. In embodiments, the components of the tool 202 may be made of dissolvable aluminum-, magnesium-, or aluminum-magnesium-based (or alloy, complex, etc.) material.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired).

Just the same, one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool 202. The downhole tool 202 (and other tool embodiments disclosed herein) and/or one or more of its components may be 3D printed as would be apparent to one of skill in the art.

Figure 2C:
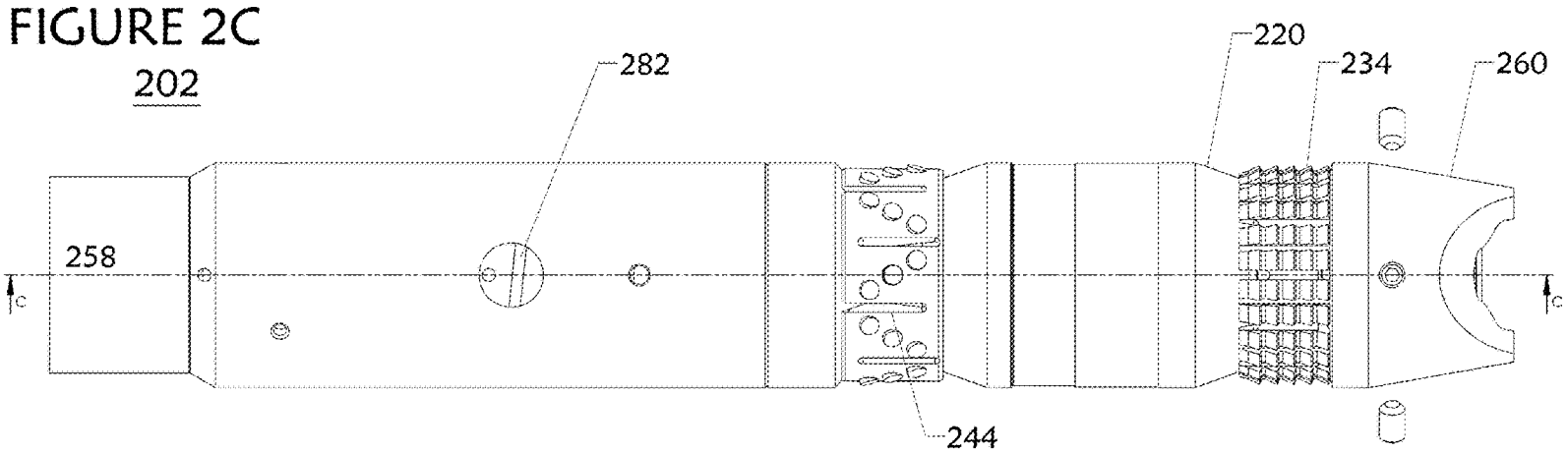
FIG. 2C shows a side longitudinal view of a downhole tool according to embodiments of the disclosure.
Figure 2D:
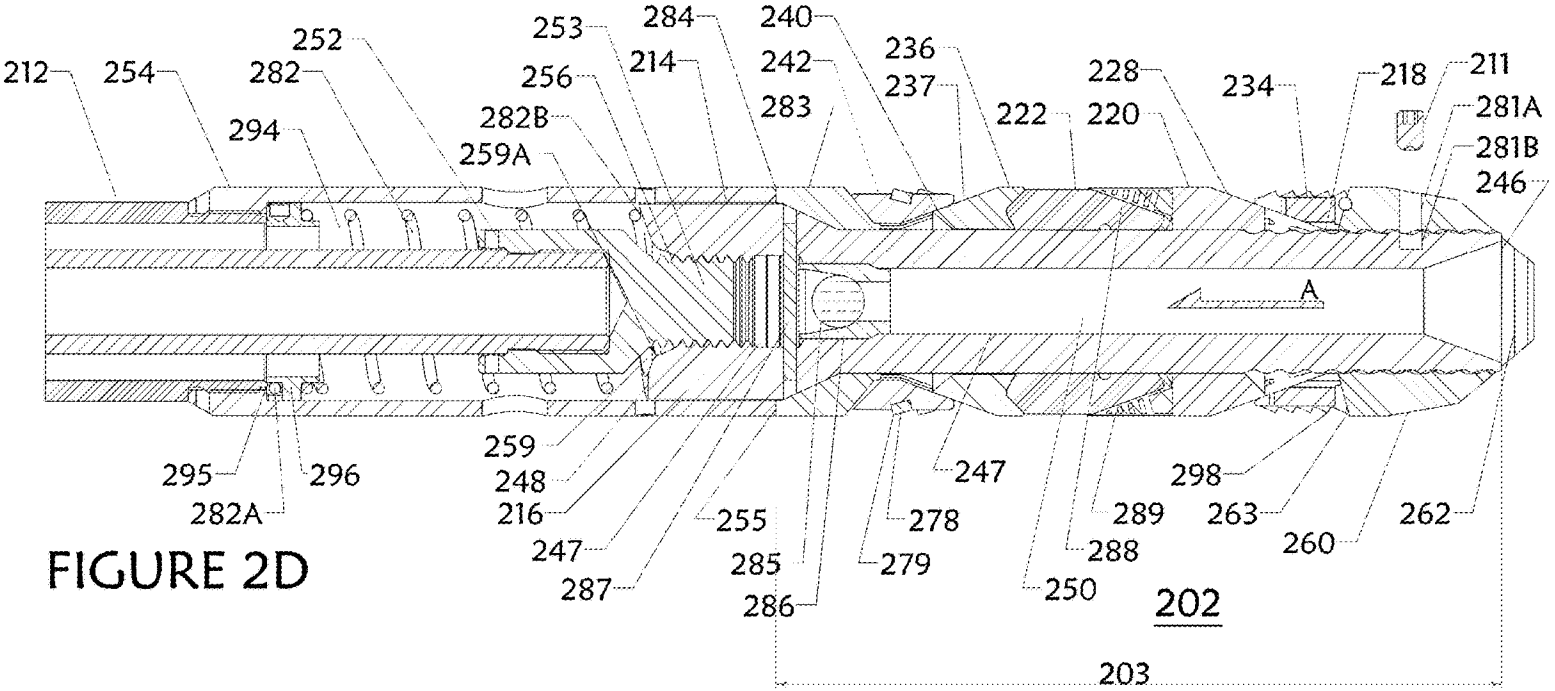
FIG. 2D shows a longitudinal cross-sectional view of a downhole tool according to embodiments of the disclosure.
Figure 2E:
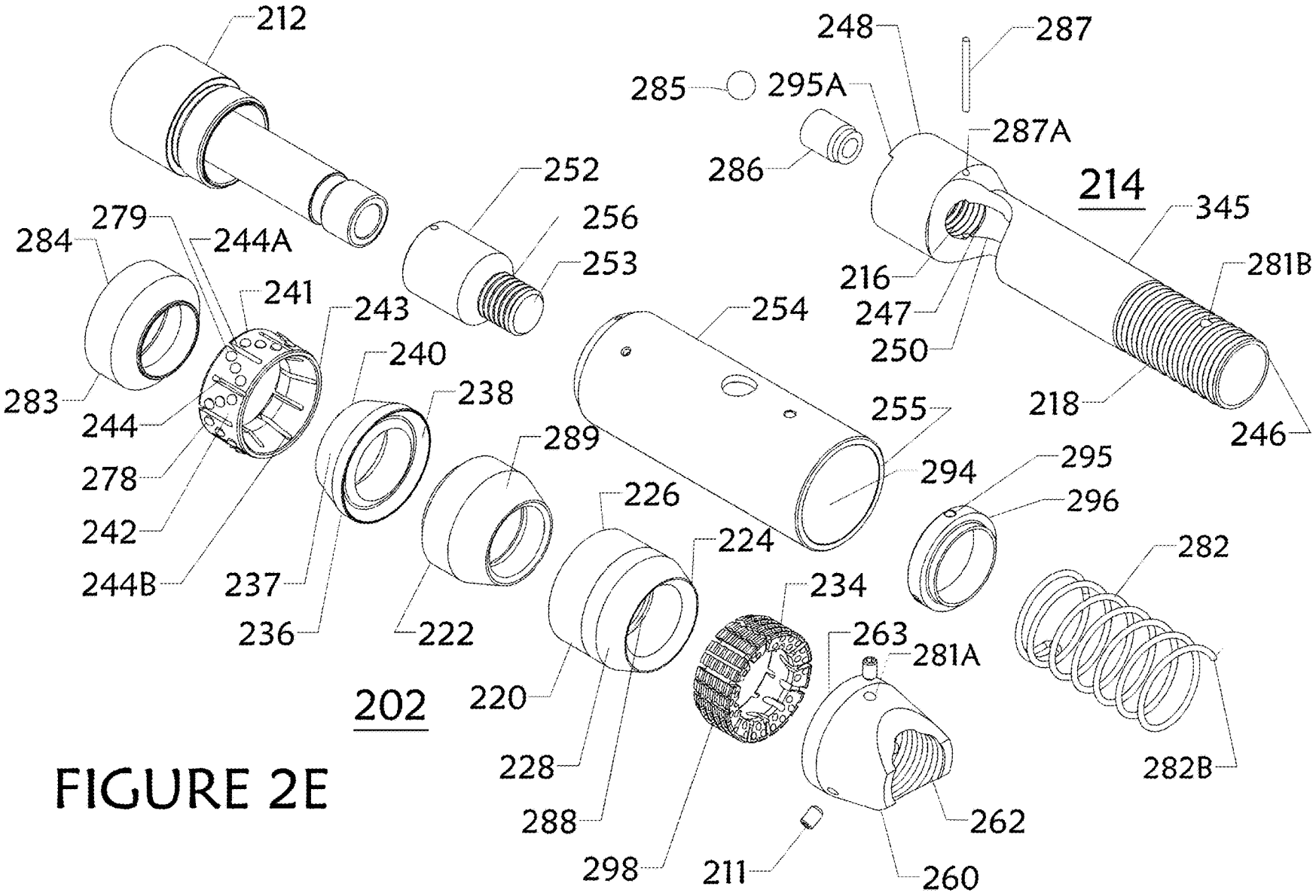
FIG. 2E shows an isometric component break-out view of a downhole tool according to embodiments of the disclosure.

Referring now to FIGS. 2C-2E together, a longitudinal view, a longitudinal cross-sectional view, and an isometric component break-out view, respectively, of downhole tool 202 useable with system (200, FIG. 2A) and illustrative of embodiments disclosed herein, are shown. The downhole tool 202 may include a mandrel 214 that extends through the tool 202 (or tool body). The mandrel 214 may be a solid body. In other aspects, the mandrel 214 may include a flowpath or bore 250 formed therein (e.g., an axial bore). The bore 250 may extend partially or for a short distance through the mandrel 214, as shown in FIG. 2E. Alternatively, the bore 250 may extend through the entire mandrel 214, with an opening at its proximate end 248 and oppositely at its distal end 246 (near downhole end of the tool 202), as illustrated by FIG. 2D.

The presence of the bore 250 or other flowpath through the mandrel 214 may indirectly be dictated by operating conditions. That is, in most instances the tool 202 may be large enough in diameter (e.g., 4¾ inches) that the bore 250 may be correspondingly large enough (e.g., 1¼ inches) so that debris and junk may pass or flow through the bore 250 without plugging concerns. However, with the use of a smaller diameter tool 202, the size of the bore 250 may need to be correspondingly smaller, which may result in the tool 202 being prone to plugging. Accordingly, the mandrel may be made solid to alleviate the potential of plugging within the tool 202.

With the presence of the bore 250, the mandrel 214 may have an inner bore surface 247, which may include one or more threaded surfaces formed thereon. As such, there may be a first set of threads 216 configured for coupling the mandrel 214 with corresponding threads 256 of a setting adapter 252.

The coupling of the threads, which may be shear threads, may facilitate detachable connection of the tool 202 and the setting adapter 252 and/or workstring (212, FIG. 2B) at the threads. It is within the scope of the disclosure that the tool 202 may also have one or more predetermined failure points (not shown) configured to fail or break separately from any threaded connection. The failure point may fail or shear at a predetermined axial force greater than the force required to set the tool 202.

The adapter 252 may include a stud 253 configured with the threads 256 thereon. In an embodiment, the stud 253 has external (male) threads 256 and the mandrel 214 has internal (female) threads; however, type or configuration of threads is not meant to be limited, and could be, for example, a vice versa female-male connection, respectively.

The downhole tool 202 may be run into wellbore (206, FIG. 2A) to a desired depth or position by way of the workstring (212, FIG. 2A) that may be configured with the setting device or mechanism. The workstring 212 and setting sleeve 254 may be part of the plugging tool system 200 utilized to run the downhole tool 202 into the wellbore and activate the tool 202 to move from an unset to set position. The set position may include seal element 222 and/or slips 234, 242 engaged with the tubular (208, FIG. 2B). In an embodiment, the setting sleeve 254 (that may be configured as part of the setting mechanism or workstring) may be utilized to force or urge compression of the seal element 222, as well as swelling of the seal element 222 into sealing engagement with the surrounding tubular.

The setting device(s) and components of the downhole tool 202 may be coupled with, and axially and/or longitudinally movable along mandrel 214. When the setting sequence begins, the mandrel 214 may be pulled into tension while the setting sleeve 254 remains stationary. The lower sleeve 260 may be pulled as well because of its attachment to the mandrel 214 by virtue of the coupling of threads 218 and threads 262. As shown in the embodiment of FIGS. 2C and 2D, the lower sleeve 260 and the mandrel 214 may have matched or aligned holes 281A and 281B, respectively, whereby one or more anchor pins 211 or the like may be disposed or securely positioned therein. In embodiments, brass set screws may be used. Pins (or screws, etc.) 211 may prevent shearing or spin-off during drilling or run-in.

As the lower sleeve 260 is pulled in the direction of Arrow A, the components disposed about mandrel 214 between the lower sleeve 260 and the setting sleeve 254 may begin to compress against one another. This force and resultant movement causes compression and expansion of seal element 222. The lower sleeve 260 may also have an angled sleeve end 263 in engagement with the slip 234, and as the lower sleeve 260 is pulled further in the direction of Arrow A, the end 263 compresses against the slip 234. As a result, slip(s) 234 may move along a tapered or angled surface 228 of a composite member 220, and eventually radially outward into engagement with the surrounding tubular (208, FIG. 2B).

Serrated outer surfaces or teeth 298 of the slip(s) 234 may be configured such that the surfaces 298 prevent the slip 234 (or tool) from moving (e.g., axially or longitudinally) within the surrounding tubular, whereas otherwise the tool 202 may inadvertently release or move from its position. Although slip 234 is illustrated with teeth 298, it is within the scope of the disclosure that slip 234 may be configured with other gripping features, such as buttons or inserts.

Initially, the seal element 222 may swell into contact with the tubular, followed by further tension in the tool 202 that may result in the seal element 222 and composite member 220 being compressed together, such that surface 289 acts on the interior surface 288. The ability to "flower", unwind, and/or expand may allow the composite member 220 to extend completely into engagement with the inner surface of the surrounding tubular.

Additional tension or load may be applied to the tool 202 that results in movement of cone 236, which may be disposed around the mandrel 214 in a manner with at least one surface 237 angled (or sloped, tapered, etc.) inwardly of second slip 242. The second slip 242 may reside adjacent or proximate to collar or cone 236. As such, the seal element 222 forces the cone 236 against the slip 242, moving the slip 242 radially outwardly into contact or gripping engagement with the tubular. Accordingly, the one or more slips 234, 242 may be urged radially outward and into engagement with the tubular (208, FIG. 2B). In an embodiment, cone 236 may be slidingly engaged and disposed around the mandrel 214. As shown, the first slip 234 may be at or near distal end 246, and the second slip 242 may be disposed around the mandrel 214 at or near the proximate end 248. It is within the scope of the disclosure that the position of the slips 234 and 242 may be interchanged. Moreover, slip 234 may be interchanged with a slip comparable to slip 242, and vice versa.

Because the sleeve 254 is held rigidly in place, the sleeve 254 may engage against a bearing plate 283 that may result in the transfer load through the rest of the tool 202. The setting sleeve 254 may have a sleeve end 255 that abuts against the bearing plate end 284. As tension increases through the tool 202, an end of the cone 236, such as second end 240, compresses against slip 242, which may be held in place by the bearing plate 283. As a result of cone 236 having freedom of movement and its conical surface 237, the cone 236 may move to the underside beneath the slip 242, forcing the slip 242 outward and into engagement with the surrounding tubular (208, FIG. 2B).

The second slip 242 may include one or more, gripping elements, such as buttons or inserts 278, which may be configured to provide additional grip with the tubular. The inserts 278 may have an edge or corner 279 suitable to provide additional bite into the tubular surface. In an embodiment, the inserts 278 may be mild steel, such as 1018 heat treated steel. The use of mild steel may result in reduced or eliminated casing damage from slip engagement and reduced drill string and equipment damage from abrasion.

In an embodiment, slip 242 may be a one-piece slip, whereby the slip 242 has at least partial connectivity across its entire circumference. Meaning, while the slip 242 itself may have one or more grooves (or undulation, notch, etc.) 244 configured therein, the slip 242 itself has no initial circumferential separation point. In an embodiment, the grooves 244 may be equidistantly spaced or disposed in the second slip 242. In other embodiments, the grooves 244 may have an alternatingly arranged configuration. That is, one groove 244A may be proximate to slip end 241, the next groove 244B may be proximate to an opposite slip end 243, and so forth.

The tool 202 may be configured with ball plug check valve assembly that includes a ball seat 286. The assembly may be removable or integrally formed therein. In an embodiment, the bore 250 of the mandrel 214 may be configured with the ball seat 286 formed or removably disposed therein. In some embodiments, the ball seat 286 may be integrally formed within the bore 250 of the mandrel 214. In other embodiments, the ball seat 286 may be separately or optionally installed within the mandrel 214, as may be desired.

The ball seat 286 may be configured in a manner so that a ball 285 seats or rests therein, whereby the flowpath through the mandrel 214 may be closed off (e.g., flow through the bore 250 is restricted or controlled by the presence of the ball 285). For example, fluid flow from one direction may urge and hold the ball 285 against the seat 286, whereas fluid flow from the opposite direction may urge the ball 285 off or away from the seat 286. As such, the ball 285 and the check valve assembly may be used to prevent or otherwise control fluid flow through the tool 202. The ball 285 may be conventionally made of a composite material, phenolic resin, etc., whereby the ball 285 may be capable of holding maximum pressures experienced during downhole operations (e.g., fracing). By utilization of retainer pin 287, the ball 285 and ball seat 286 may be configured as a retained ball plug. As such, the ball 285 may be adapted to serve as a check valve by sealing pressure from one direction but allowing fluids to pass in the opposite direction.

The tool 202 may be configured as a drop ball plug, such that a drop ball may be flowed to a drop ball seat 259. The drop ball may be much larger diameter than the ball of the ball check. In an embodiment, end 248 may be configured with a drop ball seat surface 259 such that the drop ball may come to rest and seat at in the seat proximate end 248. As applicable, the drop ball (not shown here) may be lowered into the wellbore (206, FIG. 2A) and flowed toward the drop ball seat 259 formed within the tool 202. The ball seat may be formed with a radius 259A (i.e., circumferential rounded edge or surface).

In other aspects, the tool 202 may be configured as a bridge plug, which once set in the wellbore, may prevent or allow flow in either direction (e.g., upwardly/downwardly, etc.) through tool 202. Accordingly, it should be apparent to one of skill in the art that the tool 202 of the present disclosure may be configurable as a frac plug, a drop ball plug, bridge plug, etc. simply by utilizing one of a plurality of adapters or other optional components. In any configuration, once the tool 202 is properly set, fluid pressure may be increased in the wellbore, such that further downhole operations, such as fracture in a target zone, may commence.

The tool 202 may include an anti-rotation assembly that includes an anti-rotation device or mechanism 282, which may be a spring, a mechanically spring-energized composite tubular member, and so forth. The device 282 may be configured and usable for the prevention of undesired or inadvertent movement or unwinding of the tool 202 components. As shown, the device 282 may reside in cavity 294 of the sleeve (or housing) 254. During assembly the device 282 may be held in place with the use of a lock ring 296. In other aspects, pins may be used to hold the device 282 in place.

FIG. 2D shows the lock ring 296 may be disposed around a part 217 of a setting tool coupled with the workstring 212. The lock ring 296 may be securely held in place with screws inserted through the sleeve 254. The lock ring 296 may include a guide hole or groove 295, whereby an end 282A of the device 282 may slidingly engage therewith. Protrusions or dogs 295A may be configured such that during assembly, the mandrel 214 and respective tool components may ratchet and rotate in one direction against the device 282; however, the engagement of the protrusions 295A with device end 282B may prevent back-up or loosening in the opposite direction.

The anti-rotation mechanism may provide additional safety for the tool and operators in the sense it may help prevent inoperability of tool in situations where the tool is inadvertently used in the wrong application. For example, if the tool is used in the wrong temperature application, components of the tool may be prone to melt, whereby the device 282 and lock ring 296 may aid in keeping the rest of the tool together. As such, the device 282 may prevent tool components from loosening and/or unscrewing, as well as prevent tool 202 unscrewing or falling off the workstring 212.

Drill-through of the tool 202 may be facilitated by the fact that the mandrel 214, the slips 234, 242, the cone(s) 236, the composite member 220, etc. may be made of drillable material that is less damaging to a drill bit than those found in conventional plugs. The drill bit will continue to move through the tool 202 until the downhole slip 234 and/or 242 are drilled sufficiently that such slip loses its engagement with the well bore. When that occurs, the remainder of the tools, which generally would include lower sleeve 260 and any portion of mandrel 214 within the lower sleeve 260 falls into the well. If additional tool(s) 202 exist in the well bore beneath the tool 202 that is being drilled through, then the falling away portion will rest atop the tool 202 located further in the well bore and will be drilled through in connection with the drill through operations related to the tool 202 located further in the well bore. Accordingly, the tool 202 may be sufficiently removed, which may result in opening the tubular 208.

Referring now to FIGS. 3A, 3B, 3C and 3D together, an isometric view and a longitudinal cross-sectional view of a mandrel usable with a downhole tool, a longitudinal cross-sectional view of an end of a mandrel, and a longitudinal cross-sectional view of an end of a mandrel engaged with a sleeve, in accordance with embodiments disclosed herein, are shown. Components of the downhole tool (e.g., 202, 1002, etc.) may be arranged and disposed about the mandrel 314, as described and understood to one of skill in the art. The mandrel 314, which may be made from filament wound drillable material, may have a distal end 346 and a proximate end 348. The filament wound material may be made of various angles as desired to increase strength of the mandrel 314 in axial and radial directions. The presence of the mandrel 314 may provide the tool with the ability to hold pressure and linear forces during setting or plugging operations.

The mandrel 314 may be sufficient in length, such that the mandrel may extend through a length of tool (or tool body) (202, FIG. 2B). The mandrel 314 may be a solid body. In other aspects, the mandrel 314 may include a flowpath or bore 350 formed therethrough (e.g., an axial bore). There may be a flowpath or bore 350, for example an axial bore, that extends through the entire mandrel 314, with openings at both the proximate end 348 and oppositely at its distal end 346. Accordingly, the mandrel 314 may have an inner bore surface 347, which may include one or more threaded surfaces formed thereon.

Figure 3A:
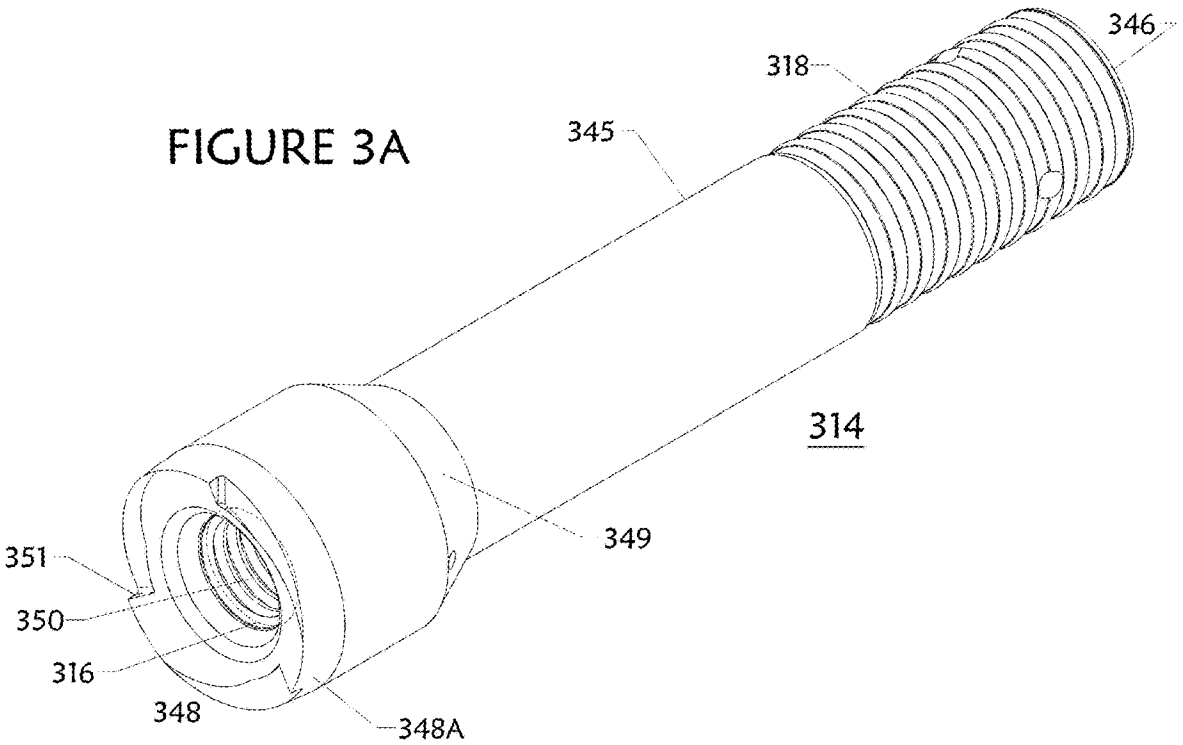
FIG. 3A shows an isometric view of a mandrel usable with a downhole tool according to embodiments of the disclosure.
Figure 3B:
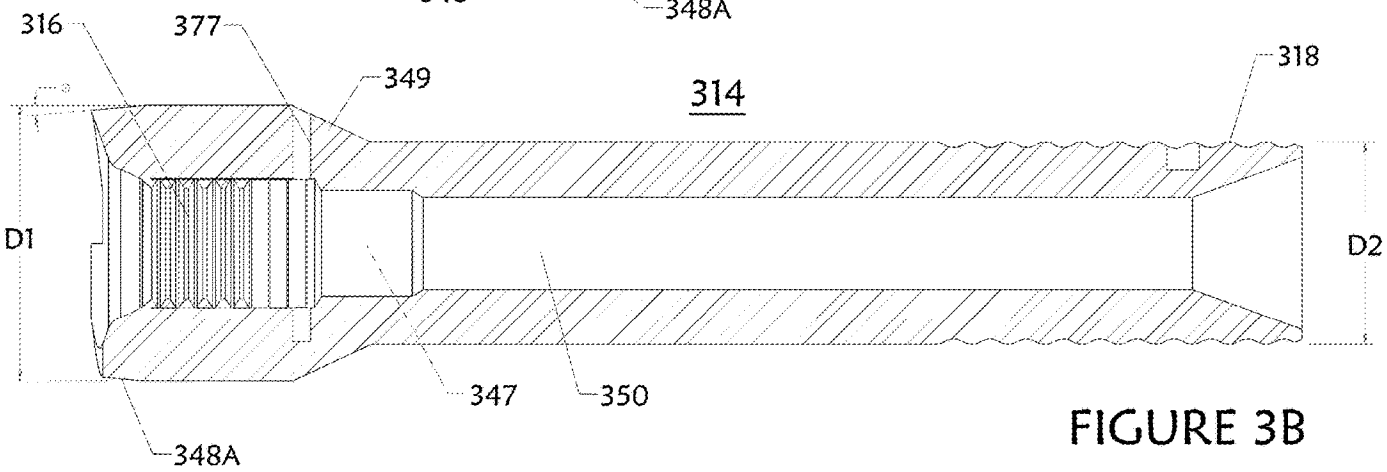
FIG. 3B shows a longitudinal cross-sectional view of a mandrel usable with a downhole tool according to embodiments of the disclosure.

The ends 346, 348 of the mandrel 314 may include internal or external (or both) threaded portions. As shown in FIG. 3C, the mandrel 314 may have internal threads 316 within the bore 350 configured to receive a mechanical or wireline setting tool, adapter, etc. (not shown here). For example, there may be a first set of threads 316 configured for coupling the mandrel 314 with corresponding threads of another component (e.g., adapter 252, FIG. 2B). In an embodiment, the first set of threads 316 are shear threads. In an embodiment, application of a load to the mandrel 314 may be sufficient enough to shear the first set of threads 316. Although not necessary, the use of shear threads may eliminate the need for a separate shear ring or pin and may provide for shearing the mandrel 314 from the workstring.

The proximate end 348 may include an outer taper 348A. The outer taper 348A may help prevent the tool from getting stuck or binding. For example, during setting the use of a smaller tool may result in the tool binding on the setting sleeve, whereby the use of the outer taper 348 will allow the tool to slide off easier from the setting sleeve. In an embodiment, the outer taper 348A may be formed at an angle $\varphi$ of about 5 degrees with respect to the axis 358. The length of the taper 348A may be about 0.5 inches to about 0.75 inches There may be a neck or transition portion 349, such that the mandrel may have variation with its outer diameter. In an embodiment, the mandrel 314 may have a first outer diameter D1 that is greater than a second outer diameter D2. Conventional mandrel components are configured with shoulders (i.e., a surface angle of about 90 degrees) that result in components prone to direct shearing and failure. In contrast, embodiments of the disclosure may include the transition portion 349 configured with an angled transition surface 349A. A transition surface angle b may be about 25 degrees with respect to the tool (or tool component axis) 358.

The transition portion 349 may withstand radial forces upon compression of the tool components, thus sharing the load. That is, upon compression the bearing plate 383 and mandrel 314, the forces are not oriented in just a shear direction. The ability to share load(s) among components means the components do not have to be as large, resulting in an overall smaller tool size.

There may be one or more protrusions or dogs 395A disposed on a lateral end of the proximate end 348. The protrusion 395A may include an elevated portion 370A that transitions to a lower portion 370B. While not meant to be limited, FIG. 3A shows there may be about three protrusions 395A on the lateral end of the proximate end 348.

In addition to the first set of threads 316, the mandrel 314 may have a second set of threads 318. In one embodiment, the second set of threads 318 may be rounded threads disposed along an external mandrel surface 345 at the distal end 346. The use of rounded threads may increase the shear strength of the threaded connection.

Figure 3D:
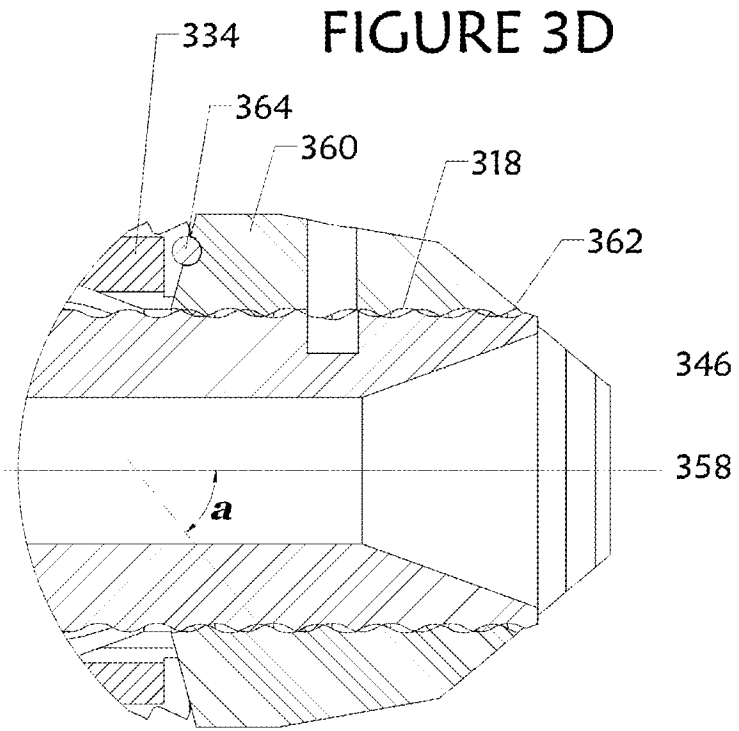
FIG. 3D shows a longitudinal cross-sectional view of an end of a mandrel engaged with a sleeve according to embodiments of the disclosure.
Figure 3C:
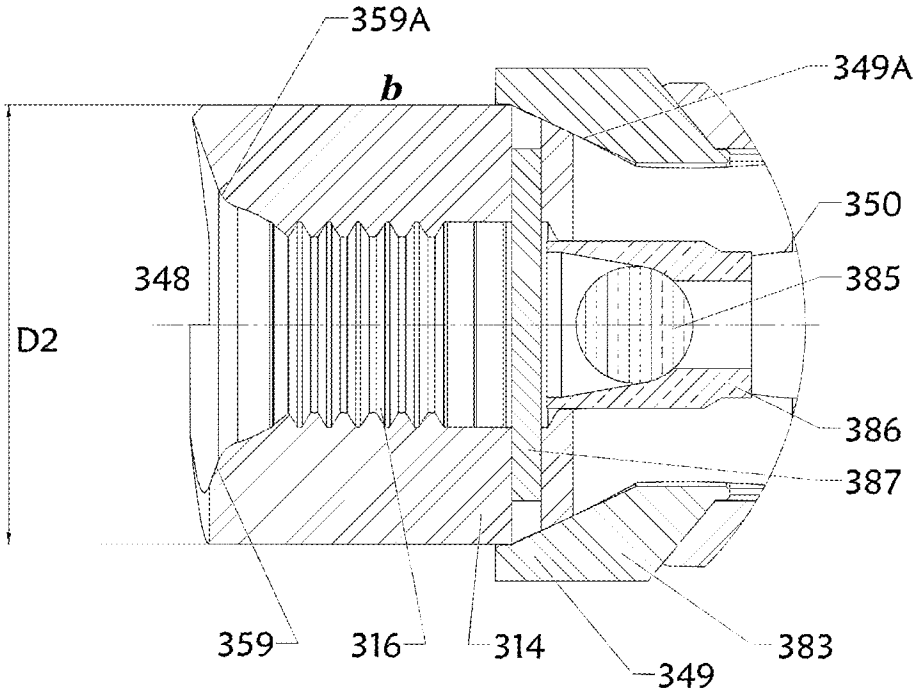
FIG. 3C shows a longitudinal cross-sectional view of an end of a mandrel usable with a downhole tool according to embodiments of the disclosure.

FIG. 3D illustrates an embodiment of component connectivity at the distal end 346 of the mandrel 314. As shown, the mandrel 314 may be coupled with a sleeve 360 having corresponding threads 362 configured to mate with the second set of threads 318. In this manner, setting of the tool may result in distribution of load forces along the second set of threads 318 at an angle a away from axis 358. There may be one or more balls 364 disposed between the sleeve 360 and slip 334. The balls 364 may help promote even breakage of the slip 334.

Accordingly, the use of round threads may allow a non-axial interaction between surfaces, such that there may be vector forces in other than the shear/axial direction. The round thread profile may create radial load (instead of shear) across the thread root. As such, the rounded thread profile may also allow distribution of forces along more thread surface(s). As composite material is typically best suited for compression, this allows smaller components and added thread strength. This beneficially provides upwards of 5-times strength in the thread profile as compared to conventional composite tool connections.

With particular reference to FIG. 3C, the mandrel 314 may have a ball seat 386 disposed therein. In some embodiments, the ball seat 386 may be a separate component, while in other embodiments the ball seat 386 may be formed integral with the mandrel 314. There also may be a drop ball seat surface 359 formed within the bore 350 at the proximate end 348. The ball seat 359 may have a radius 359A that provides a rounded edge or surface for the drop ball to mate with. In an embodiment, the radius 359A of seat 359 may be smaller than the ball that seats in the seat. Upon seating, pressure may "urge" or otherwise wedge the drop ball into the radius, whereby the drop ball will not unseat without an extra amount of pressure. The amount of pressure required to urge and wedge the drop ball against the radius surface, as well as the amount of pressure required to unwedge the drop ball, may be predetermined. Thus, the size of the drop ball, ball seat, and radius may be designed, as applicable.

The use of a small curvature or radius 359A may be advantageous as compared to a conventional sharp point or edge of a ball seat surface. For example, radius 359A may provide the tool with the ability to accommodate drop balls with variation in diameter, as compared to a specific diameter. In addition, the surface 359 and radius 359A may be better suited to distribution of load around more surface area of the ball seat as compared to just at the contact edge/point of other ball seats.

Figure 4A:
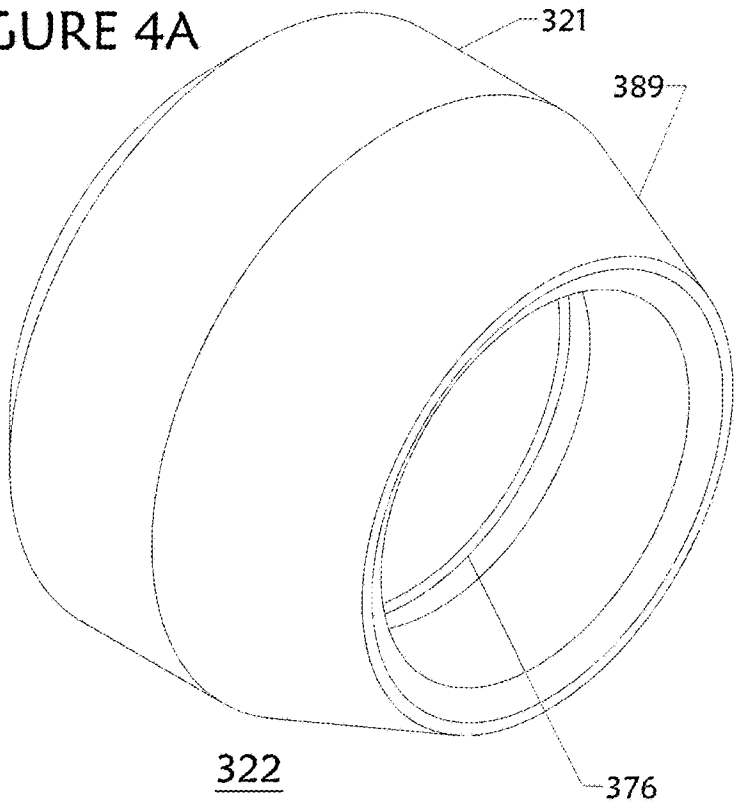
FIG. 4A shows a longitudinal cross-sectional view of a seal element usable with a downhole tool according to embodiments of the disclosure.
Figure 4B:
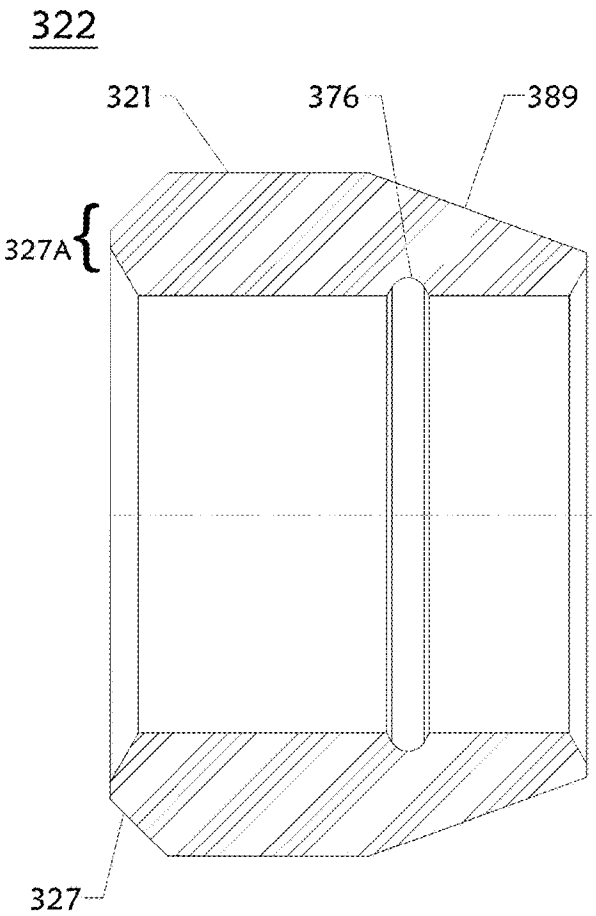
FIG. 4B shows an isometric view of a seal element usable with a downhole tool according to embodiments of the disclosure.

Referring now to FIGS. 4A and 4B together, a longitudinal cross-sectional view and an isometric view of a seal element (and its subcomponents), respectively, usable with a downhole tool in accordance with embodiments disclosed herein are shown. The seal element 322 may be made of an elastomeric and/or poly material, such as rubber, nitrile rubber, Viton or polyurethane, and may be configured for positioning or otherwise disposed around the mandrel (e.g., 214, FIG. 2C). In an embodiment, the seal element 322 may be made from 75 Duro A elastomer material. The seal element 322 may be disposed between a first slip and a second slip (see FIG. 2C, seal element 222 and slips 234, 236).

The seal element 322 may be configured to buckle (deform, compress, etc.), such as in an axial manner, during the setting sequence of the downhole tool (e.g., 202, 1002, etc.). However, although the seal element 322 may buckle, the seal element 322 may also be adapted to expand or swell, such as in a radial manner, into sealing engagement with the surrounding tubular (e.g., 208, FIG. 2B) upon compression of the tool components. In a preferred embodiment, the seal element 322 provides a fluid-tight seal of the seal surface 321 against the tubular.

The seal element 322 may have one or more angled surfaces configured for contact with other component surfaces proximate thereto. For example, the seal element may have angled surfaces 327 and 389. The seal element 322 may be configured with an inner circumferential groove 376. The presence of the groove 376 assists the seal element 322 to initially buckle upon start of the setting sequence. The groove 376 may have a size (e.g., width, depth, etc.) of about 0.25 inches.

Slips. Referring now to FIGS. 5A, 5B, 5C, 5D, 5E, 5F, and 5G together, an isometric view, a lateral view, and a longitudinal cross-sectional view of one or more slips, and an isometric view of a metal slip, a lateral view of a metal slip, a longitudinal cross-sectional view of a metal slip, and an isometric view of a metal slip without buoyant material holes, respectively, (and related subcomponents) usable with a downhole tool in accordance with embodiments disclosed herein are shown. The slips 334, 342 described may be made from metal, such as cast iron, or from composite material, such as filament wound composite. During operation, the winding of the composite material may work in conjunction with inserts under compression in order to increase the radial load of the tool.

Either or both of slips 334, 342 may be made of non-composite material, such as a metal or metal alloys. Either or both of slips 334, 342 may be made of a reactive material (e.g., dissolvable, degradable, etc.). In embodiments, the material may be a metallic material, such as an aluminum-based or magnesium-based material. The metallic material may be reactive, such as dissolvable, which is to say under certain conditions the respective component(s) may begin to dissolve, and thus alleviating the need for drill thru. In embodiments, any slip of downhole tool embodiments herein may be made of dissolvable aluminum-, magnesium-, or aluminum-magnesium-based (or alloy, complex, etc.) material.

Slips 334, 342 may be used in either upper or lower slip position, or both, without limitation. As apparent, there may be a first slip 334, which may be disposed around the mandrel (e.g., 214, 1014), and there may also be a second slip 342, which may also be disposed around the mandrel.

Figure 5A:
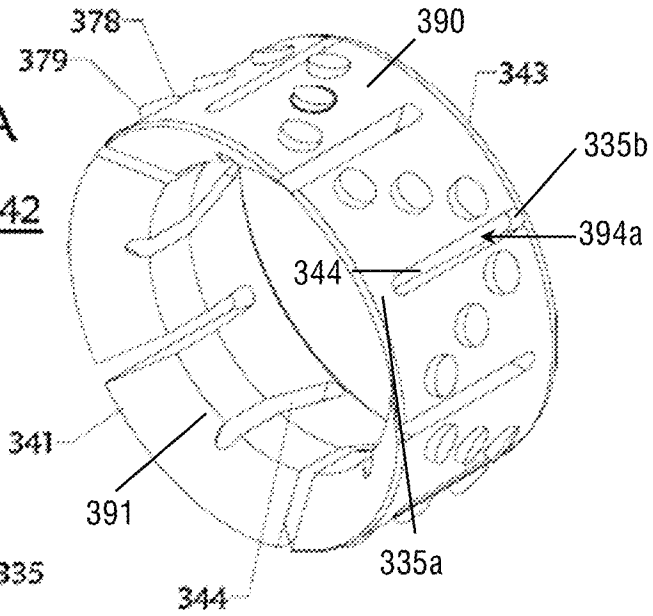
FIG. 5A shows an isometric view of one or more slips usable with a downhole tool according to embodiments of the disclosure.
Figure 5C:
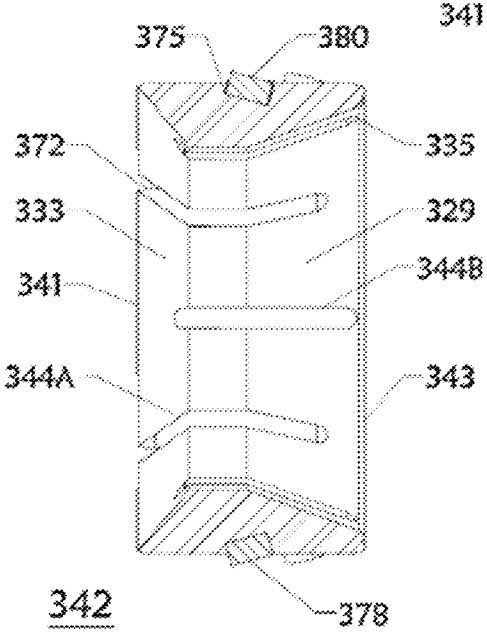
FIG. 5C shows a longitudinal cross-sectional view of one or more slips usable with a downhole tool according to embodiments of the disclosure.
Figure 5B:
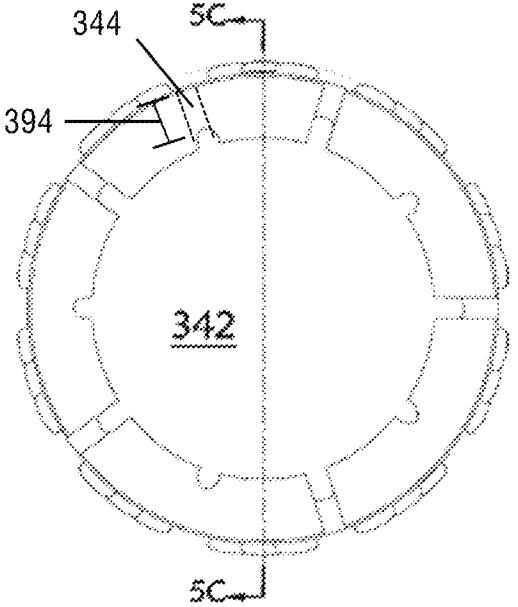
FIG. 5B shows a lateral view of one or more slips usable with a downhole tool according to embodiments of the disclosure.
Figure 5D:
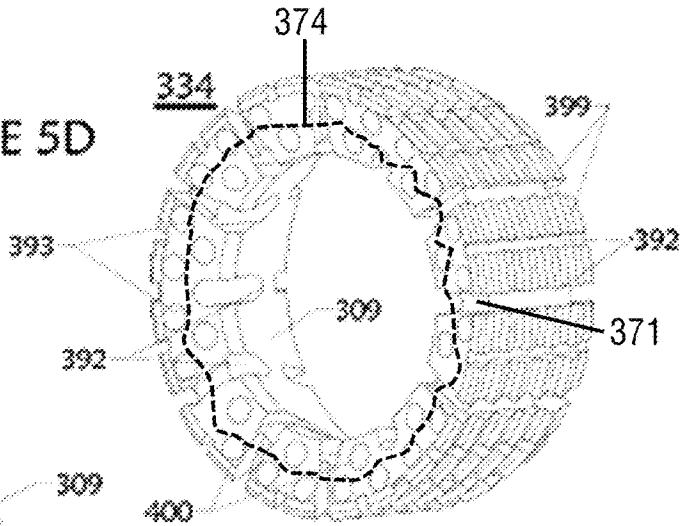
FIG. 5D shows an isometric view of a metal slip usable with a downhole tool according to embodiments of the disclosure.
Figure 5G:
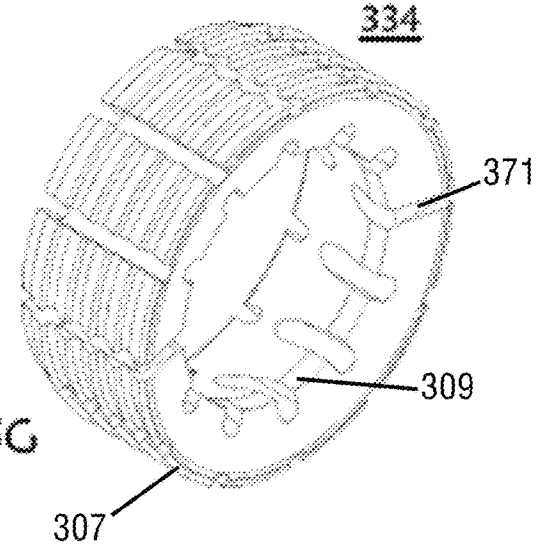
FIG. 5G shows an isometric view of a metal slip without buoyant material holes usable with a downhole tool according to embodiments of the disclosure.
Figure 5F:
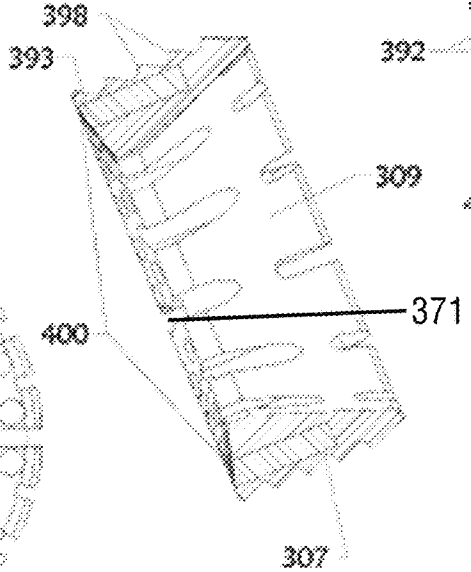
FIG. 5F shows a longitudinal cross-sectional view of a metal slip usable with a downhole tool according to embodiments of the disclosure.
Figure 5E:
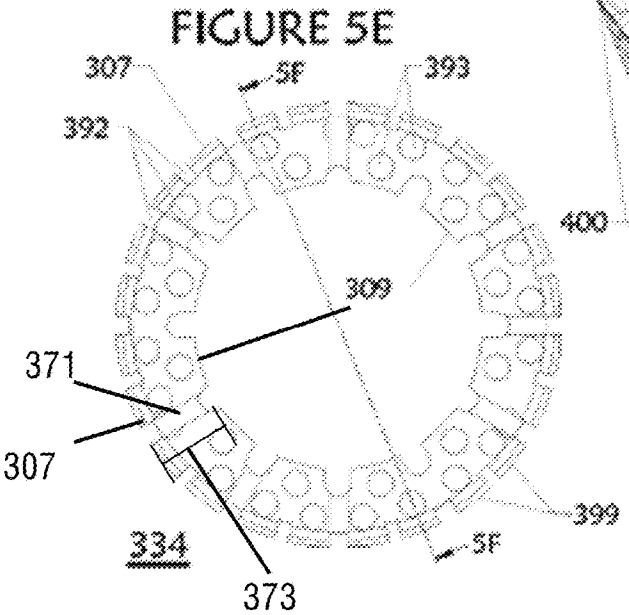
FIG. 5E shows a lateral view of a metal slip usable with a downhole tool according to embodiments of the disclosure.

Either of slips 334, 342 may include a means for gripping the inner wall of the tubular, casing, and/or well bore, such as a plurality of gripping elements, including serrations or teeth 398, inserts 378, etc. As shown in FIGS. 5D-5F, the first slip 334 may include rows and/or columns 399 of serrations 398. The gripping elements may be arranged or configured whereby the slips 334, 342 engage the tubular (not shown) in such a manner that movement (e.g., longitudinally axially) of the slips or the tool once set is prevented.

In embodiments, the slip 334 may be a poly-moldable material. In other embodiments, the slip 334 may be hardened, surface hardened, heat-treated, carburized, etc., as would be apparent to one of ordinary skill in the art. However, in some instances, slips 334 may be too hard and end up as too difficult or take too long to drill through.

Typically, hardness on the teeth 398 may be about 40-60 Rockwell. As understood by one of ordinary skill in the art, the Rockwell scale is a hardness scale based on the indentation hardness of a material. Typical values of very hard steel have a Rockwell number (HRC) of about 55-66. In some aspects, even with only outer surface heat treatment the inner slip core material may become too hard, which may result in the slip 334 being impossible or impracticable to drill-thru.

Thus, the slip 334 may be configured to include one or more holes 393 formed therein. The holes 393 may be longitudinal in orientation through the slip 334. The presence of one or more holes 393 may result in the outer surface(s) 307 of the metal slips as the main and/or majority slip material exposed to heat treatment, whereas the core or inner body (or surface) 309 of the slip 334 is protected. In other words, the holes 393 may provide a barrier to transfer of heat by reducing the thermal conductivity (i.e., k-value) of the slip 334 from the outer surface(s) 307 to the inner core or surfaces 309. The presence of the holes 393 is believed to affect the thermal conductivity profile of the slip 334, such that that heat transfer is reduced from outer to inner because otherwise when heat/quench occurs the entire slip 334 heats up and hardens.

Thus, during heat treatment, the teeth 398 on the slip 334 may heat up and harden resulting in heat-treated outer area/teeth, but not the rest of the slip. In this manner, with treatments such as flame (surface) hardening, the contact point of the flame is minimized (limited) to the proximate vicinity of the teeth 398.

With the presence of one or more holes 393, the hardness profile from the teeth to the inner diameter/core (e.g., laterally) may decrease dramatically, such that the inner slip material or surface 309 has an HRC of about ~15 (or about normal hardness for regular steel/cast iron). In this aspect, the teeth 398 stay hard and provide maximum bite, but the rest of the slip 334 is easily drillable.

One or more of the void spaces/holes 393 may be filled with useful "buoyant" (or low density) material 400 to help debris and the like be lifted to the surface after drill-thru. The material 400 disposed in the holes 393 may be, for example, polyurethane, light weight beads, or glass bubbles/beads such as the K-series glass bubbles made by and available from 3M. Other low-density materials may be used.

The advantageous use of material 400 may help promote lift on debris after the slip 334 is drilled through. The material 400 may be epoxied or injected into the holes 393 as would be apparent to one of skill in the art.

The metal slip 334 may be treated with an induction hardening process. In such a process, the slip 334 may be moved through a coil that has a current run through it. As a result of physical properties of the metal and magnetic properties, a current density (created by induction from the e-field in the coil) may be controlled in a specific location of the teeth 398. This may lend to speed, accuracy, and repeatability in modification of the hardness profile of the slip 334. Thus, for example, the teeth 398 may have a RC in excess of 60, and the rest of the slip 334 (essentially virgin, unchanged metal) may have a RC less than about 15.

The slots 392 in the slip 334 may promote breakage. An evenly spaced configuration of slots 392 promotes even breakage of the slip 334. The metal slip 334 may have a body having a one-piece configuration defined by at least partial connectivity of slip material around the entirety of the body, as shown in FIG. 5D via connectivity reference line 374. The slip 334 may have at least one lateral groove 371. The lateral groove may be defined by a depth 373. The depth 373 may extend from the outer surface 307 to the inner surface 309.

First slip 334 may be disposed around or coupled to the mandrel (214, 1014, etc.) as would be known to one of skill in the art, such as a band or with shear screws (not shown) configured to maintain the position of the slip 334 until sufficient pressure (e.g., shear) is applied. The band may be made of steel wire, plastic material or composite material having the requisite characteristics in sufficient strength to hold the slip 334 in place while running the downhole tool into the wellbore, and prior to initiating setting. The band may be drillable. FIG. 5G illustrates slip 334 may be a hardened cast iron slip without the presence of any grooves or holes 393 formed therein.

Referring again to FIGS. 5A-5C, slip 342 may be a one-piece slip, whereby the slip 342 has at least partial connectivity across its entire circumference. Meaning, while the slip 342 itself may have one or more grooves 344 configured therein, the slip 342 has no separation point in the pre-set configuration. In an embodiment, the grooves 344 may be equidistantly spaced or cut in the second slip 342. In other embodiments, the grooves 344 may have an alternatingly arranged configuration. That is, one groove 344A may be proximate to slip end 341 and adjacent groove 344B may be proximate to an opposite slip end 343. As shown in groove 344A may extend all the way through the slip end 341, such that slip end 341 is devoid of material at point 372. The slip 342 may have an outer slip surface 390 and an inner slip surface 391.

Where the slip 342 is devoid of material at its ends, that portion or proximate area of the slip may have the tendency to flare first during the setting process. The arrangement or position of the grooves 344 of the slip 342 may be designed as desired. In an embodiment, the slip 342 may be designed with grooves 344 resulting in equal distribution of radial load along the slip 342. Alternatively, one or more grooves, such as groove 344B may extend proximate or substantially close to the slip end 343 but leaving a small amount material 335 therein. The presence of the small amount of material gives slight rigidity to hold off the tendency to flare. As such, part of the slip 342 may expand or flare first before other parts of the slip 342. There may be one or more grooves 344 that form a lateral opening 394*a* through the entirety of the slip body. That is, groove 344 may extend a depth 394 from the outer slip surface 390 to the inner slip surface 391. Depth 394 may define a lateral distance or length of how far material is removed from the slip body with reference to slip surface 390 (or also slip surface 391). FIG. 5A illustrates the at least one of the grooves 344 may be further defined by the presence of a first portion of slip material 335*a* on or at first end 341, and a second portion of slip material 335*b* on or at second end 343.

The slip 342 may have one or more inner surfaces with varying angles. For example, there may be a first angled slip surface 329 and a second angled slip surface 333. In an embodiment, the first angled slip surface 329 may have a 20-degree angle, and the second angled slip surface 333 may have a 40-degree angle; however, the degree of any angle of the slip surfaces is not limited to any particular angle. Use of angled surfaces allows the slip 342 significant engagement force, while utilizing the smallest slip 342 possible.

The use of a rigid single- or one-piece slip configuration may reduce the chance of presetting that is associated with conventional slip rings, as conventional slips are known for pivoting and/or expanding during run in. As the chance for pre-set is reduced, faster run-in times are possible.

The slip 342 may be used to lock the tool in place during the setting process by holding potential energy of compressed components in place. The slip 342 may also prevent the tool from moving as a result of fluid pressure against the tool. The second slip (342, FIG. 5A) may include inserts 378 disposed thereon. In an embodiment, the inserts 378 may be epoxied or press fit into corresponding insert bores or grooves 375 formed in the slip 342.

Figure 6A:
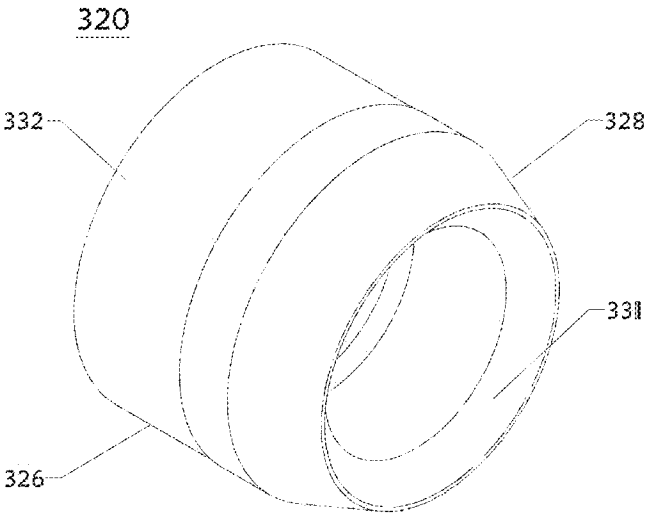
FIG. 6A shows an isometric view of a deformable member usable with a downhole tool according to embodiments of the disclosure.
Figure 6B:
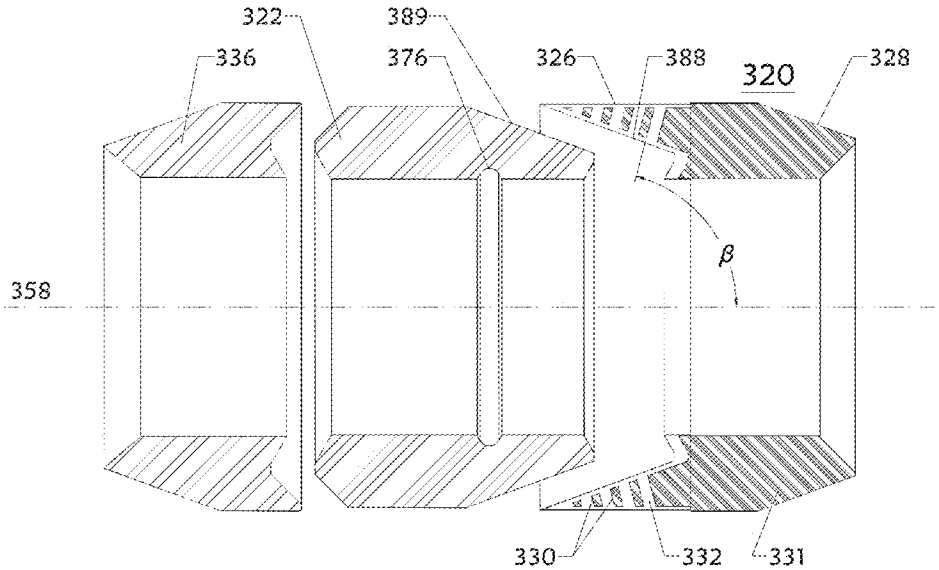
FIG. 6B shows a longitudinal cross-sectional view of a deformable member usable with a downhole tool according to embodiments of the disclosure.

Referring now to FIGS. 6A and 6B together, an isometric view and a longitudinal cross-sectional view, respectively, of a composite deformable member 320 (and its subcomponents) usable with a downhole tool in accordance with embodiments disclosed herein, are shown. The composite member 320 may be configured in such a manner that upon a compressive force, at least a portion of the composite member may begin to deform (or expand, deflect, twist, unspring, break, unwind, etc.) in a radial direction away from the tool axis (e.g., 258, FIG. 2C). Although exemplified as "composite", it is within the scope of the disclosure that member 320 may be made from metal, including alloys and so forth.

During the setting sequence, the seal element 322 and the composite member 320 may compress together (the seal element 322 also compressible to cone 336). As a result of an angled exterior surface 389 of the seal element 322 coming into contact with the interior surface 388 of the composite member 320, a deformable (or first or upper) portion 326 of the composite member 320 may be urged radially outward and into engagement the surrounding tubular (not shown) at or near a location where the seal element 322 at least partially sealingly engages the surrounding tubular. There may also be a resilient (or second or lower) portion 328. In an embodiment, the resilient portion 328 may be configured with greater or increased resilience to deformation as compared to the deformable portion 326.

The composite member 320 may be a composite component having at least a first material 331 and a second material 332, but composite member 320 may also be made of a single material. The first material 331 and the second material 332 need not be chemically combined. In an embodiment, the first material 331 may be physically or chemically bonded, cured, molded, etc. with the second material 332. Moreover, the second material 332 may likewise be physically or chemically bonded with the deformable portion 326. In other embodiments, the first material 331 may be a composite material, and the second material 332 may be a second composite material.

The composite member 320 may have cuts or grooves 330 formed therein. The use of grooves 330 and/or spiral (or helical) cut pattern(s) may reduce structural capability of the deformable portion 326, such that the composite member 320 may "flower" out. The groove 330 or groove pattern is not meant to be limited to any particular orientation, such that any groove 330 may have variable pitch and vary radially.

With groove(s) 330 formed in the deformable portion 326, the second material 332, may be molded or bonded to the deformable portion 326, such that the grooves 330 are filled in and enclosed with the second material 332. In embodiments, the second material 332 may be an elastomeric material. In other embodiments, the second material 332 may be 60-95 Duro A polyurethane or silicone. Other materials may include, for example, TFE or PTFE sleeve option-heat shrink. The second material 332 of the composite member 320 may have an inner material surface.

The use of the second material 332 in conjunction with the grooves 330 may provide support for the groove pattern and reduce preset issues. With the added benefit of second material 332 being bonded or molded with the deformable portion 326, the compression of the composite member 320 against the seal element 322 may result in a robust, reinforced, and resilient barrier and seal between the components and with the inner surface of the tubular member (e.g., 208 in FIG. 2B). As a result of increased strength, the seal, and hence the tool of the disclosure, may withstand higher downhole pressures. Higher downhole pressures may provide a user with better frac results. The seal element 322 may be configured with an inner circumferential groove 376.

Figure 7A:
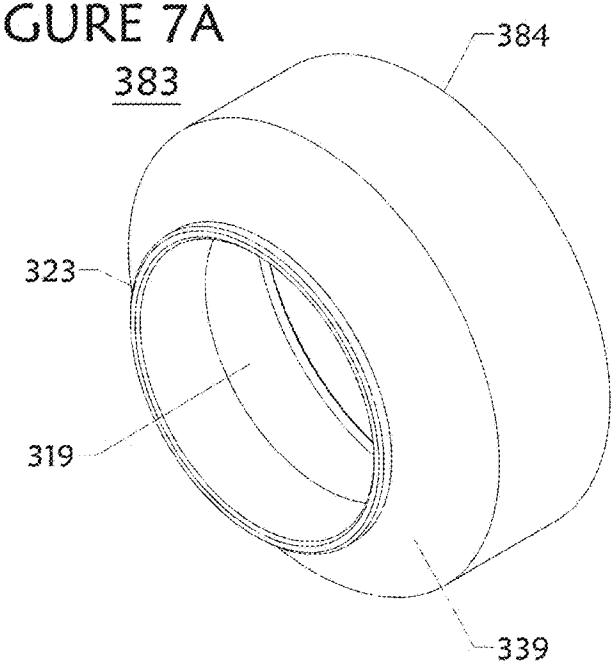
FIG. 7A shows an isometric view of a bearing plate usable with a downhole tool according to embodiments of the disclosure.
Figure 7B:
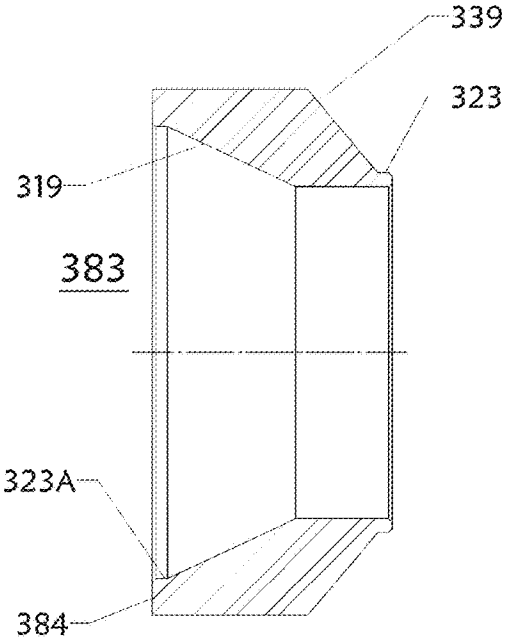
FIG. 7B shows a longitudinal cross-sectional view of a bearing plate usable with a downhole tool according to embodiments of the disclosure.

Referring now to FIGS. 7A and 7B together, an isometric view and a longitudinal cross-sectional view, respectively, of a bearing plate 383 (and its subcomponents) usable with a downhole tool in accordance with embodiments disclosed herein are shown. The bearing plate 383 may be made from filament wound material having wide angles. As such, the bearing plate 383 may endure increased axial load, while also having increased compression strength.

Because the sleeve (254, 1054, etc.) may held rigidly in place, the bearing plate 383 may likewise be maintained in place. The setting sleeve may have a sleeve end 255 that abuts against bearing plate end 284, 384. Briefly, FIG. 2C illustrates how compression of the sleeve end 255 with the plate end 284 may occur at the beginning of the setting sequence. As tension increases through the tool, an other end 239 of the bearing plate 283 may be compressed by slip 242, forcing the slip 242 outward and into engagement with the surrounding tubular (208, 1008, etc.).

Inner plate surface 319 may be configured for angled engagement with the mandrel. In an embodiment, plate surface 319 may engage the transition portion 349 of the mandrel 314. Lip 323 may be used to keep the bearing plate 383 concentric with the tool 202 and the slip 242. Small lip 323A may also assist with centralization and alignment of the bearing plate 383.

Figure 8A:
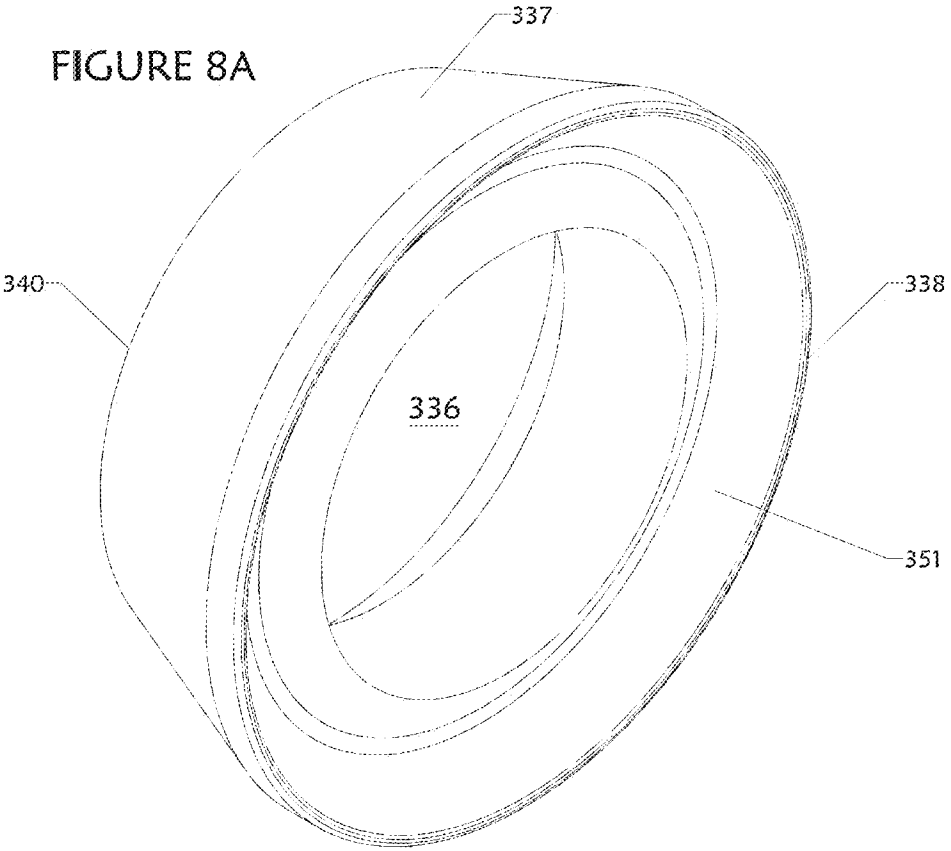
FIG. 8A shows an underside isometric view of a cone usable with a downhole tool according to embodiments of the disclosure.
Figure 8B:
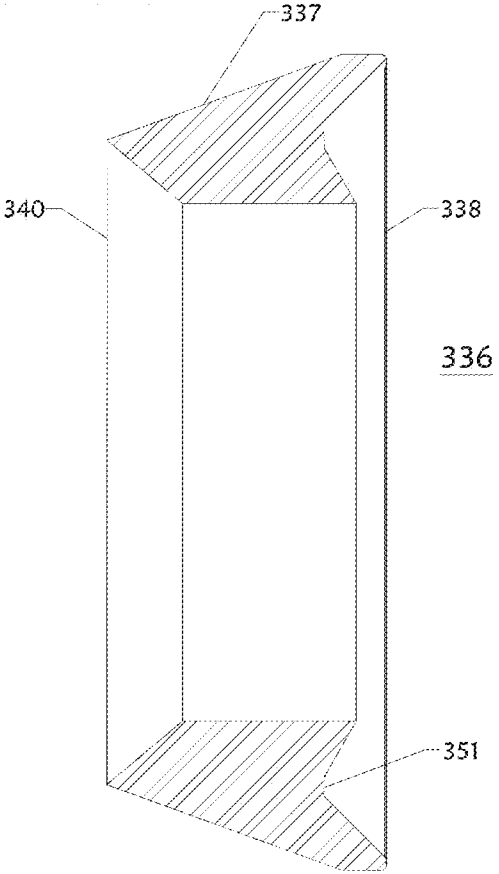
FIG. 8B shows a longitudinal cross-sectional view of a cone usable with a downhole tool according to embodiments of the disclosure.

Referring now to FIGS. 8A and 8B together, an underside isometric view and a longitudinal cross-sectional view, respectively, of one or more cones 336 (and its subcomponents) usable with a downhole tool in accordance with embodiments disclosed herein, are shown. In an embodiment, cone 336 may be slidingly engaged and disposed around the mandrel (e.g., cone 236 and mandrel 214 in FIG. 2C). Cone 336 may be disposed around the mandrel in a manner with at least one surface 337 angled (or sloped, tapered, etc.) inwardly with respect to other proximate components, such as the second slip (242, 1042, etc.). As such, the cone 336 with surface 337 may be configured to cooperate with the slip to force the slip radially outwardly into contact or gripping engagement with a tubular, as would be apparent and understood by one of skill in the art.

During setting, and as tension increases through the tool, an end of the cone 336, such as second end 340, may compress against the slip (see FIG. 2C). As a result of conical surface 337, the cone 336 may move to the underside beneath the slip, forcing the slip outward and into engagement with the surrounding tubular (see FIG. 2A). A first end 338 of the cone 336 may be configured with a cone profile 351. The cone profile 351 may be configured to mate with the seal element (222, 1022, etc.). In an embodiment, the cone profile 351 may be configured to mate with a corresponding profile 327A of the seal element (see FIG. 4A). The cone profile 351 may help restrict the seal element from rolling over or under the cone 336.

Figure 9A:
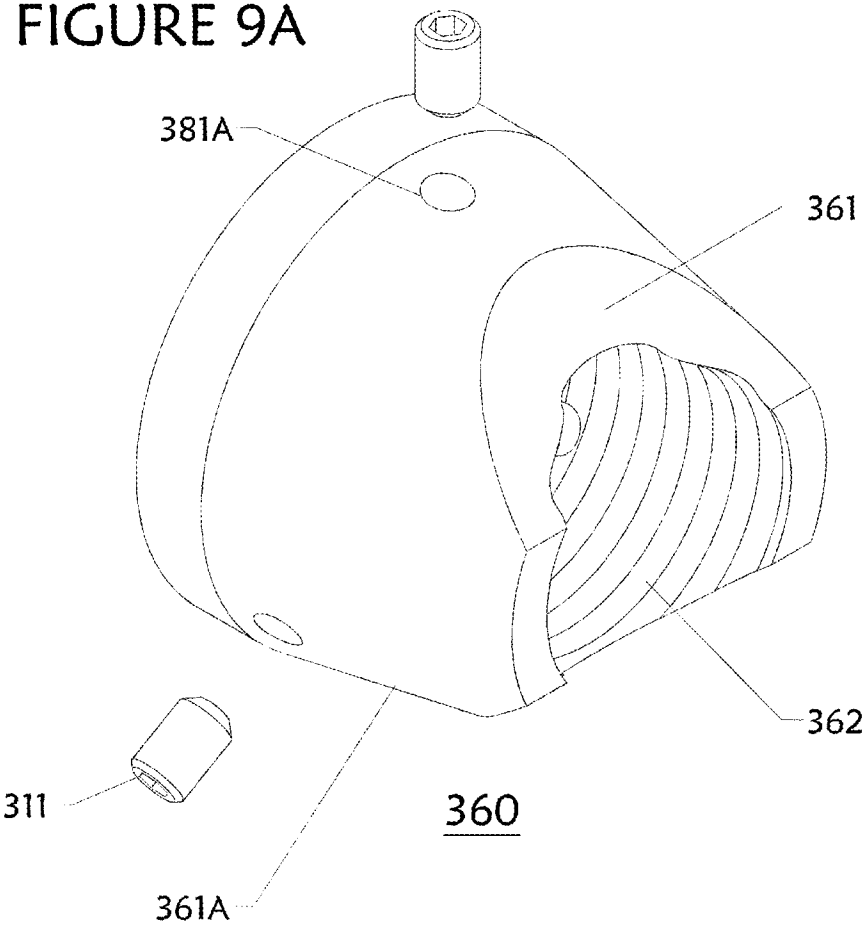
FIG. 9A shows an isometric view of a lower sleeve usable with a downhole tool according to embodiments of the disclosure.
Figure 9B:
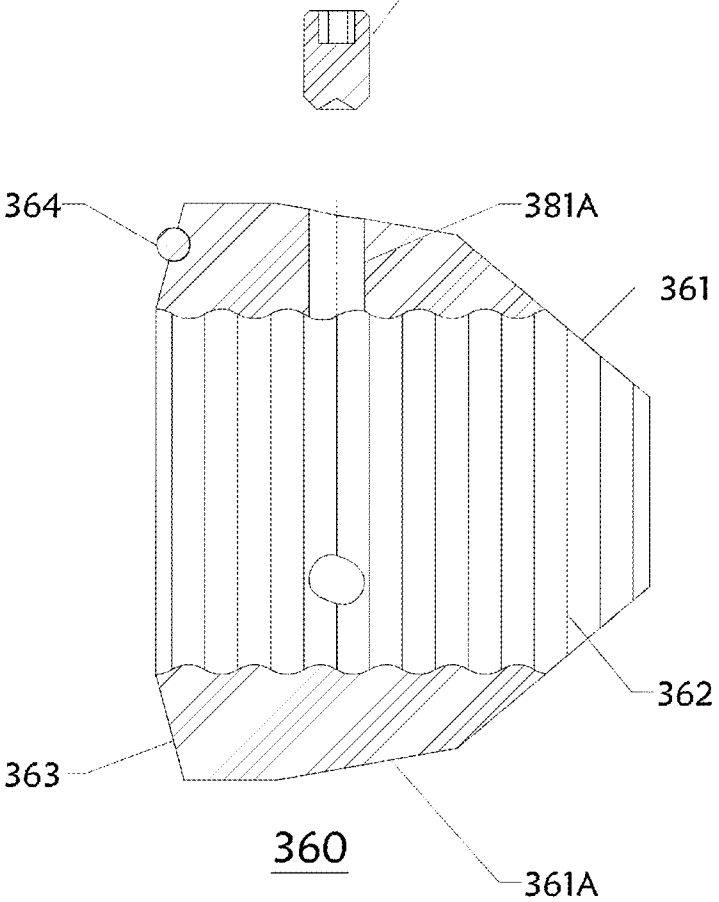
FIG. 9B shows a longitudinal cross-sectional view of a lower sleeve usable with a downhole tool according to embodiments of the disclosure.

Referring now to FIGS. 9A and 9B, an isometric view, and a longitudinal cross-sectional view, respectively, of a lower sleeve 360 (and its subcomponents) usable with a downhole tool in accordance with embodiments disclosed herein, are shown. During setting, the lower sleeve 360 will be pulled as a result of its attachment to the mandrel (214, 1014, etc.). As shown in FIGS. 9A and 9B together, the lower sleeve 360 may have one or more holes 381A that align with mandrel holes (see 281B, FIG. 2C). One or more anchor pins 311 may be disposed or securely positioned therein. In an embodiment, brass set screws may be used. Pins (or screws, etc.) 311 may prevent shearing or spin off during drilling.

As the lower sleeve 360 is pulled, the components disposed about mandrel between the may further compress against one another. The lower sleeve 360 may have one or more tapered surfaces 361, 361A which may reduce chances of hang up on other tools. The lower sleeve 360 may also have an angled sleeve end 363 in engagement with, for example, the first slip (234, 1034, etc.). As the lower sleeve 360 is pulled further, the end 363 presses against the slip. The lower sleeve 360 may be configured with an inner thread profile 362. In an embodiment, the profile 362 may include rounded threads. In another embodiment, the profile 362 may be configured for engagement and/or mating with the mandrel. Ball(s) 364 may be used. The ball(s) 364 may be for orientation or spacing with, for example, the slip 334. The ball(s) 364 and may also help maintain break symmetry of the slip 334. The ball(s) 364 may be, for example, brass or ceramic.

Figure 10A:
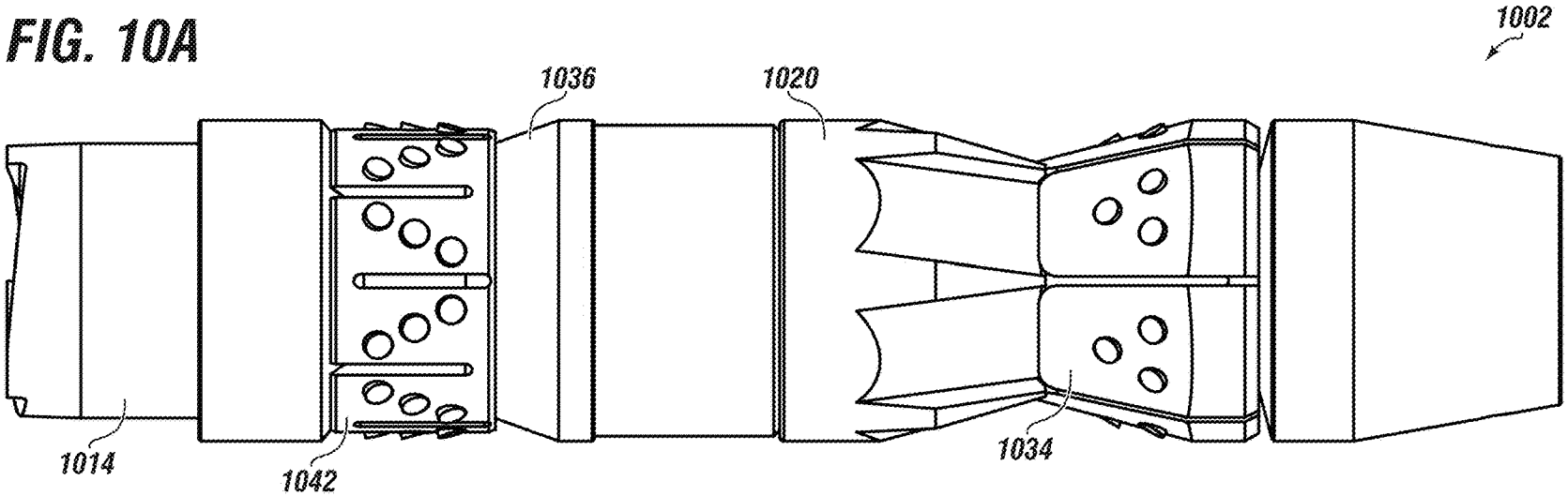
FIG. 10A shows a longitudinal external side view of a downhole tool with a bottom one-piece composite slip according to embodiments of the disclosure.
Figure 10B:
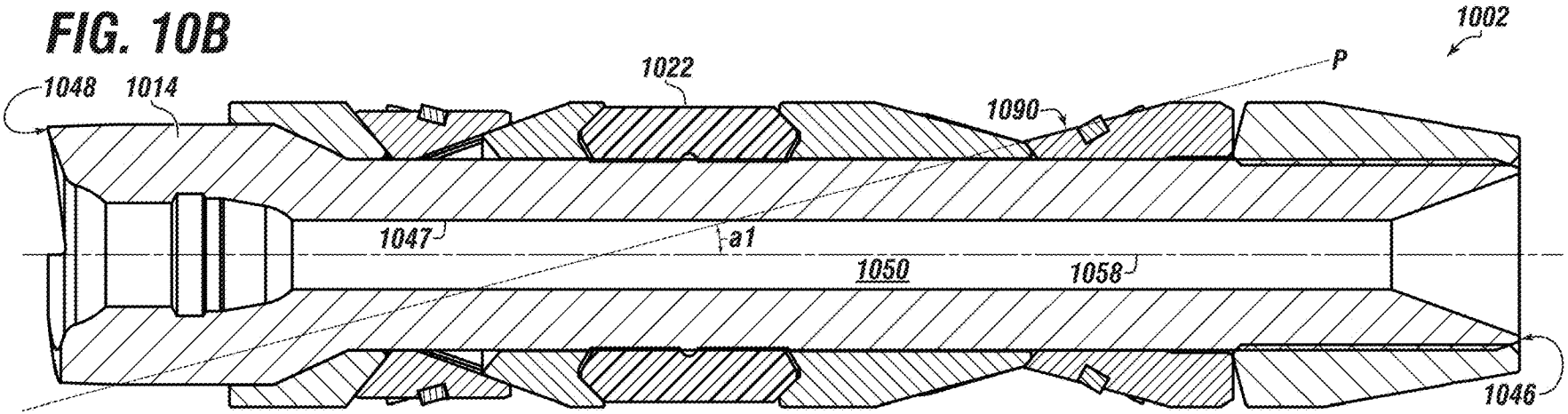
FIG. 10B shows a longitudinal cross-sectional side view of the downhole tool of FIG. 10A according to embodiments of the disclosure.

Referring now to FIGS. 10A and 10B together, a longitudinal external side view and a longitudinal cross-sectional side view, respectively, of a downhole tool with a bottom one-piece composite slip, in accordance with embodiments disclosed herein, are shown.

Downhole tool 1002 may be run, set, and operated as described herein and in other embodiments (such as in System 200, and so forth), and as otherwise understood to one of skill in the art. Components of the downhole tool 1002 may be arranged and disposed about a mandrel 1014, as described herein and in other embodiments, and as otherwise understood to one of skill in the art. Thus, downhole tool 1002 may be comparable or identical in aspects, function, operation, components, etc. as that of other tool embodiments disclosed herein. Similarities may not be discussed for the sake of brevity.

Operation of the downhole tool 1002 may allow for fast run in of the tool 1002 to isolate one or more sections of a wellbore as provided for herein. Drill-through of the tool 1002 may be facilitated by one or more components and sub-components of tool 1002 made of drillable material that may be measurably quicker to drill through than those found in conventional plugs, and/or made of reactive materials that may make drilling easier, or even outright alleviate any need.

The downhole tool 1002 may have one or more components, such as slips 1034 and 1042, may be made of a material as described herein and in accordance with embodiments of the disclosure. Such materials may include composite material, such as filament wound material, reactive material (metals or composites), and so forth. Filament wound material may provide advantages to that of other composite-type materials, and thus be desired over that of injection molded materials and the like.

The slips 1034, 1042 may be associated with respective cones or conical members 1020, 1036 (first cone and second cone, respectively). In embodiments, a deformable member (e.g., 320) may be used instead of the cone 1020.

The mandrel 1014 may extend through the tool (or tool body) 1002 in the sense that components may be disposed therearound. The mandrel 1014 may be a solid body. In other aspects, the mandrel 1014 may include a flowpath or bore 1050 formed therein (e.g., an axial bore). The bore 1050 may extend partially or for a short distance through the mandrel 1014. Alternatively, the bore 1050 may extend through the entire mandrel 1014, with an opening at its proximate end 1048 and oppositely at its distal end 1046.

With the presence of the bore 1050, the mandrel 1014 may have an inner bore surface 1047, which may include one or more threaded surfaces formed thereon. As such, there may be a first set of threads configured for coupling the mandrel 1014 with corresponding threads of a setting adapter (not shown here). To facilitate embodiments herein that may beneficially desire a 'bottom' or 'first' slip 1034 be non-metallic, and particularly filament wound composite material. The slip 1034 may include an angled outer surface 1090. The outer surface 1090 may be respective to one or more respective slip segments associated therewith, and/or more generally the entire effective outer surface. FIG. 10B illustrates in cross-section the outer surface 1090 being defined with a plane P (shown in 2D as a line) being parallel thereto. One of skill may appreciate the plane P being tangent to a point on the outer surface 1090.

Any slip segment of the slip may have a respective outer surface 1090 with related plane P in cross-section. The plane P may bisect a longitudinal axis 1058 of the downhole tool 1002 at an angle a1. The angle a1 may be greater than one degree. In embodiments the angle a1 may be in the range of 10 degrees to 20 degrees.

It is within the scope of the disclosure that although shown or contemplated as a one-piece slip, other embodiments remain possible, such as a multi-segmented slip (which may be held together by a band or ring), and thus not one-piece.

Figure 10C:
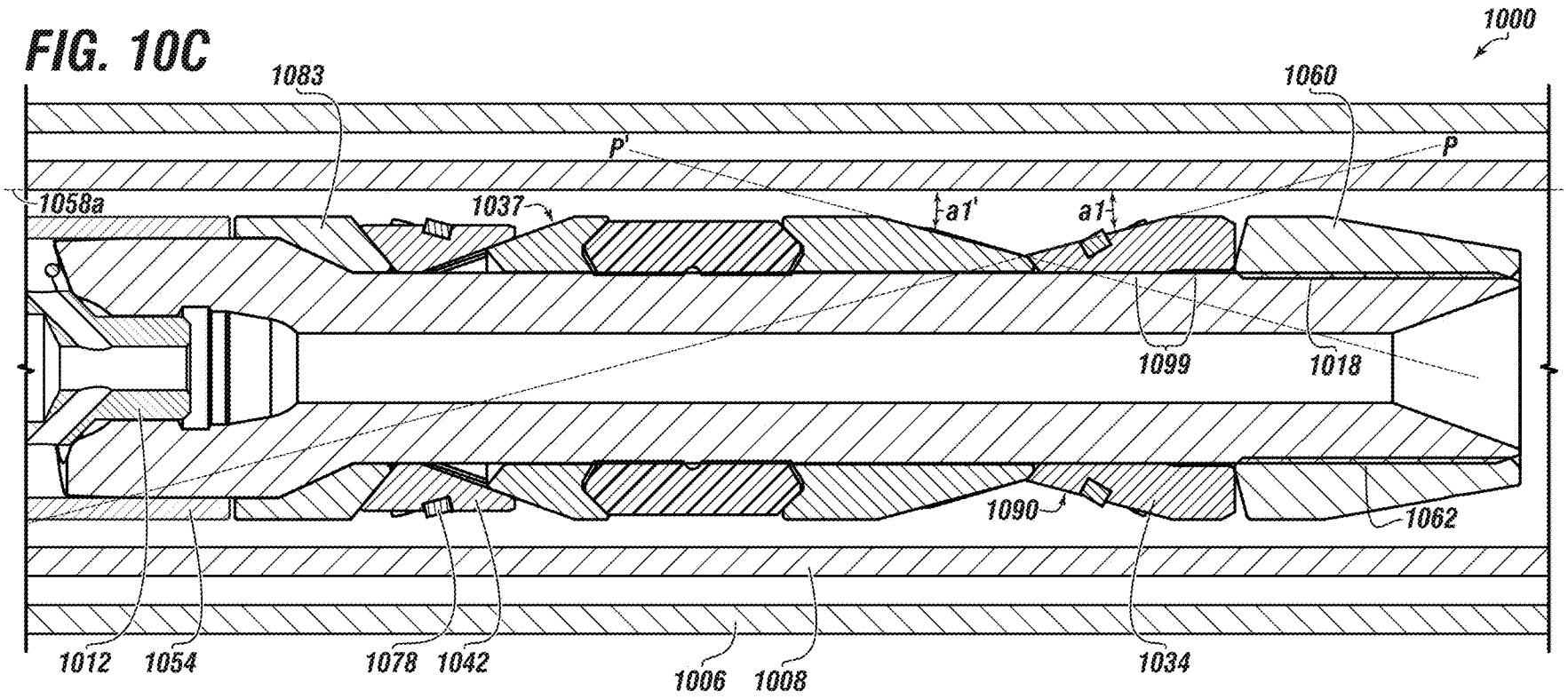
FIG. 10C shows a longitudinal cross-sectional view of an assembled downhole tool run into a wellbore according to embodiments of the disclosure.
Figure 10D:
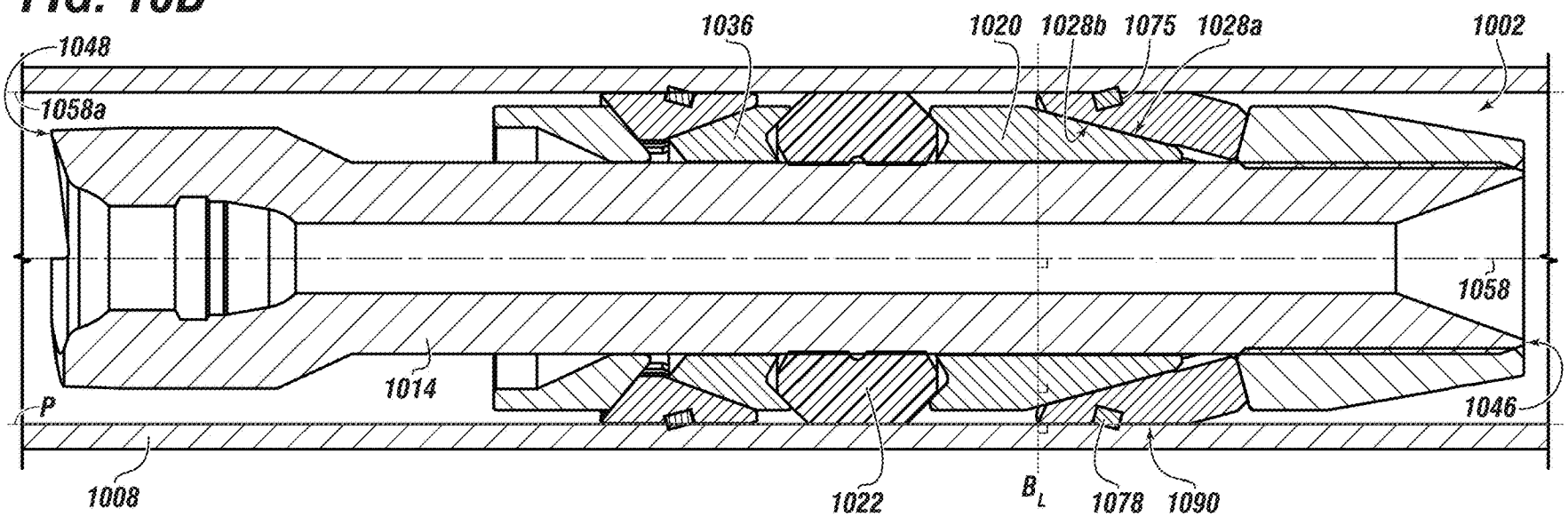
FIG. 10D shows a longitudinal cross-section view of the downhole tool of FIG. 10C moved to a set position in the wellbore according to embodiments of the disclosure.

Referring now to FIGS. 10C and 10D together, a longitudinal cross-sectional view of an assembled downhole tool run into a wellbore and a longitudinal cross-section view of the downhole tool of FIG. 10C moved to a set position in the wellbore, respectively, according to embodiments of the disclosure, are shown.

The downhole tool 1002 may be run into wellbore 1006 (such as within tubular 1008) to a desired depth or position by way of the workstring 1012 that may be configured with the setting device or mechanism, and thus part of an overall system 1000. The system may include the workstring 1012 and setting sleeve 1054, setting tool (with stud and adapter, etc.), utilized to run the downhole tool 1002 into the wellbore, and activate the tool 1002 to move from an unset to set position. System 1002 may be comparable or like that of other systems described herein, such as system 200. The set position may include seal element 1022 and/or slips 1034, 1042 engaged with the tubular 1008. In an embodiment, the setting sleeve (that may be configured as part of the setting mechanism or workstring) may be utilized to force or urge compression of the seal element 1022, as well as swelling of the seal element 1022 into sealing engagement with the surrounding tubular.

The setting device(s) and components of the downhole tool 1002 may be coupled with, and axially and/or longitudinally movable along mandrel 1014. When the setting sequence begins, the mandrel 1014 may be pulled into tension while the setting sleeve remains stationary. The lower sleeve 1060 may be pulled as well because of its attachment to the mandrel 1014 by virtue of the coupling of threads 1018 and threads 1062.

As the lower sleeve 1060 is pulled, the components disposed about mandrel 1014 between the lower sleeve 1060 and the setting sleeve 1054 may begin to compress against one another. This force and resultant movement may cause compression and expansion of seal element 1022. As the lower sleeve 1060 is pulled further in tension toward the setting sleeve 1054, the sleeve 1060 may compresses against the slip 1034. As a result, slip(s) 1034 may move along a tapered or angled surface of a cone member 1020 (or in embodiments, deformable member 220), and eventually radially outward into engagement with the surrounding tubular 1008 (and analogously with other or second cone 1036 and respective slip 1042).

The slips 1034, 1042 may be configured with varied gripping elements (e.g., buttons or inserts) that may aid or prevent the slips (or tool) from moving (e.g., axially or longitudinally) within the surrounding tubular, whereas otherwise the tool 1002 may inadvertently release or move from its position. Of distinction as compared to other slips, the slips 1034 and 1042 may be made of filament wound composite material. Non-wound composite slips, such as molded slips, would not have inner layers/layer interfaces, so one of skill would appreciate that not all composite materials are the same—each provides its own set of advantages, disadvantages, traits, physical properties, etc.

The inserts 1078 may have an edge or corner suitable to provide additional bite into the tubular surface. In an embodiment, the inserts 1078 may be mild steel, such as 1018 heat treated steel. The use of mild steel may result in reduced or eliminated casing damage from slip engagement and reduced drill string and equipment damage from abrasion. The inserts may be non-metallic, such as ceramic or comparable.

Typically, the upper slip 1042 may fracture first before the bottom slip 1034. Thus, tension or load may be applied to the tool 1002 that results in movement of cone 1036, which may be disposed around the mandrel 1014 in a manner with at least one surface 1037 angled (or sloped, tapered, etc.) inwardly of upper or second slip 1042. The second slip 1042 may reside adjacent or proximate to collar or cone 1036. As such, the seal element 1022 may force or urge the cone 1036 (and cone surface 1037) against the slip 1042, moving the slip 1042 radially outwardly into contact or gripping engagement with the tubular 1008. Similarly, the other cone 1020 (and cone surface 1028*a*) may move against the slip 1034 (and slip underside 1028*b*).

It has been discovered that a large coefficient of friction may exist between the cone surface 1028*a* and the slip underside 1028*b*. At the microscopic level, millions of fibers may undesirably interact with each other akin to the way Velcro hook-and-loop sticks, causing an undesired sticking between the surfaces, which may further result in failure of the tool 1002 to set. Although not shown here, one or more surfaces 1028*a* and/or 1028*b* may be surface coated to reduce the coefficient of friction therebetween. The surface coating may be sprayed, cooked, cured, etc. onto surface 1028 *a, b.*

The surface coating may be a ceramic, a sulfide, teflon, a carbon (e.g., graphite), etc. The surfaces 1028 *a, b* may be further lubricated, such as with a grease- or oil-based material.

Accordingly, the one or more slips 1034, 1042 may be urged radially outward and into engagement with the tubular 1008. As shown, the bottom or first slip 1034 may be at or near distal end 1046, and the second slip 1042 may be disposed around the mandrel 1014 at or near the proximate end 1048. It is within the scope of the disclosure that the position of the slips 1034 and 1042 may be interchanged. That is, in embodiments slips 1034 and 1042 may be used in each other's place. For example, slip 1042 may be the first or bottom slip, and slip 1134 may be the second or top slip. Moreover, slip 1034 may be interchanged with a slip comparable to slip 1042, and vice versa.

FIG. 10C illustrates (prior to setting) in longitudinal cross-section how an outer slip surface 1090 may be generally planar. Thus, the outer surface 1090 may have a plane P. The plane (and the outer surface 1090) may be offset from a long axis 1058 of the tool 1002 (or respective longitudinal axis or reference plane 1058*a* of the proximate surrounding tubular 1008) by an angle a1. That is, the plane P may bisect the long axis 1058 at the angle a1. Alternatively, or additionally the plane P may be bisect a reference plane 1058*a* of a tubular sidewall at the same angle a1.

One of skill may appreciate the tubular 1008 need not have an inner wall that is precisely axially linear through its entire length. However, in the proximity to where the downhole tool is set, and merely for reference frame purposes, the tubular 1008 may generally have the tubular sidewall that may effectively have the planar reference plane 1058*a* tantamount to parallel to axis 1058 in proximity to the tool 1002 (or slip 1034). In this respect to the angle a1 with reference to either bisect point (of axis 1058 or 1058*a*) would be equal by way of congruency.

In embodiments, the angle of a1 may be in an angle range of about 1 degree to about 20 degrees. In embodiments the angle range of a1 may be between about 10 degrees to about 20 degrees. The angle a1 may be about 10 degrees to about 15 degrees. FIG. 10D illustrates (post-setting) the plane P of outer slip planar surface 1090 (as shown in cross-section) may now be generally parallel to the long axis 1058. In this respect, the body of slip 1034 may have a pivot movement associated with it beyond that of generally radially outward. 'Parallel' is meant to include a tolerance of less than 1 degree. Parallel is further meant to include a bisect line BL being perpendicular (with reasonable tolerance) to that of the reference plane 1058, plane P (when slip is set), and axis 1058. In the set position, 'parallel' may be emblematic of most of surface 1090 being moved into proximate engagement the tubular 1008.

The angle of offset (e.g., with reference to plane P versus axis 1058 after setting) may be limited by various parameters, including lateral thickness of the slip, the mandrel OD, as well as tool OD. For example, a large offset angle may be desired, but this may require the OD of the slip to be larger than the OD of the tool, which renders the tool susceptible to presetting and other failure modes.

In an analogous manner the Figures illustrate in longitudinal cross-section how the outer cone surface 1028*a* may also be generally planar. Thus, the outer surface 1028*a* may have an associated plane P'. The plane P' (and the outer surface 1028*a*) may be offset from a long axis 1058 of the tool 1002 (or respective longitudinal axis or reference plane 1058*a* of the proximate surrounding tubular 1008) by an angle a1'. That is, the plane P' may bisect the long axis 1058 at the angle a1'. Alternatively, or additionally the plane P' may be bisect a reference plane 1058*a* of a tubular sidewall at the same angle a1'.

In embodiments, the angle of a1' may be in an angle range of about 1 degree to about 20 degrees. In embodiments the angle range of a1' may be between about 5 degrees to about 15 degrees. In other embodiments, the range of a1' may be between about 10 degrees to about 20 degrees.

Angles described herein may be negative to that of others as the tool 1002 is assembled, with one of skill understanding a positive or negative angle is not of consequence, and instead is only based on a reference point. 'Absolute' angle is meant refer to angles in the same magnitude of degree, and not necessarily of direction or orientation.

In embodiments, the angles a1 and a1' are substantially equal to each other in the assembled or run-in configuration. Thus, each of the angles a1 and a1' may be in the range of about 10 degrees to about 20 degrees with respect to a reference axis. At the same time a1 and a1' may be equal to each other (within a tolerance of less than 0.5 degrees).

One of skill would appreciate that upon setting, the angle of offset (a2, FIG. 12B) may also be equal to that of a1', whereas the angle a1 moves to zero.

The slip 1034 may have one or more inner surfaces with varying angles. The slip 1034 may have a slip transition region 1099 that may include a first inner slip surface having a first ID1, and a second inner slip surface having a second ID2. There may be a transition surface, which may be angled, including a right angle (thus akin to a shoulder).

Figure 12A:
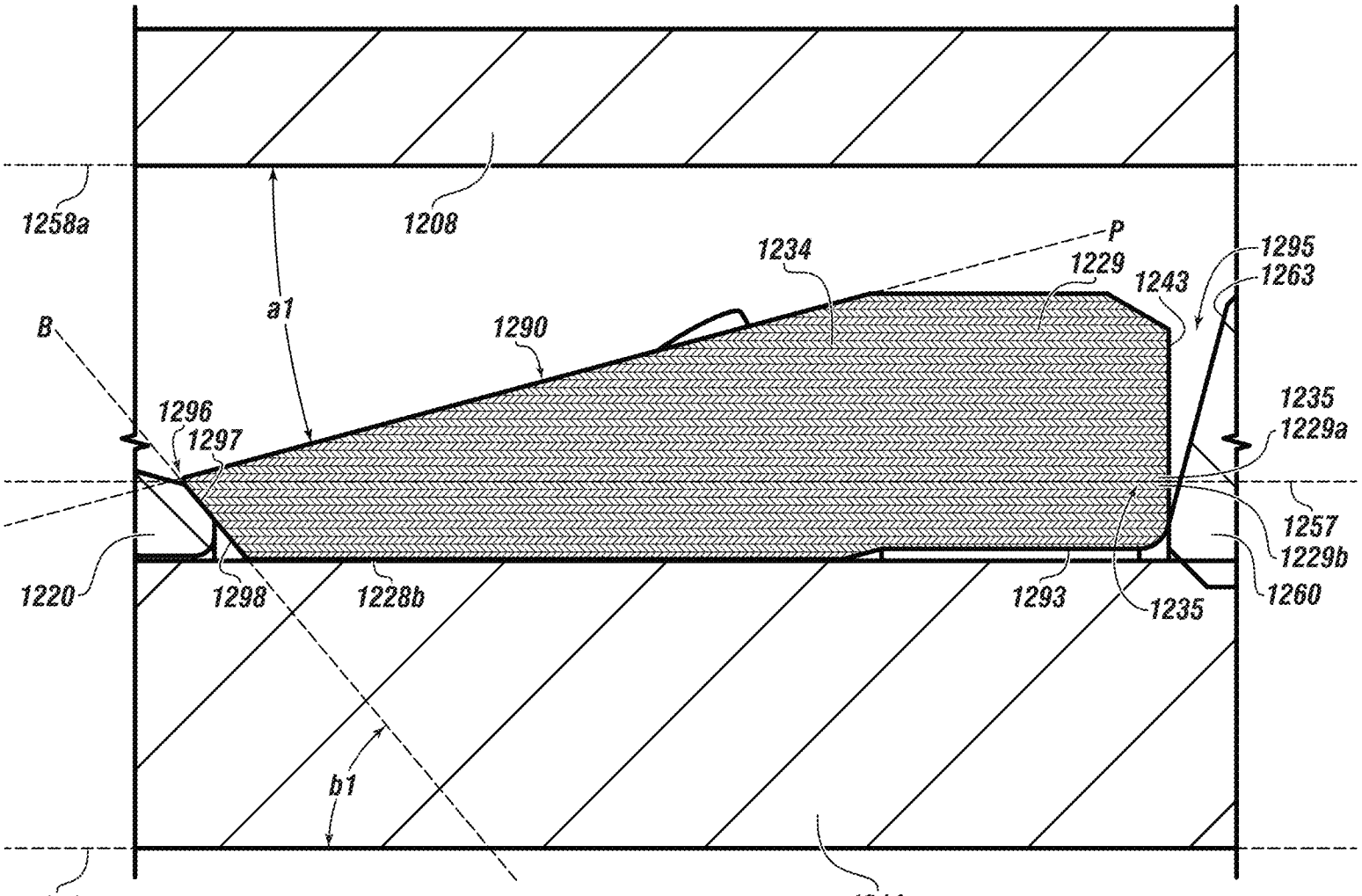
FIG. 12A shows a close-up longitudinal side cross-sectional view of a one-piece composite slip disposed around a mandrel in a run-in position according to embodiments of the disclosure.
Figure 12B:
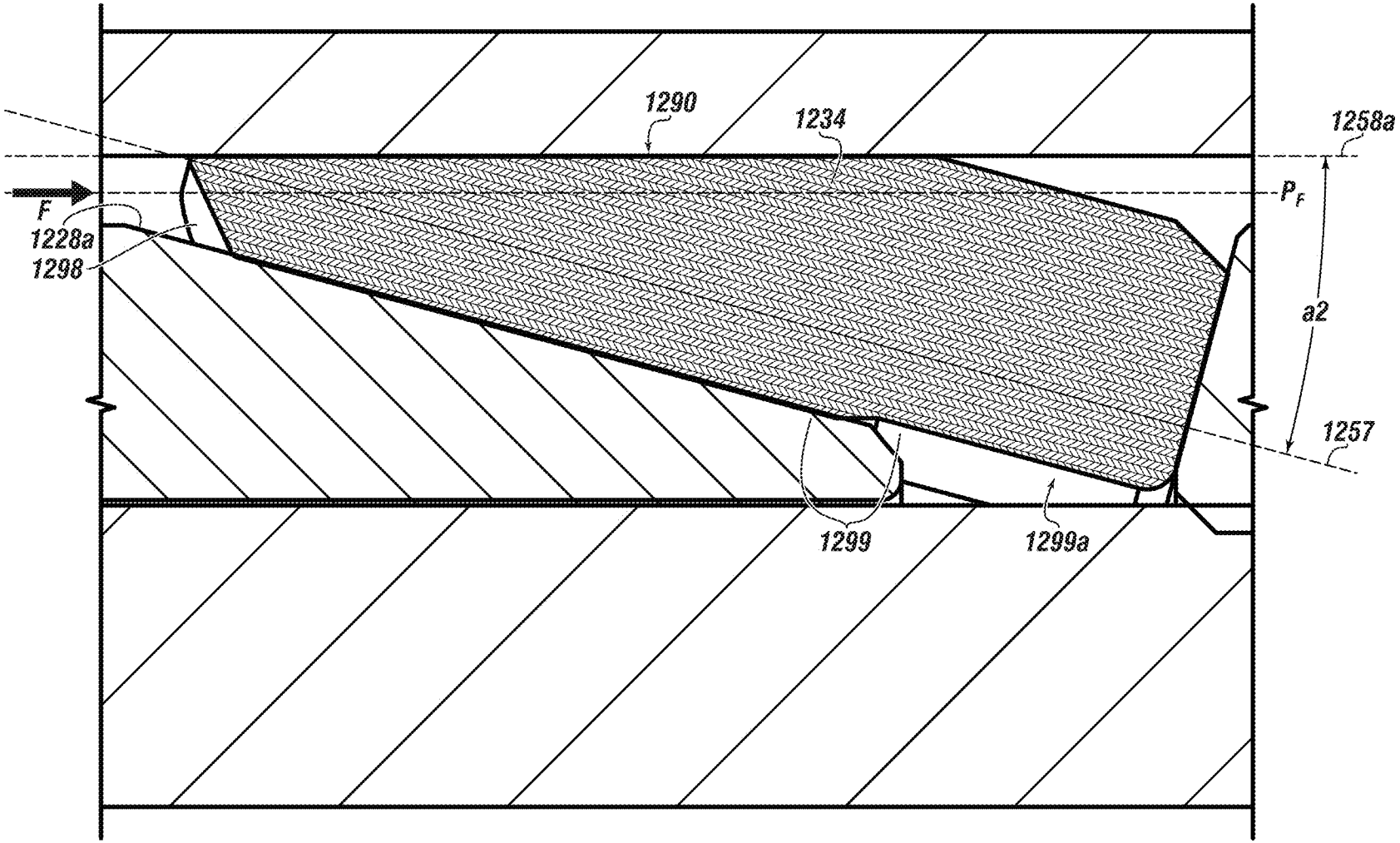
FIG. 12B shows a close-up longitudinal side cross-sectional view of the slip of FIG. 12A moved to a set position according to embodiments of the disclosure.
Figure 13C:
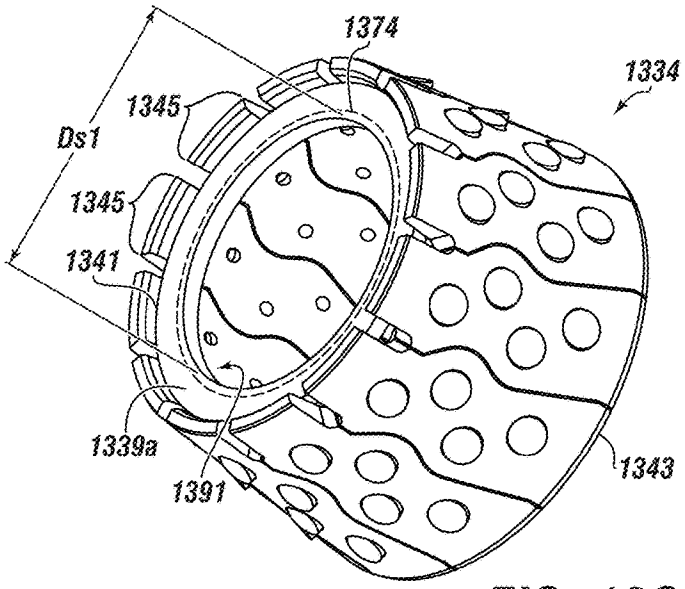
FIG. 13C shows a front-side isometric view of the slip of FIG. 13A according to embodiments of the disclosure.
Figure 13B:
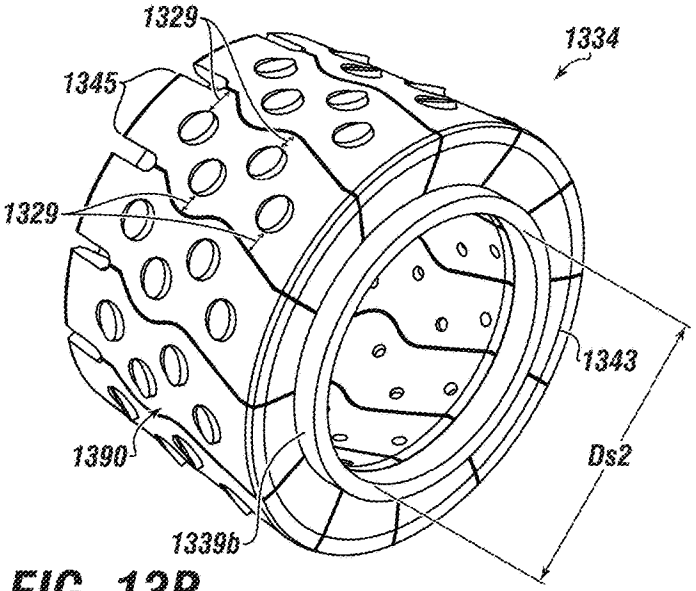
FIG. 13B shows a rear-side isometric view of the slip of FIG. 13A according to embodiments of the disclosure.
Figure 13A:
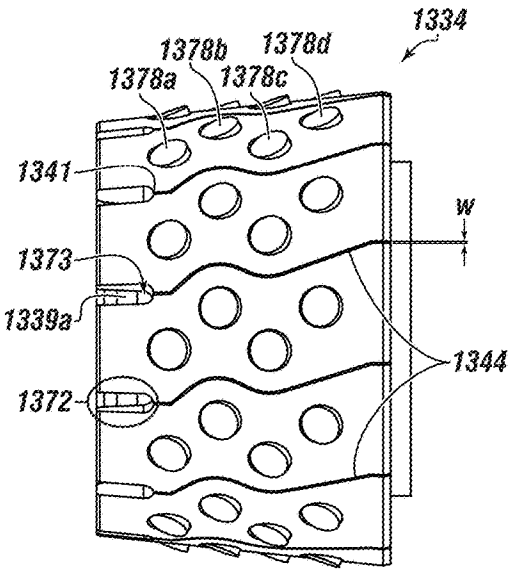
FIG. 13A shows a longitudinal side view of a one-piece composite slip configured with curved segment gaps according to embodiments of the disclosure.
Figure 14A:
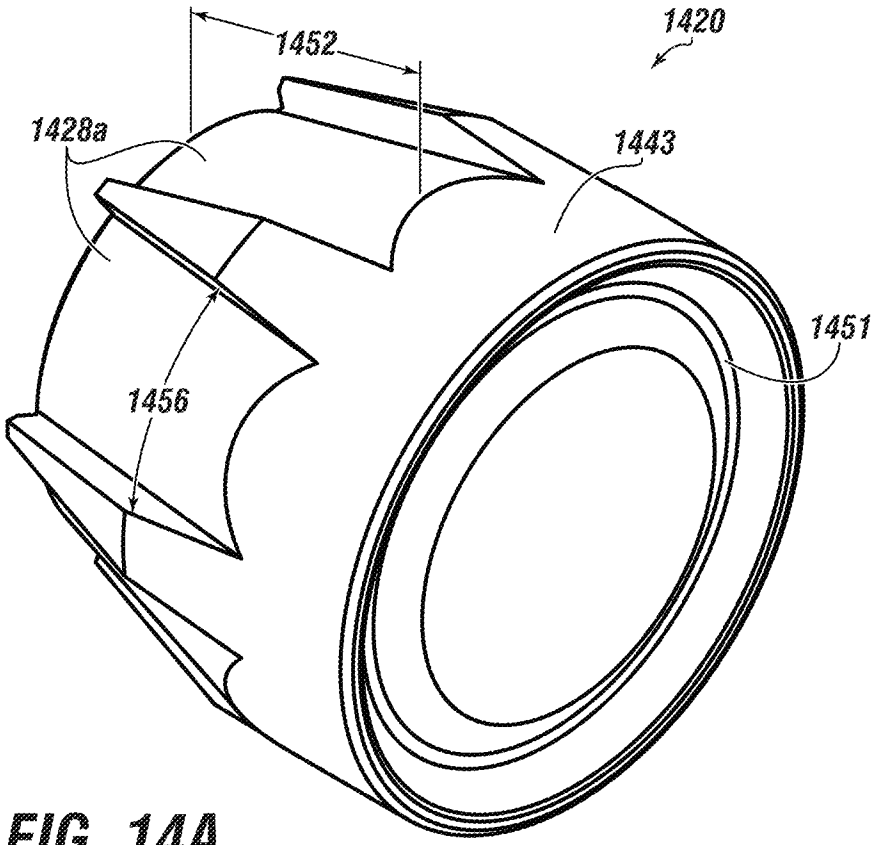
FIG. 14A shows a rear-side isometric view of a finned cone member according to embodiments of the disclosure.
Figure 13D:
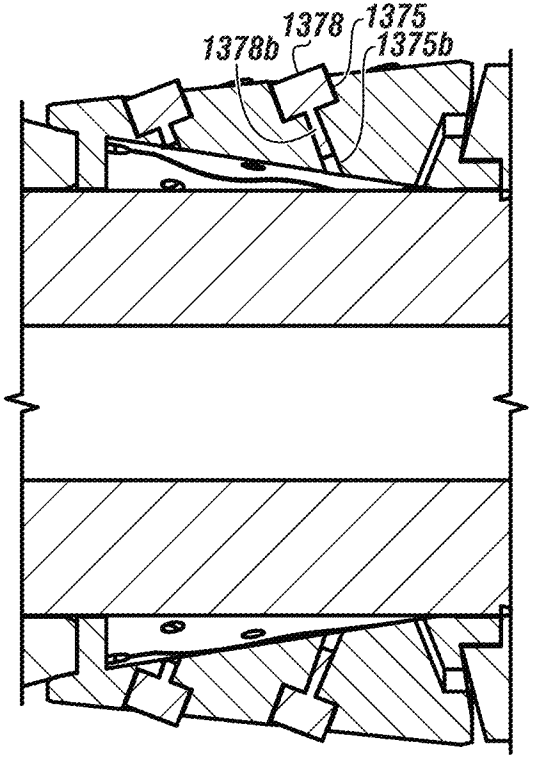
FIG. 13D shows a longitudinal side cross-sectional view of the slip of FIG. 13A according to embodiments of the disclosure.
Figure 14C:
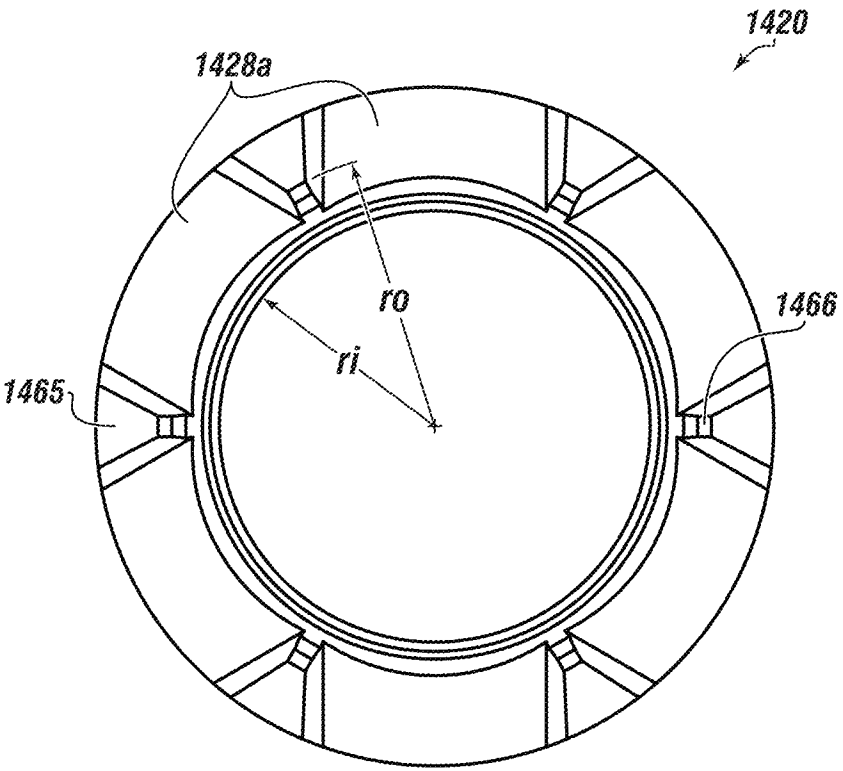
FIG. 14C shows a front thru-bore view of the cone of FIG. 14A according to embodiments of the disclosure.
Figure 14B:
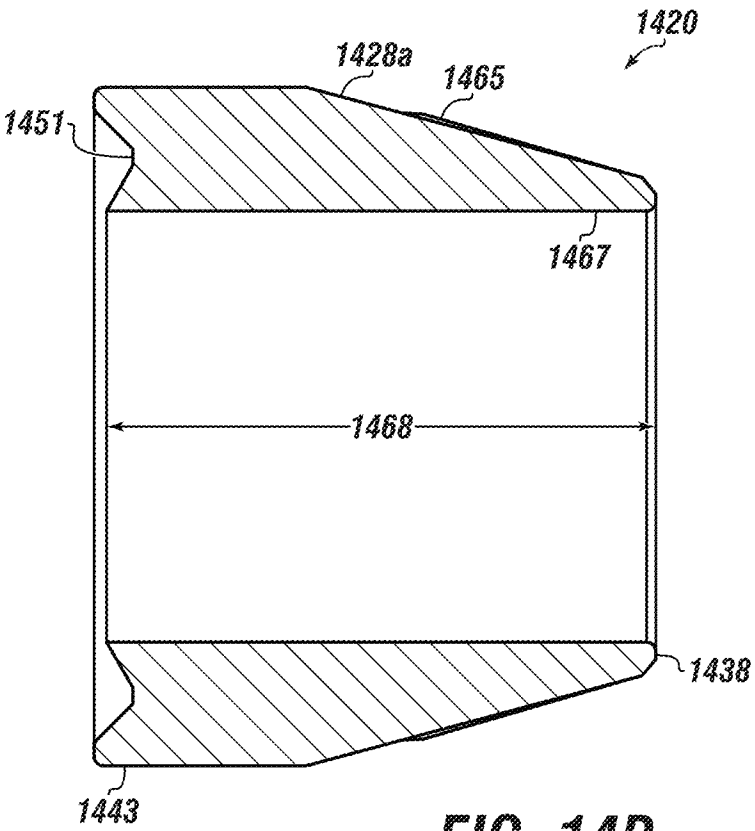
FIG. 14B shows a longitudinal side cross-sectional view of the cone of FIG. 14A according to embodiments of the disclosure.
Figure 14D:
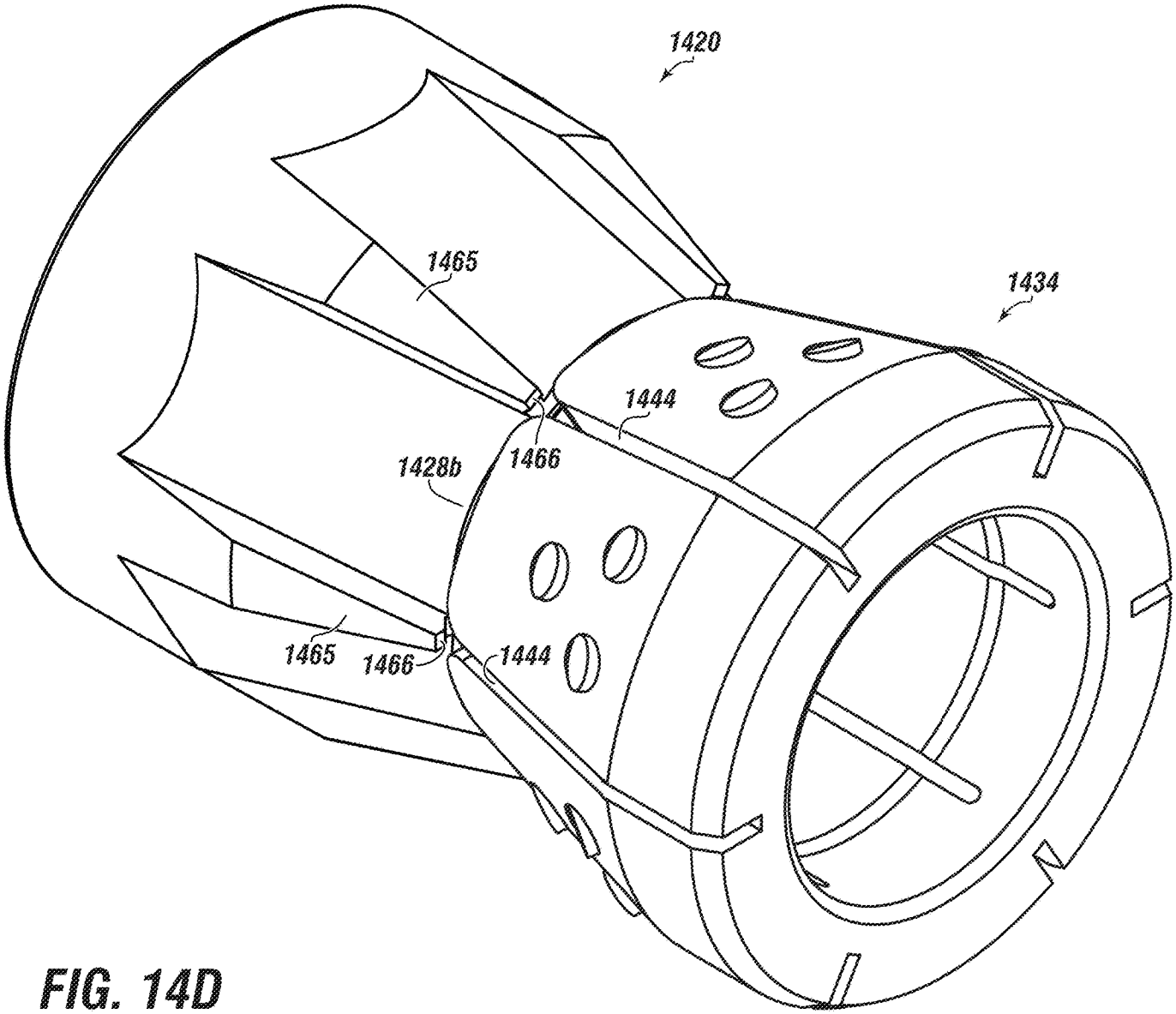
FIG. 14D shows a close-up isometric view of a cone engaged with a slip that are usable with a downhole tool in according to embodiments of the disclosure.
Figure 14E:
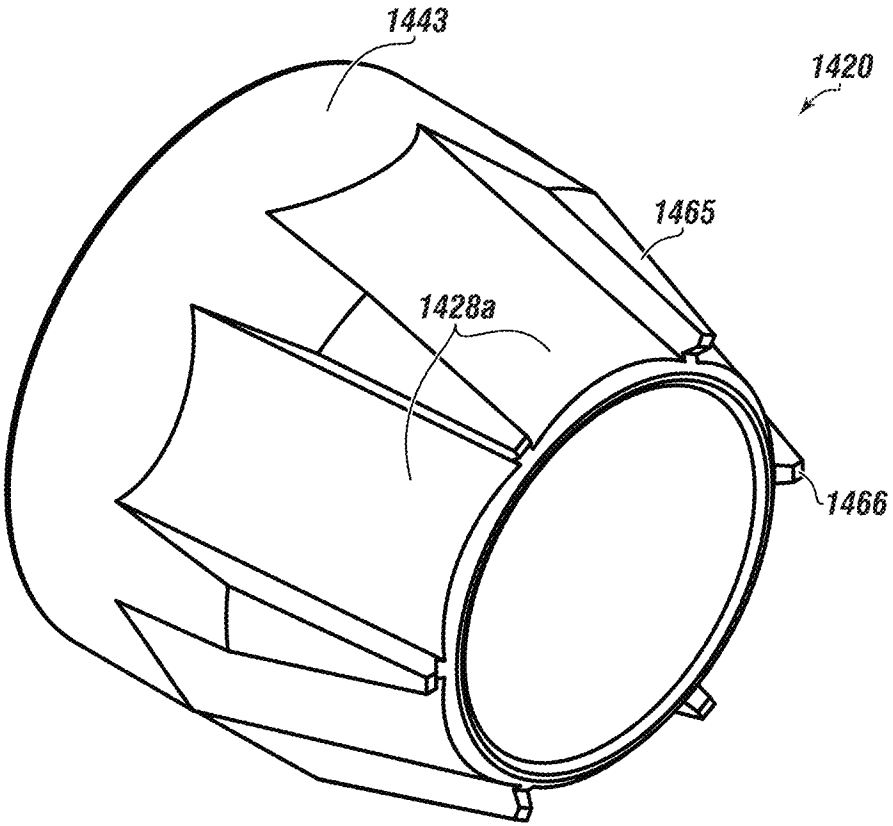
FIG. 14E shows a rear-side isometric view of the cone of FIG. 14A according to embodiments of the disclosure.

Referring briefly to FIGS. 12A and 12B, a close-up longitudinal side cross-sectional view of a one-piece composite slip disposed around a mandrel in a run-in position, and a close-up longitudinal side cross-sectional view of the slip of FIG. 12A moved to a set position, respectively, in accordance with embodiments disclosed herein, are shown.

Slip 1234 may be like that of slip 1034, and thus usable for downhole tool 1002, as well as other embodiments herein. As shown the slip 1234 may have a body made of a composite material, such as filament wound material, and thus formed from a winding process that results in layering. The slip (or slip body) 1234 may thus have a plurality of layers 1229 of material may be bound together, such as physically, chemically, and so forth to form an article, of which the slip 1234 may be machined therefrom. Adjacent layers, such as layers 1229 *a, b* may have a generally planar (resin) interface 1235, which may be further referenced by interface plane 1257. Once of skill would appreciate the interface 1235 on the microscopic level may include interaction of fibers from adjacent layers.

FIG. 12A in particular shows the run-in or preset configuration of the slip 1234 in contact with the cone 1220. Here the slip 1234 (or respective segments) may have a facet 1298 engaged with a cone end face 1297. The facet 1298 may be tapered or rounded end portion of the slip segments (e.g., 1133, FIG. 11A). The engagement between the facet 1298 and the cone end face 1297 may be at an angle (as shown here in cross-section).

The facet 1298 may be a rounded or curved surface. The facet 1298 may provide the ability to guide or key the contact point(s) 1296 between the slip 1234 and the cone 1220 in the assembled or run-in configuration. On the one hand it is desired for the facet 1298 to have some angle that may attribute to a higher point of inducing fracture, and thus provide a layer of protection against inadvertent presetting. On the other hand, too great of an angle (such as 90 degrees) makes the end of the slip 1234 akin to having a (right) shoulder that prevents or hinders setting. Oppositely, to low of an angle, and the slip 1234 may become susceptible to preset or other failure, even at lower forces.

In embodiments, a break angle b1 lying in a break plane parallel to the contact point surfaces 1296 (prior to setting) may be about 20 degrees to about 60 degrees with respect to a longitudinal axis (e.g., 1058). In embodiments the break angle b1 may be about 45 degrees to about 55 degrees.

The outer surface 1290 of the respective segments 1233 may have a predetermined radius of curvature to match that of the surrounding tubular inner diameter once the segments 1233 are extended into contact therewith. The inner surface of the slip 1234 may have an inner diameter sized for sliding engagement with the mandrel.

Also, in the assembled or run-in configuration may include a gap or clearance 1295 between the lower sleeve 1260 and a (lateral) slip end face 1243. There may also be a slip transition region 1299. The slip transition region 1299 may be tantamount to an area or region where the slip ID changes. Thus, the slip 1234 may have a first $ID_1$ and a second $ID_2$.

The presence of the differentiation in slip ID may provide a slip clearance 1293, which may be an annular clearance between the slip 1234 and the mandrel 1214. The slip clearance 1293 provides the slip 1234 with the ability to have an inflection (or hinge, pivot, etc.) (for fracture) point 1299*a* without hindering the setting force. Without the clearance 1293, the slip 1234 may not fracture or set properly.

The breaking strength of the slip 1234 (i.e., the amount of load required to 'bump' the facet 1298 out of contact with cone end surface 1297 may be predetermined. The breaking strength may be controlled by adjusting the angle of the contact point 1296, or the size of the inflection point 1299*a*, or both.

A difficulty in using a composite slip in the 'bottom' position is the ability to provide a predictable breaking point, especially as compared to a metal-material slip. However, while metal slips may provide predictability, they have the inherent detractions described herein.

Embodiments herein provide for the slip 1234 to have a break point in the range of about 2000 lbs to about 5000 lbs of axial setting force. Which is to say once the break point is reached, the slip 1234 may begin to set. It should be appreciated that the slip 1234 may beneficially be provided with the ability to withstand a brief inadvertent force, even if the force is higher than 2000. Thus, the facet 1298 in some instances may be urged out of contact—at least partially—with end surface 1297, but the resilience of the slip (or slip body) 1234 may bring the facet 1298 back into its original position.

Once a sufficient amount of force is incurred into the tool, the facet(s) 1298 may be urged radially outward, and out of contact with the cone 1220, whereby the underside of the slip (or respective slip segments) 1228*b* may now move into engagement with the cone outer surface (or respective cone face) 1228*a* (see FIG. 12B). The amount of force to move the facet 1298 out of contact with the cone end face 1297 may be in the range of about 2000 lbs to about 5000 lbs of axial setting force during the setting sequence. In embodiments the range may be about 3500 to about 4500.

When running in the well there may be countless events that could impart a force high enough to preset the slip 1234 (or 1034, etc.). The resiliency of the composite material allows the slip 1234 to deform slightly under short duration impact/load then return to its original shape/position. The process which may give the greatest risk of preset is pump-down. During pump-down the speed of the fluid in the well bore and the speed of the tool string/wireline must be maintained such that the differential pressure caused by fluid flowing past the tool does not induce enough force to deploy the lower slip 1234. If a lower slip on a tool deploys while the tool is moving chances are it will lock in place (pre-set) at an undesired depth. The cost of removing the plug may be $1M+. Pre-set typically happens when the wireline stops and the pumps do not. The initiation break force of the slip 1234 may be predetermined to be slightly higher than the weak point at the connection between the wireline and tool string such that the wireline will release before the slip 1234 sets.

Upon reaching the set position the slip face 1243 may move into proximate engagement with a tapered surface or face 1263 of the lower sleeve, thus closing gap 1295.

As shown in FIG. 12A, as the downhole tool with slip 1234 thereon is brought to rest at the position to which the tool will be set, the reference plane 1257 of the interface 1235 may be approximately parallel to the tool axis (e.g., 1058) or to a tubular plane 1258*a* (e.g., a2 equivalent to 0 or 180 degrees). Also prior to setting, an outer surface 1290 of the slip 1234 may be defined by residing in a reference surface plane P that is offset from tubular reference plane 1258*a* (also 1157, 1058). The angle a1 of offset may be at least one degree. The angle a1 may be in the range of about 1 to about 20 degrees. The angle a1 may be about 10 degrees to about 15 degrees.

As shown in FIG. 12B, upon setting, the outer surface 1290 may be substantially engaged with the surrounding tubular 1208, and thus reference planes P and 1258*a* may now be contemplated as being parallel to each other (e.g., a1 now equivalent to 0 degrees). It is noted that the vector F may be in either direction (e.g., uphole or downhole). Meanwhile angle a2 has now moved from 0 degrees to that of which a1 was in FIG. 12A. In this respect, a2 in FIG. 12B (post-setting) may be of offset may be at least one degree. The post-setting angle a2 may be in the range of about 1 to about 20 degrees. The angle a2 may be about 10 degrees to about 15 degrees.

Forces (including net or cumulative) may be represented a vector F that similarly lies in a plane $P_F$ parallel to reference planes P and 1258*a*. By congruency, these forces F may now also be offset from the resin interface layer 1235 by angle a2. By way of the motion of the slip 1234, pre-set angle a1 may be equal to post-set angle a2.

Returning again to FIGS. 10C-10D, during setting, because the sleeve 1054 may be held rigidly in place (such as via workstring 1012), the sleeve 1054 may engage against a bearing plate 1083 that may result in the transfer load through the rest of the tool 1002, as described herein, and the force interaction of the components of the tool 1002.

The tool 1002 may be configured with ball plug check valve assembly that includes a ball seat, as would be apparent to one of skill. The assembly may be removable or integrally formed therein. In an embodiment, the mandrel 1014 may be configured with the ball seat formed or removably disposed therein.

The tool 1002 may include an anti-rotation assembly that includes an anti-rotation device or mechanism like that described herein.

Drill-through of the tool 1002 may be facilitated by the fact that the mandrel 1014, the slips 1034, 1042, the cone(s) etc. may be made of drillable material that is less damaging to a drill bit than those found in conventional plugs. Lower or bottommost slip 1034 may be made of composite material and may be configured to provide the downhole tool 1002 with the characteristic of being able to withstand or hold at 10,000 psi or more.

Referring now to FIGS. 11A, 11B, 11C, and 11D together, a front-side thru-bore view, a rear-side isometrice view, a front-side isometric view, and a longitudinal side cross-sectional view, of a one-piece composite slip (and related subcomponents), respectively, usable with a downhole tool in accordance with embodiments disclosed herein, are shown.

Slip 1134 may be like that of slip 1034, and thus usable for a downhole tool in accordance with embodiments herein. As shown the slip 1134 may have a body made of a composite material. While other materials may be possible (such as a metal, metal alloys, reactive material, etc.), in embodiments the slip 1134 may be made of or from a composite material, such as filament wound composite.

The slip 1134 may include a plurality of slip segments 1133. While not limited, the number of slip segments 1133 may be about 3 to about 9 segments. In contrast to conventional segmented slips, the slip 1134 may be or have a one-piece configuration. The one-piece configuration may be that which has at least partial material connectivity around the body of the slip 1134. For example, material connectivity line 1174 illustrates such a configuration. Material connectivity around the slip body means just that—the presence of material therearound. Without such a configuration, it would be necessary for some other mechanism to hold pieces/segments of the slip together.

One segment 1133 may be separated from another by way of a longitudinal groove 1144 (longitudinal in the sense of being referenced from one end 1141 of the slip to the other end). The groove 1144 may indeed extend from the end 1141 to the other end 1143 but need not. As such, there may be an amount of slip material or region 1171 sufficient for rigidly holding the slip 1134 together, as well as being durable enough (in combination with other regions).

The groove 1144 may also reflect a lateral opening through the slip body 1134. That is, the groove 1144 may have a depth 1173 that extends from an outer surface 1190 to an inner surface 1191. Depth 1173 may define a lateral distance or length of how far material is removed from the slip body with reference to slip surface 1190 (or also inner slip surface 1191). One of skill would appreciate the dimension(s) of the groove 1144 at a given point may vary along the slip body.

Figure 11C:
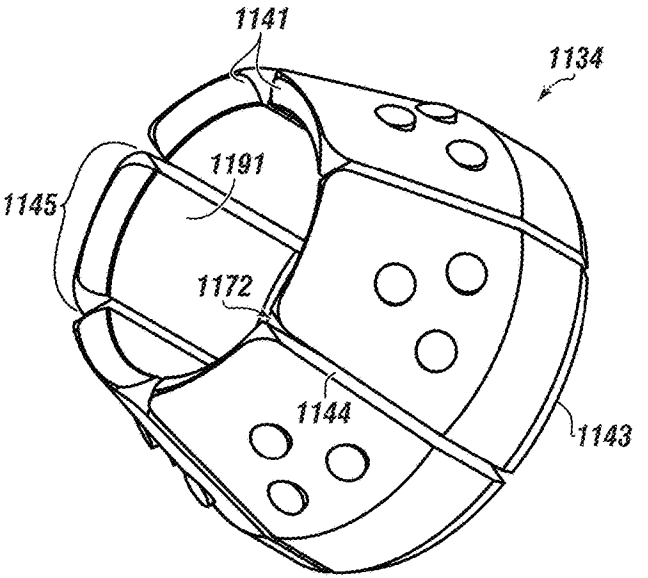
FIG. 11C shows a front-side isometric view of the one-piece composite slip of FIG. 11A according to embodiments of the disclosure.
Figure 11B:
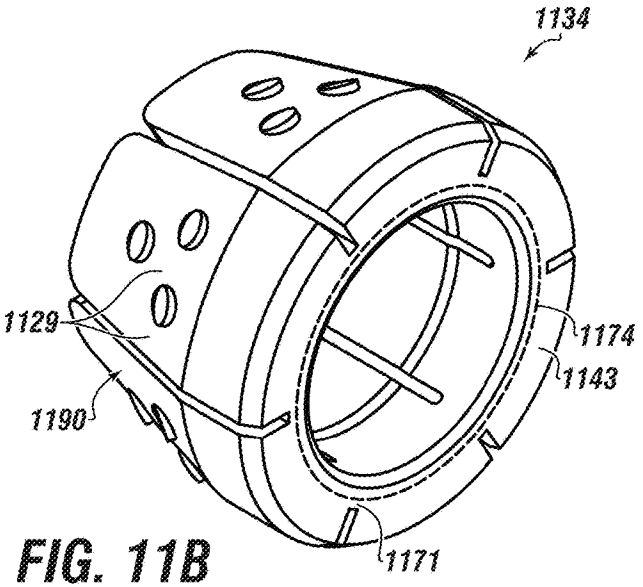
FIG. 11B shows a rear-side isometric view of the one-piece composite slip of FIG. 11A according to embodiments of the disclosure.
Figure 11A:
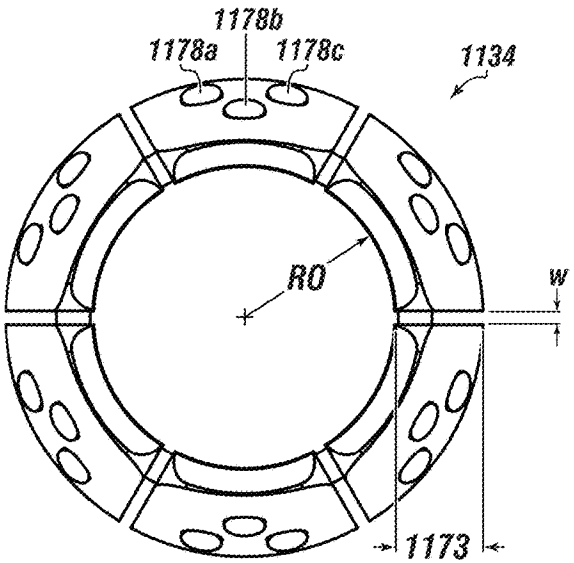
FIG. 11A shows a front-side thru-bore view of a one-piece composite slip according to embodiments of the disclosure.

FIGS. 11B and 11C illustrate how the groove 1144 may extend all the way through the slip end 1141, as well as from outer surface 1190 to inner surface 1191, and may thus be devoid of material at point 1172. However, the groove 1144 may not extend all the way laterally through the body at the other end 1143.

Where the slip 1134 is devoid of material at its end 1141 (or segment ends 1145), that portion or proximate area of the slip may have the tendency to flare first during the setting process. The arrangement or position of the grooves 1144 of the slip 1134 may be designed as desired. In an embodiment, the slip 1134 may be designed with grooves 1144 that facilitate an equal distribution of radial load along the slip 1134.

Figure 11E:
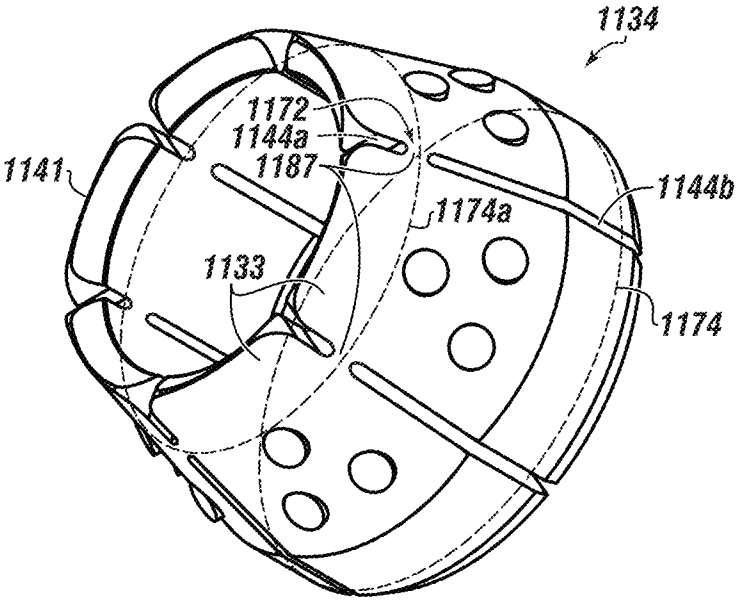
FIG. 11E shows a front-side isometric view of a webbed one-piece composite slip according to embodiments of the disclosure.
Figure 11D:
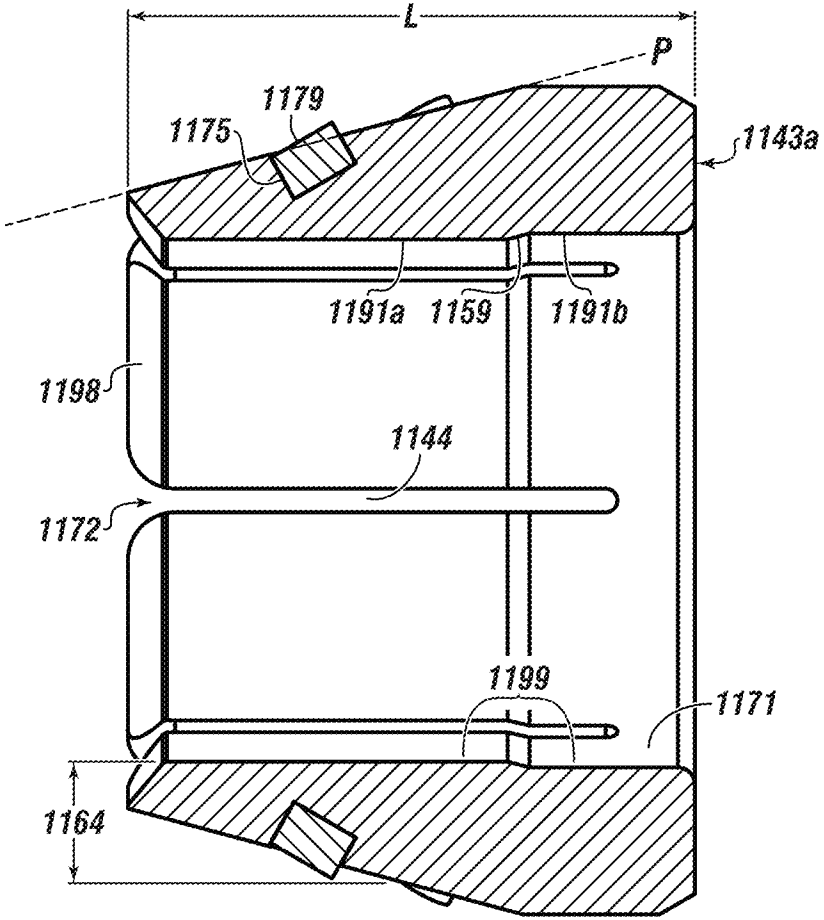
FIG. 11D shows a longitudinal side cross-sectional view of the one-piece composite slip of FIG. 11A according to embodiments of the disclosure.

Referring briefly to FIG. 11E, a variant of slip 1134 is shown. FIG. 11E illustrates the slip 1134 may have a one-piece configuration, such as illustrated by material connectivity line 1174. However, in addition to one or more grooves that extend longitudinally all the way through the slip end 1141, there may be one or more grooves, such as groove 1144*b*, that may extend proximate or substantially close to the slip end 1141 but leaving a small amount material or webbing 1187 therein at material point 1172. The presence of the small amount of material webbing 1187 gives slight rigidity to hold off the tendency to flare. As such, part of the slip 1134 may expand or flare first before other parts of the slip 1134. The webbing 1187 may also aid against preset.

The use of the webbing 1187 between other segments 1133 may provide another region of one-piece connectivity for the slip, as illustrated by second connectivity line 1174*a*.

Returning again to FIGS. 11A-11D, the slip 1134 may have one or more inner surfaces with varying angles. The slip 1134 may have a slip transition region 1199 that may include a first inner slip surface 1191*a* having a first ID1, and a second inner slip surface 1191*b* having a second ID2. There may be a transition surface 1159, which may be angled, including a right angle (thus akin to a shoulder).

Slip 1134 may be used in either upper or lower slip position, or both, without limitation of a downhole tool suitable for using slips. Slip 1134 may be configured with various structure and function described herein for successful use with downhole tools, including for being the lower slip, and holding the downhole tool in place even at pressures in excess of 10,000 (even 15,000) psi.

The slip 1134 may include or be configured with the ability to grip the inner wall of a tubular, casing, and/or well bore, such as the buttons or inserts 1178. As shown there may be a pattern associated with the use of inserts 1178 *a-c*. There may be a triangular pattern of inserts 1178 *a-c*. In embodiments, the inserts 1178 may be equidistantly spaced apart.

The inserts 1178 may be arranged or configured whereby the slip 1134 may engage the tubular (not shown) in such a manner that movement (e.g., longitudinally axially) of the slips or the tool once set is prevented. In an embodiment, the inserts 1178 may be epoxied or press fit into corresponding insert bores (or grooves, recesses, etc.) 1175 formed in the slip 1134.

The more buttons 1178, the greater biting and holding ability of the slip 1134. The number of inserts for any respective segment 1133 may provide the ability to have more buttons with more radial material 1129 therearound.

Radial material 1129 is meant to include not just the surrounding material in a radial direction, but also in depth (hence, more akin to a volume of material proximately surrounding the respective button).

The greater amount of material 1129 around and supporting the respective button 1178, the greater the ability for the slip 1134 to hold higher pressure. That is, with less surrounding material, the button 1178 may be prone to slipping or breaking out of insert bore 1175, or outright fail on its own. Thus, tensile and/or compressive strength of the segment 1133 may be adequately maintained, and the slip 1134 provided the ability to resist failure.

The bore 1175 may be further associated with a bore socket (not shown here), which may provide the benefit of, whereby, if glue or other adhesive material is used, it may be squeezed out of the bore 1175 as the insert button 1178 is pressed into the respective bore/socket. The socket may exit the inner bore surface 1191.

In some embodiments, the slip insert depth and/or the respective bore depth may vary. As a thickness 1164 (from outer surface 1190 to inner surface 1191) of slip segments 1133 may vary long a longitudinal length L of the slip 1134, it may be beneficial to have a larger bore depth where more thickness is available.

In other aspects, the button 1178 may be stackable (not viewable here) and thus be a combination of stacked or connected buttons. The button 1178 may be machined and fabricated with an integral tail portion accordingly (also not viewable here). The tail may be progressively different in length to accommodate the change in lateral thickness 1164 of the slip 1134 along length L.

One of skill would appreciate that although a linear cut may be possible, and perhaps in some instances desirable, there may be less radial material around one or more buttons and/or it may be necessary to use fewer buttons, either of which may effect the pressure rating (hold ability) of the slip 1134.

Ultimately a higher degree of angle (e.g., a1 of FIG. 12A) of surface 1190 may be preferred to further the benefit against failure between slip layers; however, a high angle a1 may be limited by other performance factors. For example, it may be prudent to have as much slip body material as possible, whereas trimming more material away to provide a bigger a1 may render the slip without sufficient material for holding pressure. Moreover, it may be prudent to ensure a widest portion the slip (see FIG. 10C) is no greater than a widest outer tool diameter (or tool OD), as any portion of the slip that may stick out may be prone to catching on debris (or other items) that may be in the tubular.

The lower end of material thickness of the slip 1134 may be predicated by the fact that it has to have an inner slip ID suitable for fitting around a mandrel (1114). Thus, it has been discovered that an ability for the outer surface 1190 to accommodate a reference angle (a1) to be in the range of about 1 degree to 20 degrees. The angle a1 may be in the range of about 10 degrees to about 20 degrees, which may be optimal when accounting for other parameters.

The slip 1134 may be disposed around or coupled to a mandrel (e.g., 214, 1114) as would be known to one of skill in the art, including to maintain the position of the slip 1134 until sufficient pressure (e.g., setting) is applied. Although the slip 1134 may be composed of individual body segments 1133 held together (such as by a band or slip ring), a one-piece configuration provides a number of benefits and advantages. For example, alleviating the need for an outer band/ring alleviates a primary point of failure attributable to inadvertent pre-setting.

The one-piece configuration means the slip 1134 may have at least a portion thereof that has at least partial connectivity across or around its entire circumference (see connectivity line 1174). Meaning, while the slip 1134 itself may have one or more grooves 1144 configured therein, at least a portion of the slip 1134 has no separation point in the pre-set configuration. In an embodiment, the grooves 1144 may be equidistantly spaced or cut in the slip 1134. The groove(s) 1144 may be formed from any suitable type of machining or milling, including CNC, as well as other processes that might promote narrower groove.

Referring now to FIGS. 13A, 13B, 13C, and 13D together, a longitudinal side view, a rear-side isometric view, a front-side isometric view, and a longitudinal side cross-sectional view, of a one-piece composite slip (and related subcomponents) configured with curved segment gaps, respectively, usable with a downhole tool in accordance with embodiments disclosed herein, are shown.

Slip 1334 may be like that of slip 1034, and thus usable for downhole tool 1002, as well as other embodiments herein. While other materials may be possible (such as a metal, metal alloys, reactive material, etc.), in embodiments the slip 1334 may be made of or from a composite material, such as filament wound composite. As the slip 1334 may have a body made of a filament wound material, and the slip 1334 may be formed from a winding process that results in layering. The slip (or slip body) 1334 may thus have a plurality of layers (not shown here) of material may be bound together, such as physically, chemically, and so forth to form an article, of which the slip 1334 may be machined therefrom.

The slip 1334 may include a plurality of slip segments 1333 and may be or have a one-piece configuration according to embodiments herein (see material connectivity line 1374). One segment 1333 may be separated from another by way of a longitudinal groove 1344 (longitudinal in the sense of being referenced from one end 1341 of the slip to the other end). The groove 1344 may indeed extend from the end 1341 to the other end 1343 but need not. There may be an amount of slip material or region 1339*a* and/or 1339*b* sufficient for rigidly holding the slip 1334 together, as well as being durable enough (in combination with other regions).

The groove 1344 may also reflect a lateral opening through the slip body 1334 as described herein. That is, the groove 1344 may have a depth that extends from an outer surface 1390 to an inner surface 1391. One of skill would appreciate the dimension(s) of the groove 1344 at a given point may vary along the slip body. The groove 1344 may extend all the way through the slip end 1341, as well as from outer surface 1390 to inner surface 1391, and may thus be devoid of material at point 1132.

The slip 1334 may include or be configured with the ability to grip the inner wall of a tubular, casing, and/or well bore, such as the buttons or inserts 1334. As shown there may be a pattern associated with the use of inserts 1334 *a-d*. There may be a triangular pattern of inserts. The pattern may be alternating back-n-forth along the respective segment 1333. In embodiments, the inserts 1378 may be equidistantly spaced apart.

The inserts 1378 may be arranged or configured whereby the slip 1334 may engage the tubular (not shown) in such a manner that movement (e.g., longitudinally axially) of the slips or the tool once set is prevented. In an embodiment, the inserts 1378 may be epoxied or press fit into corresponding insert bores (or grooves, recesses, etc.) 1375 formed in the slip 1334.

The more buttons 1378, the greater biting and holding ability of the slip 1334. The number of inserts for any respective segment 1333 may provide the ability to have more buttons with more radial material 1329 therearound. Although not meant to be limited, a curvilinear cut pattern may provide the ability to have more buttons with more radial material 1129 therearound. A curvilinear cut may include one or more arcuate or rounded segments in conjunction with one or more linear (or substantially linear) segments.

Radial material 1329 is meant to include not just the surrounding material in a radial direction, but also in depth (hence, more akin to a volume of material proximately surrounding the respective button).

The greater amount of material 1329 around and supporting the respective button 1378, the greater the ability for the slip 1334 to hold higher pressure. That is, with less surrounding material, the button 1378 may be prone to slipping or breaking out of insert bore 1375, or outright fail on its own.

The bore 1375 may be further associated with a bore socket 1375*b*, which may provide the benefit of, whereby, if glue or other adhesive material is used, it may be squeezed out of the bore 1375 as the insert button 1378 is pressed into the respective bore/socket. The socket may exit the inner bore surface 1391.

The bore 1375 may be further associated with a bore socket (e.g., 1375*b*, etc.). The socket 1375*b* may be narrower in width than the bore, but of greater length or depth. Although not meant to be limited, any respective socket may extend from the central bottom of the bore 1375 and all the way through the body of the slip 1334, and thus resulting in an inner opening in the inner surface 1391. This may provide the benefit of, whereby, if glue or other adhesive material is used, it may be squeezed out of the opening as the insert button 1378 is pressed into the respective bore/socket.

Although not meant to be limited in size or shape, the bore socket may be generally cylindrical. Thus, a respective button tail 1378*b* may fit snugly therein. The use of a button tail (e.g., 1378*b*, etc.) may provide additional material that may aid or help the respective button stay within the bore 1375.

The button 1378 may be machined and fabricated with an integral tail portion accordingly. Tails may be progressively different in length to accommodate the change in lateral thickness of the slip 1334.

One of skill would appreciate that although a linear cut may be possible, and perhaps in some instances desirable, there may be less radial material around one or more buttons and/or it may be necessary to use fewer buttons, either of which may effect the pressure rating (hold ability) of the slip 1334.

As shown one or more grooves 1344 may extend all the way through the slip end 1341, such that slip end 1341 is devoid of material at point (or region) 1372. Here, material is removed in the shape tantamount to a 'u' cut by standard machining or milling; however, the shape or amount of material removed at point 1372 is not meant to be limited.

The removal of material at point 1372 may alleviate concern about jetting or cutting through first inner shear ring 1339*a*. That is, in the event the slip 1342 has one or more grooves 1344 made by the aforementioned water jet, a starting point may be needed. In this case, the water jet may be precisely controlled to start at point 1373, shown here as just below ring 1339*a* and just above end 1341, relatively speaking. The cut of the groove 1341 may continue through the slip body until reaching a second shear ring 1339*b*.

The shear ring 1339*a* may be integral to the slip 1334 and formed by standard machining during processing of the slip. Generally, the shear ring 1339*a* may be annular in nature and configured for tolerance fit around the mandrel. The shear ring 1339*a* may be configured for being in proximate engagement with an end (or end portion) of a respective cone end (not shown here). In an assembled tool configuration, the slip 1334 may be prevented from setting unless and until the shear ring 1339*a* is sheared from the slip 1334.

As mentioned, there may be a second shear ring 1339*b*, which may be located on the other end 1343 of the slip 1334. The second shear ring 1339*b* may similarly be integral to the slip 1334 and formed by standard machining during processing of the slip. Generally, the shear ring 1339*b* may be annular in nature and configured for tolerance fit around the mandrel. The shear ring 1339*b* may be configured for being in proximate engagement with an end (or end portion) of a lower sleeve. The slip 1334 may be prevented from setting unless and until the shear ring 1339*b* is sheared from the slip 1334. In embodiments, the slip 1334 may be prevented from completely setting unless and until both the shear ring 1339*a* and the second shear ring 1339*b* are sheared from the body of the slip 1334.

The arrangement or position of the grooves 1344 of the slip 1334 may be designed as desired. In an embodiment, the slip 1334 may be designed with grooves 1344 resulting in equal distribution of radial load along the slip 1334, and generally equal size segments 1345.

One of skill would appreciate that although a linear cut may be possible, and perhaps in some instances desirable, there may be less radial material around one or more buttons and/or it may be necessary to use fewer buttons, either of which may effect the pressure rating (hold ability) of the slip 1334. To compensate, a longer slip may be used—but this has the possible detriment of making the overall length of the tool longer and/or having more material to drill through.

Although the groove(s) 1344 may be formed from any suitable type of machining or milling, including CNC, it may be advantageous to use a process that reduces the size of the groove 1344, and hence leaves more cumulative material with the body of the slip. In the embodiment illustrated here there are 12 grooves in the body of the slip 1344. If each groove 1344 is provided with an additional 1/12" of material, that results in a cumulative addition of 1" of material in the slip body.

It has been discovered that cutting the groove with a high-pressure water jet may provide a groove width w in the range of about (0.1 to 5)/10,000th of an inch. The width w may be in the range of 0.001 inches to about 0.1 inches. In embodiments the width may be in the range of about 0.005 inches to about 0.06 inches. The use of the water jet at such a pressure for a composite material slip for all practical purposes means the groove 1344 depth 1394 will go through the entirety of the slip body (from outer surface 1390 to inner surface 1391). The water jet may be programmable, and further associated with a rotating head for movable and controllable cutting action.

As shown one or more grooves 1344 may extend all the way through the slip end 1341, such that slip end 1341 is devoid of material at point (or region) 1372. Here, material is removed in the shape tantamount to a 'u' cut by standard machining or milling; however, the shape or amount of material removed at point 1372 is not mean to be limited.

The removal of material at point 1372 alleviates concern about jetting or cutting through first inner shear ring 1339*a*. That is, in the event the slip 1342 has one or more grooves 1344 made by the aforementioned water jet, a starting point may be needed. In this case, the water jet may be precisely controlled to start at point 1373, shown here as just below ring 1339*a* and just above end 1341, relatively speaking. The cut of the groove 1344 may continue through the slip body until reaching a second shear ring 1339*b*.

The shear ring 1339*a* may be integral to the slip 1334 and formed by standard machining during processing of the slip. Generally, the shear ring 1339*a* may be annular in nature and configured for tolerance fit around the mandrel. The shear ring 1339*a* may be configured for being in proximate engagement with an end (or end portion) of a respective cone). The slip 1334 may be prevented from setting unless and until the shear ring 1339*a* is sheared from the slip 1334.

There may be a second shear ring 1339*b*, which may be located on the other end 1343 of the slip 1334. The second shear ring 1339*b* may similarly be integral to the slip 1334 and formed by standard machining during processing of the slip. Generally, the shear ring 1339*b* may be annular in nature and configured for tolerance fit around the mandrel. The shear ring 1339*b* may be configured for being in proximate engagement with an end (or end portion) of a lower sleeve. The slip 1334 may be prevented from setting unless and until the shear ring 1339*b* is sheared from the slip 1334. In embodiments, the slip 1334 may be prevented from completely setting unless and until both the shear ring 1339*a* and the second shear ring 1339*b* are sheared from the body of the slip 1334.

Referring now to FIGS. 14A, 14B, 14C, 14D, and 14E together, a rear-side isometric view, a longitudinal side cross-sectional view, a front thru-bore view, a front-side isometric view, respectively, of a cone usable with a downhole tool in accordance with embodiments disclosed herein, are shown.

Cone 1420 may be like that of cone 1020, and thus usable for a downhole tool in accordance with embodiments herein. While other materials may be possible (such as a metal, metal alloys, reactive material, etc.), in embodiments the cone 1420 may be made of or from a composite material, such as filament wound composite.

In an embodiment, cone 1420 may be slidingly engaged and disposed around a mandrel (e.g., 1014 in FIG. 10C). Cone 1420 may be disposed around the mandrel in a manner with at least one surface 1428*a* angled (or sloped, tapered, etc.) with respect to other proximate components, such as the lower slip (1034). As such, the cone 1420 with surface 1428*a* may be configured to cooperate with the slip to force the slip radially outwardly into contact or gripping engagement with a tubular, as would be apparent and understood by one of skill in the art.

During setting, and as tension increases through the tool, an end of the cone 1420, such as second end 1440, may compress against the slip (see FIG. 10D). As a result of conical surface 1428*a*, the cone 1420 may move to the underside beneath the slip (e.g., slip surface 1028*b*, forcing the slip outward and into engagement with the surrounding tubular. A second end 1440 of the cone 1420 may be configured with a cone profile 1451. The cone profile 1451 may be configured to mate with a seal element (222, 1022, etc.). In an embodiment, the cone profile 1451 may be configured to mate with a corresponding profile of the seal element. The cone profile 1451 may help restrict the seal element from rolling over or under the cone 1436.

As tension or load is applied the seal element may facilitate urging the cone 1436 against the slip, and thus moving the slip (or its segments) radially outwardly into contact or gripping engagement with the tubular.

Advantages

Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

A synergistic effect is realized because a smaller tool means faster drilling time is easily achieved. Again, even a small savings in drill-through time per single tool results in an enormous savings on an annual basis.

As the tool may be smaller (shorter), the tool may navigate shorter radius bends in well tubulars without hanging up and presetting. Passage through shorter tool has lower hydraulic resistance and may therefore accommodate higher fluid flow rates at lower pressure drop. The tool may accommodate a larger pressure spike (ball spike) when the ball seats.

One-piece slips are resistant to preset due to axial and radial impact allowing for faster pump down speed. This further reduces the amount of time/water required to complete frac operations.

A bottom position composite one-piece slip made of filament wound material provides significant advantages to metal or other composite-material slips, particularly one that overcomes deficiencies associated with characteristics of a filament winding process. An angled outer surface aids offsetting shear force on layer interfaces. A 'break' point promotes predictability, reliability, and prevents undesired preset.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool comprising:

a mandrel;

a bottom slip disposed around the mandrel, and further comprising:

a circular body having a plurality of slip segments connected by a one-piece configuration characterized by at least partial material connectivity therearound, wherein the bottom slip is made of a filament wound composite material further comprising a plurality of layers joined by respective interface layers, wherein an outer slip surface of an at least one of the plurality of slip segments is defined in cross-section by a plane P that intersects a longitudinal axis of the downhole tool at an angle a1 when the bottom slip is in an unset position, and wherein an end of the at least one of the plurality of slip segments further comprises a facet; and a bottom cone having an end face directly engaged with the facet of the bottom slip in the unset position, the engagement at a break angle b1 defined in cross-section by a break plane B that intersects the longitudinal axis, wherein the bottom cone has a sloped outer surface defined in cross-section by a plane P' that respectively intersects the longitudinal axis at an angle a1' that is oriented in an opposite direction to the angle a1, and wherein the sloped outer surface is not engaged with an inner slip surface in the unset position.

2. The downhole tool of claim 1, wherein each end of the plurality of slip segments further comprises a facet engaged with a respective cone surface.

3. The downhole tool of claim 1, wherein each adjacent slip segment is separated by a respective lateral groove having a depth that extends from the outer surface to an inner slip surface.

4. The downhole tool of claim 3, wherein the bottom cone comprises a plurality of raised fins, with a respective fin configured to move through the respective lateral groove, wherein the fin is not in contact with the slip when the slip is in the unset position.

5. The downhole tool of claim 3, wherein the inner slip surface comprises a transition region resulting in the inner slip surface having a first inner slip diameter that is smaller than a second inner slip diameter.

6. The downhole tool of claim 1, wherein the angle b1 is in the range of 20 degrees to 60 degrees, and wherein at least part of the bottom cone comprises a sulfide-based surface coating.

7. The downhole tool of claim 1, wherein each of the plurality of slip segments comprises a set of three inserts triangulated to each other, and wherein the sulfide-based coating comprises molybdenum disulfide.

8. The downhole tool of claim 1, wherein upon setting the angle a1 equals between −1 to 1 degrees, and an interface between two adjacent layers of the plurality of layers is defined in cross-section by an interface plane parallel to the plane P'.

9. The downhole tool of claim 8, the downhole tool further comprising:

a bearing plate disposed around the mandrel;

a top slip disposed around the mandrel, and proximate to the bearing plate;

a top cone disposed around the mandrel, and engaged with the top slip;

a sealing element disposed between the top cone and the bottom cone;

a lower sleeve threadingly engaged with the mandrel, wherein a gap is present between a tapered surface of the lower sleeve and a lateral slip end face.

10. The downhole tool of claim 9, wherein upon setting of the bottom slip the gap is closed by way of the tapered surface being in substantial contact with the lateral slip end face.

11. The downhole tool of claim 1, wherein an at least two slip segments are separated by a respective lateral groove having a depth that extends from the outer surface to an inner slip surface, wherein the bottom cone comprises a raised fin configured to move through the respective lateral groove as the downhole tool moves from the unset to a set position.

12. A downhole tool comprising:

a mandrel;

a bottom slip disposed around the mandrel comprising:

a circular body having a one-piece configuration characterized by at least partial material connectivity therearound, and further having a plurality of separated slip segments extending therefrom, wherein the bottom slip is made of a filament wound composite material further comprising a plurality of wound layers joined by respective interface layers, wherein an outer slip surface of an at least one of the plurality of slip segments is defined in cross-section by a plane P that intersects a longitudinal axis of the downhole tool at an angle a1 when the bottom slip is in an unset position, and wherein an end of each of the plurality of slip segments further comprises a facet; and a bottom cone having a plurality of end faces directly engaged with the respective facet of the bottom slip in the unset position, the engagement at a break angle b1 defined in cross-section by a break plane B that intersects the longitudinal axis, wherein the bottom cone has a sloped outer surface defined in cross-section by a plane P' that intersects the longitudinal axis of the downhole tool at an angle a1' that is oriented in an opposite direction to the angle a1, and wherein the sloped outer surface is not engaged with an inner slip surface in the unset position, wherein an at least two slip segments are separated by a respective lateral groove having a depth that extends from the outer slip surface to an inner slip surface, wherein the bottom cone comprises a raised fin configured to move through the respective lateral groove as the downhole tool moves from the unset to a set position, and wherein the raised fin is not in contact with any part of the bottom slip in the unset position.

13. The downhole tool of claim 12, wherein at least part of the cone comprises a surface coating to provide a resistive friction force to the bottom slip.

14. The downhole tool of claim 13, wherein the inner slip surface comprises a transition region resulting in the inner slip surface having a first inner slip diameter that is smaller than a second inner slip diameter.

15. The downhole tool of claim 12, the downhole tool further comprising:

a bearing plate disposed around the mandrel;

a top slip disposed around the mandrel, and proximate to the bearing plate;

a top cone disposed around the mandrel, and engaged with the top slip;

a sealing element disposed between the top cone and the bottom cone;

a lower sleeve threadingly engaged with the mandrel, wherein a gap is present between a tapered surface of the lower sleeve and a lateral slip end face.

16. The downhole tool of claim 15, wherein upon setting of the bottom slip, the angle a1 equals approximately zero degrees, and an interface between two adjacent layers of the plurality of layers is defined in cross-section by an interface plane lying parallel to the plane P', and wherein the gap is closed by way of the tapered surface being in substantial contact with the lateral slip end face.

17. A downhole tool comprising:

a mandrel;

a bearing plate disposed around the mandrel;

a top slip disposed around the mandrel, and proximate to the bearing plate;

a top cone disposed around the mandrel, and engaged with the top slip;

a bottom slip disposed around the mandrel comprising:

a circular body having a one-piece configuration characterized by at least partial material connectivity therearound, and the body further having a plurality of separated slip segments extending therefrom, wherein the bottom slip is made of a filament wound composite material further comprising a plurality of wound layers joined by respective interface layers, wherein an outer slip surface of an at least one of the plurality of slip segments is defined in cross-section by a plane P that intersects a longitudinal axis of the downhole tool at an angle a1 when the bottom slip is in an unset position, and wherein an at least one end of one of the plurality of slip segments further comprises a facet;

a bottom cone having a plurality of end faces directly engaged with the respective facet of the bottom slip in the unset position, the engagement at a break angle b1 defined in cross-section by a break plane B that intersects the longitudinal axis in a range of 20 degrees to 60 degrees;

a sealing element disposed between the top cone and the bottom cone; and a lower sleeve threadingly engaged with the mandrel, wherein the bottom cone has a sloped outer surface defined in cross-section by a plane P' that intersects the longitudinal axis at an angle a1' that is oriented opposite to the angle a1 wherein the bottom cone comprises a raised fin configured to move through a respective lateral groove between two adjacent slip segments as the downhole tool moves from an unset to a set position, and wherein the raised fin is not in contact with any part of the bottom slip in the unset position.

18. The downhole tool of claim 17, wherein the angle a1 and the angle a1' are in the range of 10 degrees to 20 degrees, wherein the angle b1 is in the range of 20 degrees to 60 degrees, and wherein at least part of the cone comprises a sulfide-based surface coating.

19. The downhole tool of claim 18, wherein in the set position the angle a1 equals −1 to 1 degrees, and an interface between two adjacent layers of the plurality of layers is defined in cross-section by an interface plane parallel to the plane P'.

* * * * *